US007442107B1

(12) United States Patent
Ueda et al.

(10) Patent No.: US 7,442,107 B1
(45) Date of Patent: Oct. 28, 2008

(54) ELECTRONIC TOY, CONTROL METHOD THEREOF, AND STORAGE MEDIUM

(75) Inventors: Mie Ueda, Tokyo (JP); Tomohiko Onishi, Tokyo (JP)

(73) Assignee: Sega Toys Ltd., Tokyo (JP)

( * ) Notice: Subject to any disclaimer, the term of this patent is extended or adjusted under 35 U.S.C. 154(b) by 90 days.

(21) Appl. No.: 09/698,676

(22) Filed: Oct. 26, 2000

(30) Foreign Application Priority Data

Nov. 2, 1999 (JP) ..... 1999-313033
Mar. 15, 2000 (JP) ..... 2000-72778

(51) Int. Cl.
*A63H 30/00* (2006.01)

(52) U.S. Cl. ..... 446/175; 700/245

(58) Field of Classification Search ..... 446/175, 446/376–377; 700/245, 253
See application file for complete search history.

(56) References Cited

U.S. PATENT DOCUMENTS 3,867,786 A * 2/1975 Greenblatt ..... 446/130
4,139,968 A 2/1979 Milner
4,221,927 A 9/1980 Dankman et al.
4,245,430 A 1/1981 Hoyt
4,267,606 A 5/1981 Stelter et al.
4,451,911 A 5/1984 Klose et al.
4,642,710 A * 2/1987 Murtha et al. ..... 360/79
4,654,659 A 3/1987 Kubo
4,673,371 A 6/1987 Furukawa
4,717,364 A 1/1988 Furukawa
4,740,186 A 4/1988 Sirota
4,754,133 A 6/1988 Bleich
4,802,879 A 2/1989 Rissman et al.
4,840,602 A 6/1989 Rose
4,857,030 A 8/1989 Rose
4,923,428 A 5/1990 Curran
4,949,327 A 8/1990 Forsse et al.
5,141,464 A 8/1992 Stern et al.
5,267,886 A 12/1993 Wood et al.

(Continued)

FOREIGN PATENT DOCUMENTS

EP 0 898 237 A2 2/1999

(Continued)

OTHER PUBLICATIONS

Poo-Chi (Instructional manual) Copyright 200 Tiger Electronics, LTD.*

*Primary Examiner*—Robert E Pezzuto
*Assistant Examiner*—Alex F. R. P. Rada, II
(74) *Attorney, Agent, or Firm*—Perry Hoffman

(57) ABSTRACT

An electronic toy has a head, a body and legs. A display that displays the expression of the eyes is provided to the front of the head, and a speaker and a detection switch that detects the pressing of such speaker are provided on the upper face of the head. A sound sensor and light sensors are housed inside a nose. Ears are rotatably provided on both sides of the head, and a lower jaw capable of being opened/closed is provided below the nose. A tail is provided to the rear of the body. A controller housed in the nose controls the posture, outcry, melody, expression of the eyes, etc. from the communication biorhythm and pet biorhythm prepared in accordance with the way a user contacts the toy through sensory input indicated with detection signals from the sound sensors, infrared sensors, feeding indications, light sensors, and the like.

12 Claims, 37 Drawing Sheets

U.S. PATENT DOCUMENTS

| | | | | | |
|---|---|---|---|---|---|
| 5,281,143 | A | | 1/1994 | Arad et al. | |
| 5,324,225 | A | | 6/1994 | Satoh et al. | |
| 5,572,646 | A | * | 11/1996 | Kawai et al. | 345/473 |
| 5,636,994 | A | | 6/1997 | Tong | |
| 5,700,178 | A | | 12/1997 | Cimerman et al. | |
| 5,870,527 | A | | 2/1999 | Fujikawa et al. | |
| 5,908,345 | A | * | 6/1999 | Choi | 426/3 |
| 5,929,585 | A | | 7/1999 | Fujita | |
| 5,933,152 | A | * | 8/1999 | Naruki et al. | 345/501 |
| 5,963,712 | A | | 10/1999 | Fujita et al. | |
| 5,966,526 | A | * | 10/1999 | Yokoi | 703/11 |
| 6,083,104 | A | * | 7/2000 | Choi | 446/436 |
| 6,149,490 | A | * | 11/2000 | Hampton et al. | 446/298 |
| 6,175,772 | B1 | * | 1/2001 | Kamiya et al. | 700/31 |
| 6,213,871 | B1 | * | 4/2001 | Yokoi | 273/460 |
| 6,227,966 | B1 | * | 5/2001 | Yokoi | 446/143 |
| 6,273,815 | B1 | * | 8/2001 | Stuckman et al. | 434/238 |
| 6,330,494 | B1 | * | 12/2001 | Yamamoto | 318/568.12 |
| 6,337,552 | B1 | * | 1/2002 | Inoue et al. | 318/568.1 |

FOREIGN PATENT DOCUMENTS

| | | | | |
|---|---|---|---|---|
| EP | 898237 | A2 | * | 2/1999 |
| EP | 0 923 011 | A2 | | 6/1999 |
| EP | 0 924 034 | A2 | | 6/1999 |
| JP | 1050592 | | | 6/1999 |
| JP | 1038550 | | | 9/1999 |
| JP | 1050592-1 | | | 9/1999 |
| WO | WO 96/03190 | A1 | | 2/1996 |
| WO | WO 97/41936 | | | 11/1997 |
| WO | WO 99/64208 | | | 12/1999 |
| WO | WO 99/67067 | | | 12/1999 |

* cited by examiner

DISPLAY OF EYES-ORDER

| | | DISPLAY |
|---|---|---|
| 1 | HEART | 72a 72b |
| 2 | UPPER RIGHT ROUND EYE | 71b |
| 3 | ANGRY EYES | 73a 73b |
| 4 | RIGHT-EYED WINK | 71a 73b 73a |
| 5 | CRYING EYES | 71a 71b 74b 74a |
| 6 | OVERALL ROUND EYES | 71a 71b 73b 73a |
| 7 | UPPER LEFT ROUND EYE | 71a |
| 8 | LEFT-EYED WINK | 71b 73b |
| 9 | CLOSED EYES | 73a |

FIG. 15

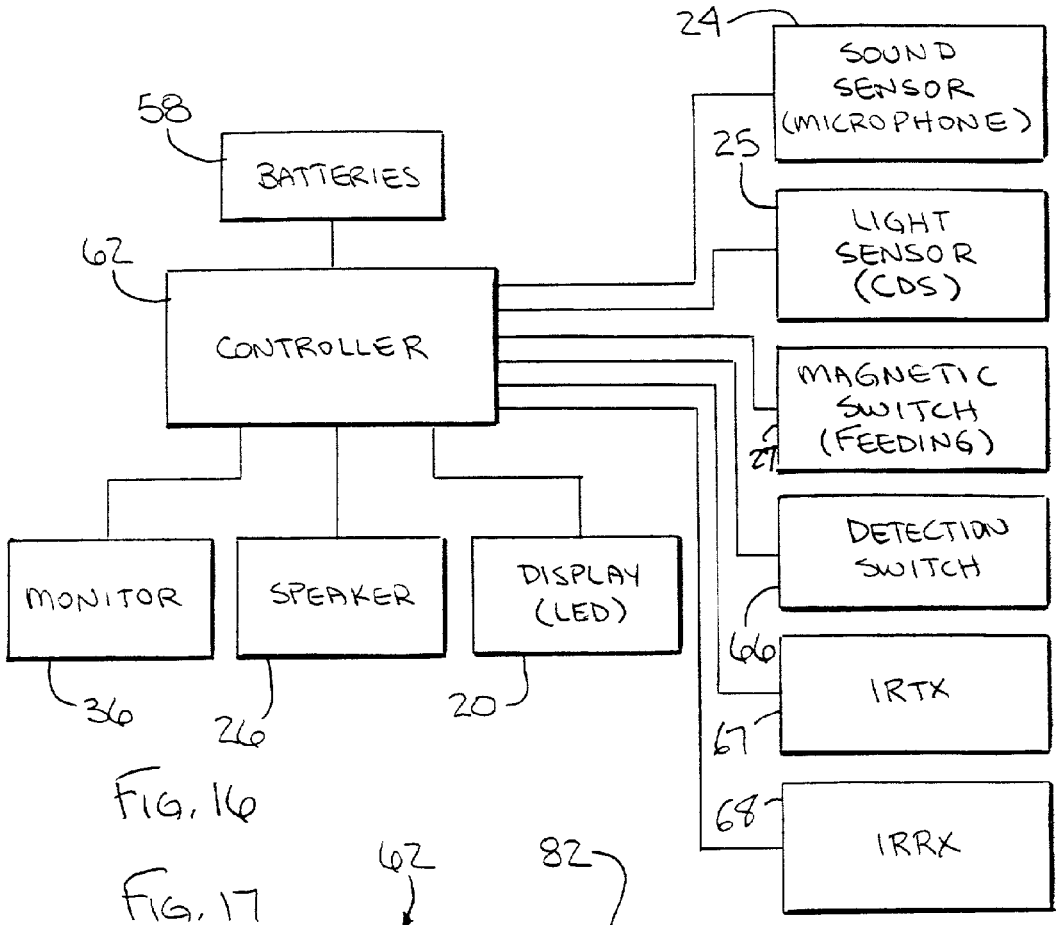
FIG. 16
FIG. 17
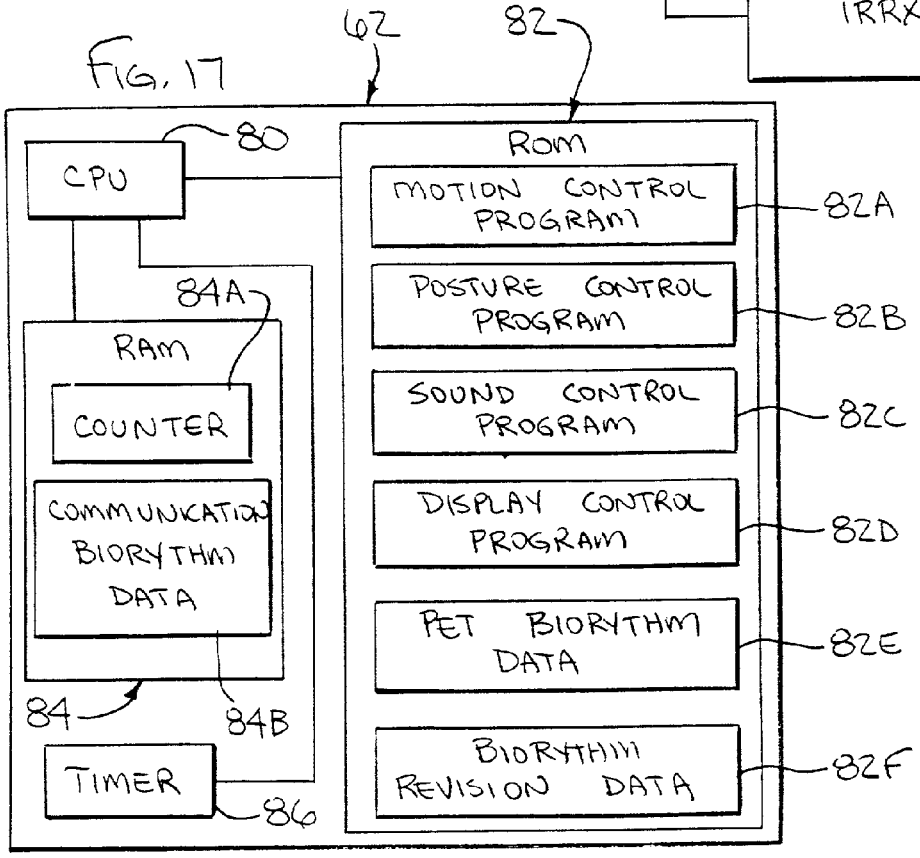

FIG. 22

| | Male Characteristics | Female Characteristics |
|---|---|---|
| ① | low voice version | basic voice pattern |
| ② | male version is normal pattern of eyes | femal version is normal pattern of eyes |
| ③ | having special songs | having special dances |

*Fig. 31(A)*

| | motion | right foot | | left foot | | hind legs | | | | |
|---|---|---|---|---|---|---|---|---|---|---|
| | | A | B | A | B | C | D | E | F | |
| 1 | stand | O | | O | | O | | | | |
| 2 | sit | O | | O | | | O | | | |
| 3 | lie down | | O | | O | | | O | | |
| 4 | growl | O | O | O | O | O | | | | back and forth between A and B; 3 sets |
| 5 | hand | O | O | O | | | O | | | back and forth between A and B; 3 sets |
| 6 | go | | | | O | | O | | | rotation of B after D |
| 7 | wriggle 1 | O | O | O | O | | | O | | back and forth between A and B; 3 sets |
| 8 | wriggle 2 | O | O | O | O | | | | O | back and forth between A and B; 3 sets |
| 9 | stretch 1 | O | O | O | O | O | | | | |
| 10 | stretch 2 | | O | | O | | | | O | |
| 11 | stretch 3 | O | | O | | | | | O | |
| 12 | pushup | O | O | O | O | | | | O | back and forth between A and B; 3 sets |
| 13 | back 1 | O | | O | | rotation | rotation | rotation | rotation | 3 rotations |
| 14 | back 2 | | O | | O | rotation | rotation | rotation | rotation | 3 rotations |
| 15 | perform | O | | O | O | | O | | | back and forth between A and B during performance |

*Fig. 31(B)*

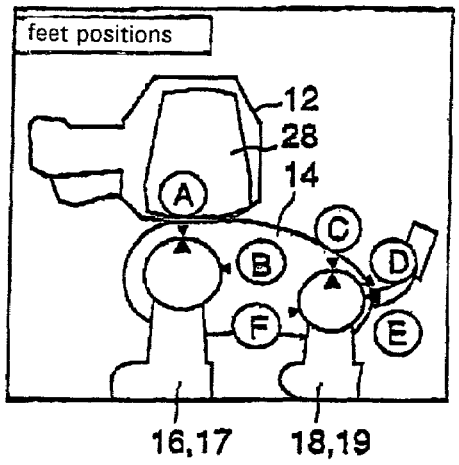

*Fig. 37*
(A) Register Sounds
| registered word | 6 of the registered words |
|---|---|
| i | name (dog) |
| ii | hand |
| iii | lie down |
| iv | sit |
| v | good |
| vi | let's play |
(B) Register Steps
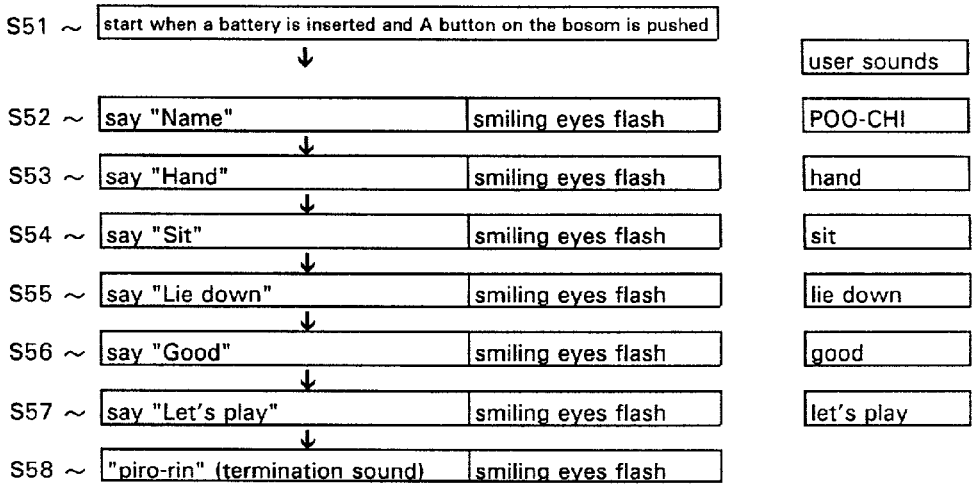
(C) Unsuccessful Example of Registration
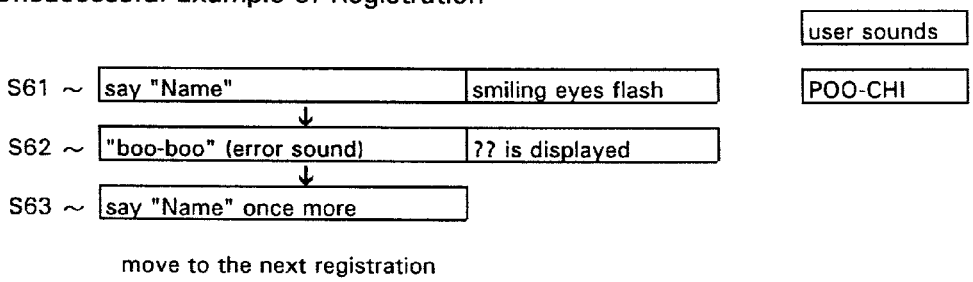
(D) Successful Example of Registration
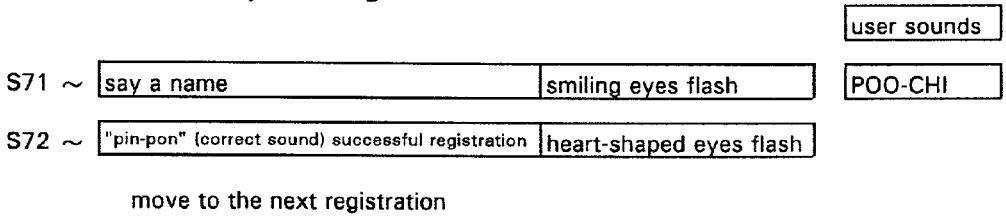

*Fig. 38*

(A) Character Characteristic

| | |
|---|---|
| cur | rude voice and rude singing;<br>disobedient to the orders of the master;<br>stray dog which only sleeps |
| faithful dog | faithful character;<br>ability to sing |
| performing dog | ability to play special tricks with the command "Let's play" |

(B) Character Formation Parameter MAP 102

| point | faithful dog parameter | | | performing dog parameter |
|---|---|---|---|---|
| 25 | O | | | |
| 20 | O | | | |
| 15 | O | O | O | O |
| 10 | O | O | O | O |
| 5 | O | O | O | O |
| command | hand | sit | lie down | let's play |

(C) Conditions for Changing Character

| | |
|---|---|
| fills up all MAP within 4 hours | performing dog |
| fills us all MAP other than the performing dog parameter within 4 hours | faithful dog |
| fills up neither MAP within 4 hours | cur |

FIG. 39
<Example> Register Character
(A) incorrect the first time
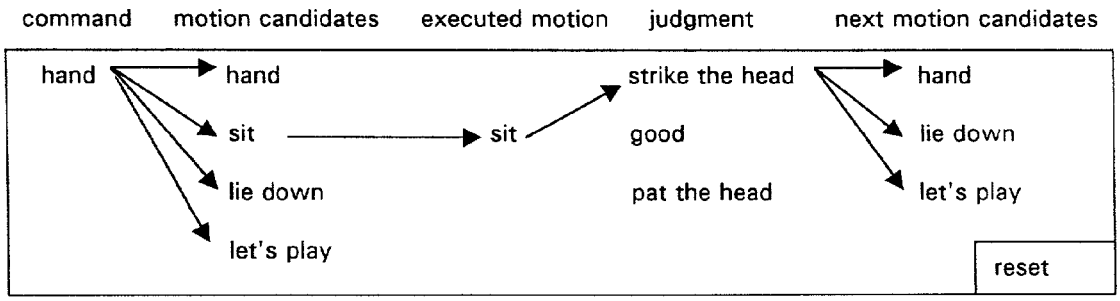
(B) correct in the second time
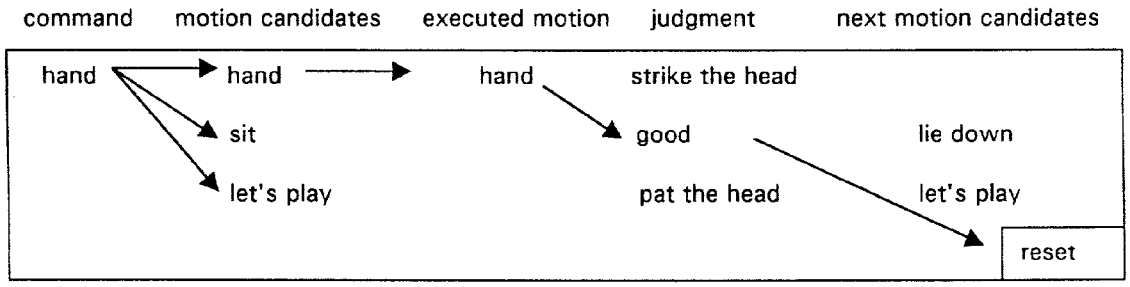

*Fig. 41*

(A) Mood parameter

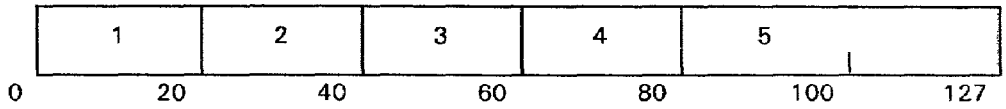

(B)

| state | level | mood parameter |
|---|---|---|
| ultra happy mode | 5 | 81~127 |
| happy mode | 4 | 61~80 |
| normal | 3 | 41~60 |
| grumpy mode | 2 | 21~40 |
| ultra grumpy mode | 1 | 0~20 |

(C) Positive conditions

| motion | increase value |
|---|---|
| the head is patted | 2 |
| praised after the motion in response to user's voice | 4 |
| told "no" after the motion in response to user's voice | 1 |

(D) Negative conditions

| motion | | decrease value |
|---|---|---|
| the head is struck | | -1 |
| As the time elapses, the mood parameter fluctuates in accordance with the hungry value (decreases every one minute) | fullness level 5 | -2 |
| | fullness level 4 | -4 |
| | fullness level 3 | -6 |
| | fullness level 2 | -8 |
| | fullness level 1 | -10 |
| The mood parameter will become 100 if it exceeds 100 at bedtime | | |
| The mood parameter will become 20 if it exceeds 127 | | |

(A) Fullness parameter (B)

| state | level | mood parameter |
|---|---|---|
| ultra full | 5 | 81~127 |
| full | 4 | 61~80 |
| normal | 3 | 41~60 |
| hungry | 2 | 21~40 |
| ultra hungry | 1 | 0~20 |

(C) Positive conditions

| motion | increase value |
|---|---|
| food is given | 4 |

(D) Negative conditions

| motion | decrease value |
|---|---|
| occurrence of voice or motor action | -1 |
| elapse of time (decreases every one minute) | -4 |

*Fig. 44*

| fullness parameter value | | mood parameter fluctuation value |
|---|---|---|
| level 5 | 80~127 | -60 |
| level 4 | 61~80 | -70 |
| level 3 | 41~60 | -80 |
| level 2 | 21~40 | -90 |
| level 1 | 0~20 | -100 |

ELECTRONIC TOY, CONTROL METHOD THEREOF, AND STORAGE MEDIUM

BACKGROUND OF THE INVENTION

1. Field of the Invention

The present invention relates to an electronic toy capable of controlling motions arbitrarily in accordance with external sounds and contacts, control method thereof, and storage medium.

2. Description of the Related Art

Animal dolls, such as those of dogs, cats, bears, etc., have been widely used as toy animals from the past. Further, there are toy animals wherein motors and speakers are built in the animal dolls or the body of animal-shaped toys manufactured from synthetic resin. For example, by contacting the head and pressing it down, the toy animals will conduct prescribed motions such as moving the feet or mouth, and generate prescribed cries.

With these types of toy animals, as the same motions are repeated and the same cries are generated repeatedly, the user will often lose interest in the toy easily. Contrarily, if the motions are selected at random, the user will also lose interest in the toy easily since the motions expected by such user will not be made. In light of such conventional toy animals, electronic toys with microcomputers for controlling various motions such that the user will not lose interest in the toy have been developed.

As an example of such electronic toy, there are those that conduct certain motions (e.g., generating pre-stored phrases from a speaker, shaking the body, etc.) pursuant to commands of a microcomputer upon the user stroking the head, lifting the toy, speaking to it, and so on. This type of electronic toy counts the number of times the head was stroked, the number of times the doll was raised, the number of times the user spoke to it and, for example, controls the toy to gradually change the phrases generated from the speaker to become a more charming expression pursuant to the increase in the count value.

With the conventional electronic toy described above, as the toy will merely change the spoken words to gradually become a more charming expression pursuant to the increase in the number of times the head was stroked, the number of times the toy was lifted, and the number of times the user spoke to the toy, the motion patterns thereof are predictable.

Thus, with conventional electronic toys, there is a problem in that the user will lose interest in the toy in a relatively short period of time as such user will know what the toy will say next pursuant to the length of contracting such toy.

SUMMARY OF THE INVENTION

Accordingly, an electronic toy is provided which overcomes the aforementioned problems by changing the motion patterns in accordance with the frequency of external input of sounds and contacts or the result of combining parameters that change with time. The disclosed electronic toy is further capable of controlling motions arbitrarily in accordance with external inputs received at detection input sensors by detecting sequences of external inputs for predetermined time intervals in which a number of detection signals are output from the detection input sensors, with parameter alteration for changing the parameter value in accordance with the predetermined time intervals. Memory is provided for storing information relating to a plurality of motion patterns which moves the electronic toy, and a selection is made based upon detection signals being output from the detection input sensors. Information relating to arbitrary motion patterns among the plurality of motion patterns is stored in memory pursuant to the parameter value set by the parameter alteration.

Thus, an information processor for controlling the electronic toy generates movements according to selected motion patterns. Accordingly, when detection signals are output from the detection input sensors, information of an arbitrary motion pattern among the plurality of motion patterns stored is selected based on the parameter value determined with the parameter alteration. Thus, for example, when external inputs of sound or contact are made, it is possible to make the motions differ pursuant to the input timing. Moreover, as it is possible to control the toy to take unexpected actions in response to the input, the user will not lose interest even after long hours of playing with the toy since it is difficult to predict the motion pattern.

The parameter alteration means alternates between a happy mode and grumpy mode in predetermined cycles based on the control parameter which changes together with the lapse in time. Thus, the happy mode and grumpy mode may be alternated in predetermined cycles based on the control parameter which changes together with the lapse in time, such that the toy may switch between the happy mode or grumpy mode pursuant to he input timing, and it is therefore possible to increase the amusement by conducting unpredicted motions. Further, the modes of operation may be changed in accordance with the number of detections, and thus the cycle of, e.g., the happy mode, may be extended pursuant to the way the user contacts the toy. Therefore, it is possible to increase the amusement since the motion pattern at such time will be difficult to predict and unexpected motions are conducted.

The selection means selects information on a special motion pattern when the value representing the parameter change conforms with the count representing the parameter change conforms with predetermined values. To this end, the detection input sensors include sound detection means for detecting external sound, contact detection means for detecting external contact, and light detection means for detecting changes in the brightness of the surrounding light. Accordingly, by detecting the changes in external sounds, external contacts, and the brightness of the surrounding light, the toy will recognize that it is being treated with affection. Thus, it is further possible to produce interesting reactions in response to the inputs by making the motion pattern selected according to the sound detection frequency, contact detection frequency, and light detection frequency.

The memory provides for a first storage unit for storing data of a plurality of posture motion patterns which changes the posture, a second storage unit for storing data of a plurality of sound patterns which changes the sound, and a third storage unit for storing data of a plurality of expression patterns which changes the expression. Thus, an arbitrary motion may be selected from the data of posture motion patterns stored in the first storage unit, sound patterns stored in the second storage unit, and expression patterns stored in the third storage unit. The selection of a combination of the posture motion pattern, sound pattern, and expression pattern stored in the memory facilitates selection of a combination of the posture motion pattern, sound pattern, and expression pattern. The expression pattern includes a motion pattern for changing at least the size or the shape of the eyes. Thus, produced is an expression according to the changes in the character at such time. The electronic toy is thus capable of controlling motions arbitrarily in accordance with external inputs with a head housing a drive motor and a transmission mechanism for transmitting rotational driving force to the drive motor, a display for displaying the shape of the eyes are provided from the front of the head, first detection means provided on the top of the head and for detecting the pressing thereof, second detection means for detecting sound, third detection means for detecting the peripheral brightness, a body housing a cam mechanism, which is driven by rotational driving force from said drive motor via the transmission mechanism, legs driven by said cam mechanism, a lower jaw driven by said transmission mechanism, ears driven by said transmission mechanism, storage means for storing the respective motion patterns of the legs, lower jaw, and ears, and a controller for selecting an arbitrary motion pattern among the plurality of motion patterns stored in the storage means in accordance with the timing of detection signals output from the first to third detection means, and controlling the drive motor and the display pattern of the display in accordance with the selected motion pattern. Arbitrary motion patterns are then selected among a plurality of motion patterns stored in the storage means according to the timing of the detection signals output from the first through third detection means, and as the drive motor and the display pattern of the display are controlled according to the selected motion pattern.

The electronic toy arbitrarily controls motions in accordance with external inputs by setting the initial mode for a period after the power is turned on until a prescribed time elapses, detecting external inputs while the initial mode is initialized such that the individual differences of gender and the like may be determined pursuant to the number of times the user contacts the toy while the initialization mode is being set after the batteries are foremost installed. This enables the production as though the electronic toy has a gender and character of an animal as individual differences will appear with respect to the expression, sound, and motion in correspondence with the contact of the user after initialization. The individual difference setting means sets individual differences pursuant to whether the count value of the counter is an add or even number. Accordingly, individual differences are set pursuant to whether the count value of the number of inputs detected during the setting of the initialization mode is an odd or even number. This further enables the production as though the electronic toy has a gender and character of an animal as individual differences will appear with respect to the expression, sound, and motion in correspondence with the contact of the user after initialization. The electronic toy may also be provided with gender and like characteristics of an animal as individual differences appear with respect to the expression, sound, and motion in correspondence with the contact of the user after initialization.

BRIEF DESCRIPTION OF THE DRAWINGS

The preferred embodiments of the present invention are now explained with reference to the drawings.

FIG. 15 is a diagram showing the combinations of the display patterns to be illuminated and displayed on the display;

FIG. 16 is a block diagram showing the structure of the control system of the electronic toy;

FIG. 17 is a block diagram showing the structure of the controller;

FIG. 22 shows male and female gender data associated with eye patterns A and B shown in FIGS. 23 and 24 respectively, with associated voice and song gender characteristics;

FIG. 31 is a diagram showing the combinations of motion types of the electronic toy 90 and the motion positions of the legs 16-19; (A) is a diagram showing the combinations of the motion types and the motion positions of the legs 16-19; and (B) is a diagram respectively showing the rotation angles of the legs 16-19;

FIG. 37 is a diagram for explaining a sound registration; (A) is a diagram showing an example of registered words to be used in sound registration; (B) is a flowchart for explaining the steps of sound registration; (C) is a flowchart for explaining an unsuccessful example of sound registration; and (D) is a flowchart for explaining a successful example of sound registration;

FIG. 38 is a diagram for explaining an example of conditions for character formation; (A) is a diagram showing the characteristics of the character; (B) is a diagram showing an example of the character formation parameter MAP; and (C) is a diagram showing an example of conditions for character changing;

FIG. 39 is a diagram for explaining an example of character registration motions; (A) is a diagram showing an example of an incorrect motion; and (B) is a diagram showing an example of a correct motion;

FIG. 41 is a diagram explaining the mood parameters; (A) indicates the level of the mood parameter; (B) indicates the state of the respective level; (C) indicates positive conditions to the mood parameter; and (D) indicates negative conditions to the mood parameter;

FIG. 44 is a graph showing an example of the changing values of the mood parameter in accordance with the fullness parameter value $P_B$;

DETAILED DESCRIPTION OF THE PREFERRED EMBODIMENT

Figure 1:
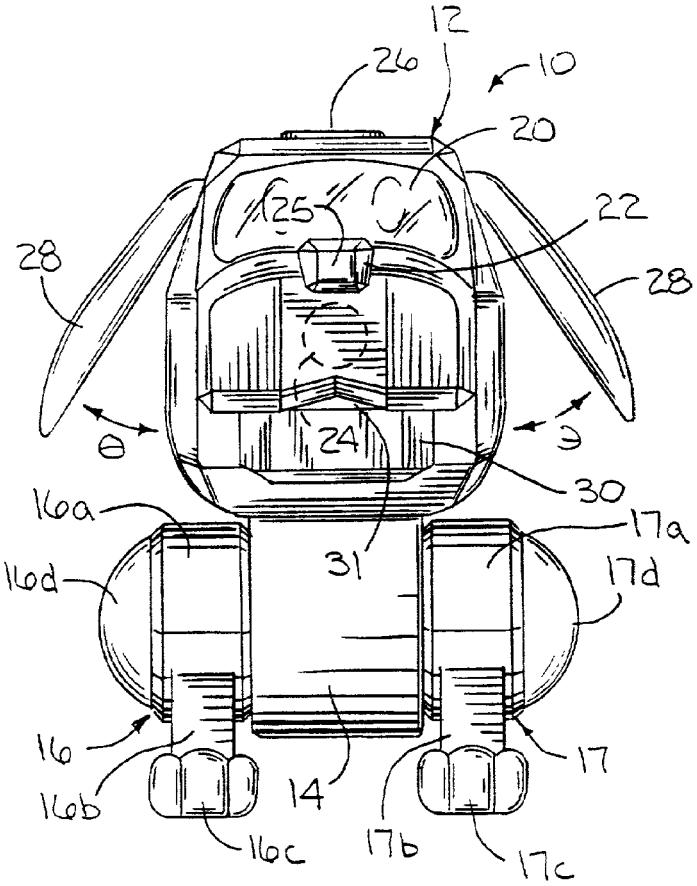
FIG. 1 is a front view of the electronic toy according to an embodiment of the present invention.
Figure 2:
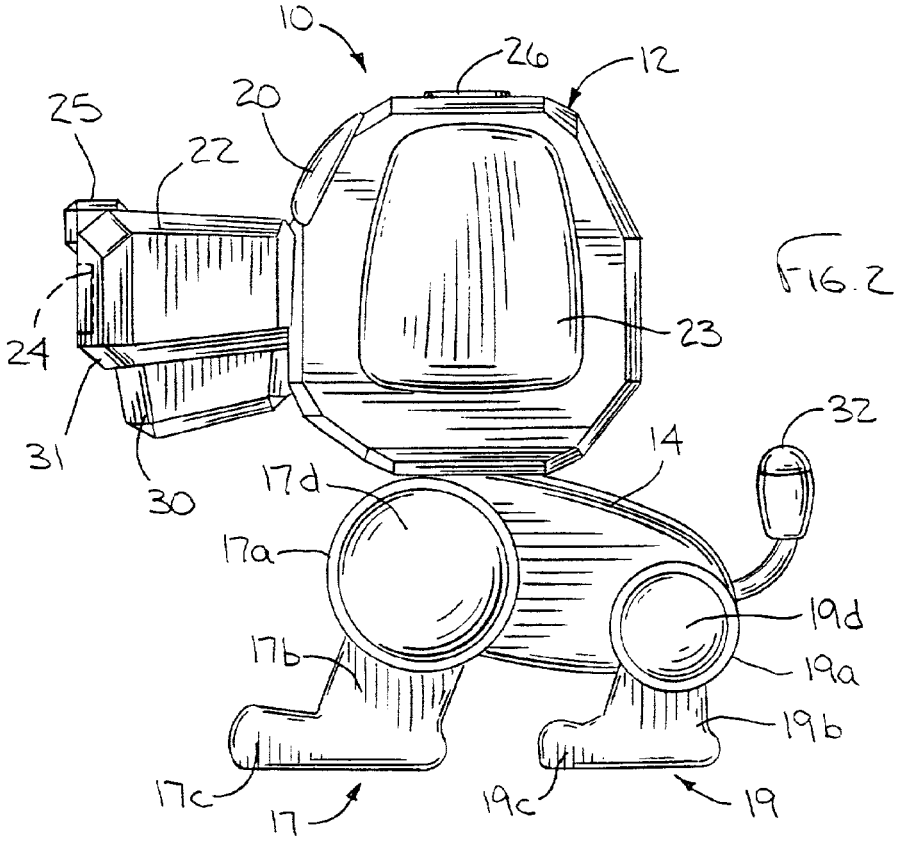
FIG. 2 is a side view of the electronic toy shown in FIG. 1.
Figure 3:
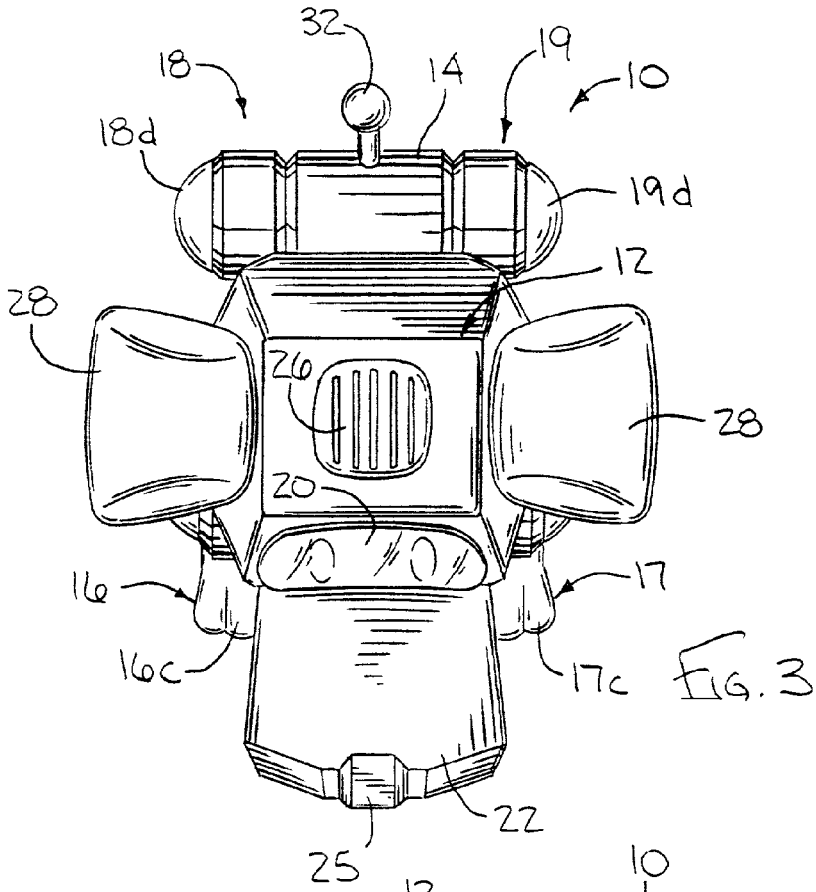
FIG. 3 is a plan view of the electronic toy shown in FIG. 1.
Figure 4:
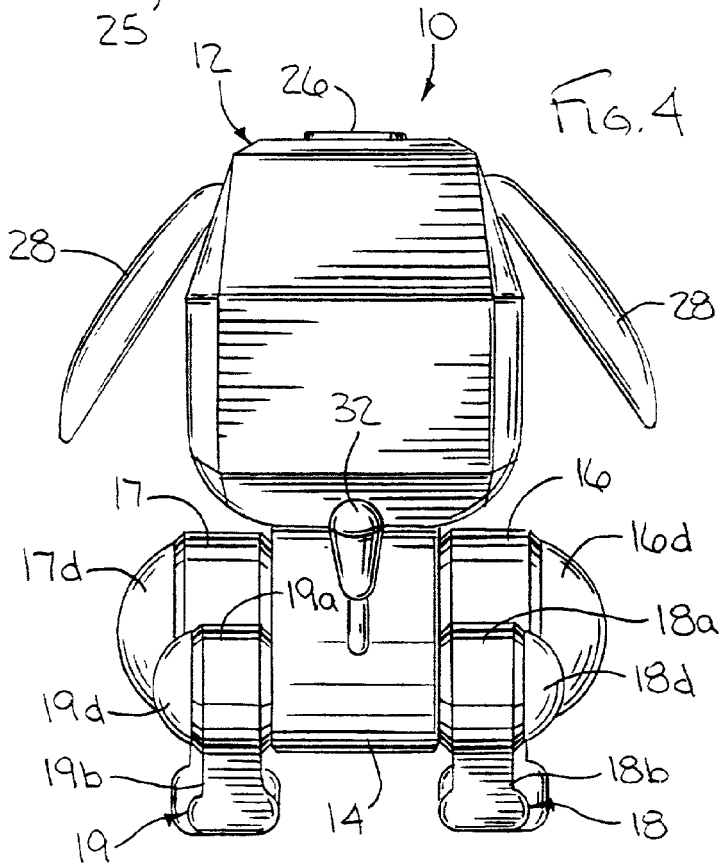
FIG. 4 is a rear view of the electronic toy shown in FIG. 1.
Figure 5:
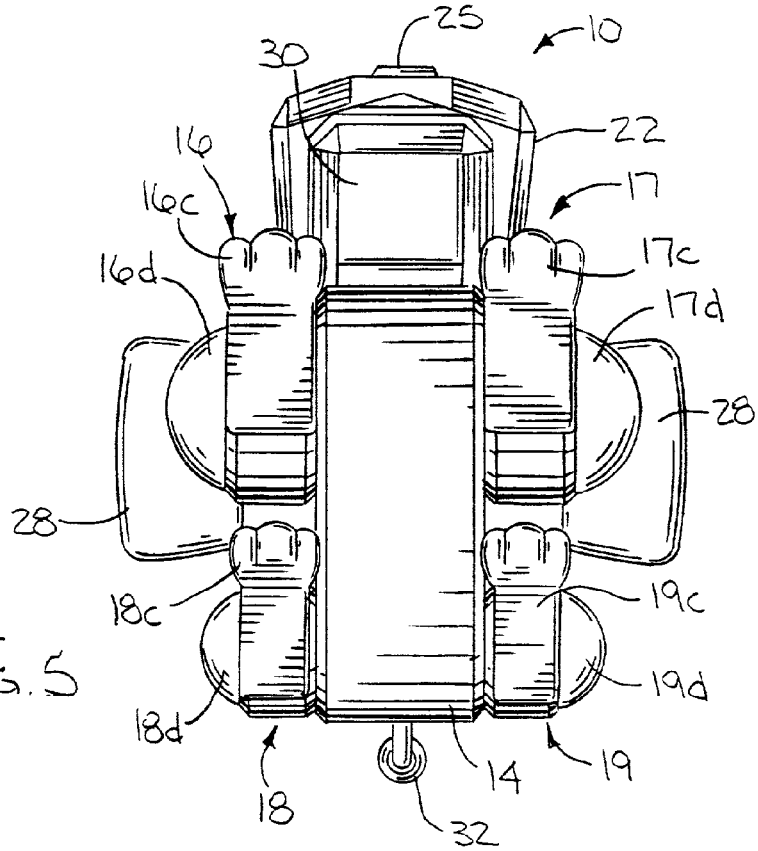
FIG. 5 is a bottom view of the electronic toy shown in FIG. 1.
Figure 6:
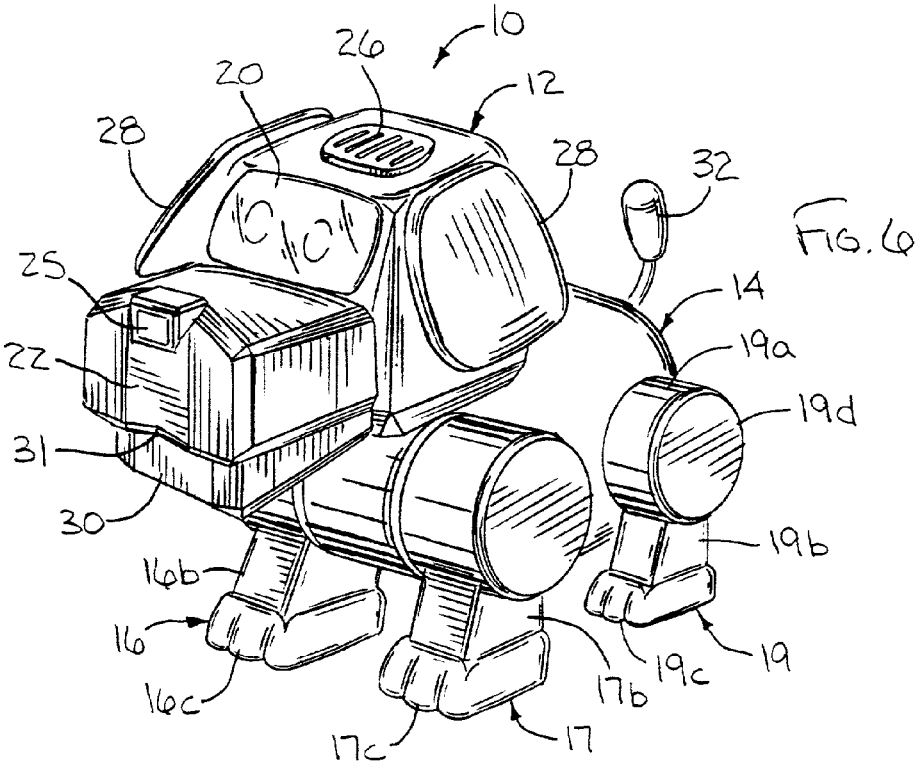
FIG. 6 is a perspective view of the electronic toy shown in FIG. 1.

As shown in FIGS. 1 through 6, the electronic toy 10 is a dog-shaped toy having, in summary, a head 12, body 14, and legs 16-19. Although the electronic toy 10 of this embodiment is structured such that the four legs 16-19 are provided to both sides of the body 14, it does not walk. That is, the electronic toy 10 is structured to change its posture by the rotational motion of the legs 16-19 by rotating such legs 16-19 at a prescribed angle in accordance with the changes in the feeling as described later.

The four legs 16-19 are respectively formed of circular axes 16*a*-19*a* rotatably supported at both sides of the body 14, shanks 16*b*-19*b* extending in the radial direction from the axes 16*a*-19*a*, and toes 16*c*-19*c* provided at the tip of the shanks 16*b*-19*b*.

Moreover, the legs 16-19, axes 16*a*-19*a*, shanks 16*b*-19*b*, and toes 16*c*-19*c* are formed integrally, and joints different from those of actual dogs are not provided to the legs 16-19. Semispherical caps 16*d*-19*d* are provided to the side of the axes 16*a*-19*a*, and these caps 16*d*-19*d* may be colored an arbitrary color.

A display 20 for displaying the expression of the eyes is provided to the front of the head 12. Although this display 20 ordinarily displays oval eyes pursuant to the illumination of light emitting diodes (LED), a plurality of LEDs may be selectively illuminated as explained later in order to change the display pattern of the eyes for expressing the feeling at such time.

A sound sensor 24 (sound detection means) structured of a microphone for detecting peripheral sounds is built in the tip face of the nose 22 protruding frontward from the front of the head 12. A light sensor 25 for detecting the peripheral brightness is stored in the upper corner of the nose 22. The light sensor of the present embodiment, for example, is formed of CdS cells (cadmium sulfide cells) and outputs detection signals in accordance with the brightness of the incoming light.

A speaker 26 for producing barking sounds or playing melodies is provided to the upper face of the head 12. This speaker 26 is mounted slidably in the upward/downward directions as described later and, for example, when the head 12 is pushed, the speaker 26 is moved downward so as to detect that the toy has been stroked.

On both sides of the head 12, provided are ears 28 formed of semi-transparent material colored an arbitrary color different than that of the head 12. The upper part of the ears 28 are connected rotatably to the side of the head 12 and, as explained later, rotates upward or downward in accordance with the changes in the feeling at such time.

A lower jaw 30 at the lower side of the nose 22 is provided rotatably to be in an opened position or closed position and operates with the mouth 31 in an open state or closed state in accordance with the changes in the feeling at such time.

A tail 32 is provided to the rear of the body 14 so as to move upward or downward in accordance with the changes in the feeling at such time.

Figure 7:
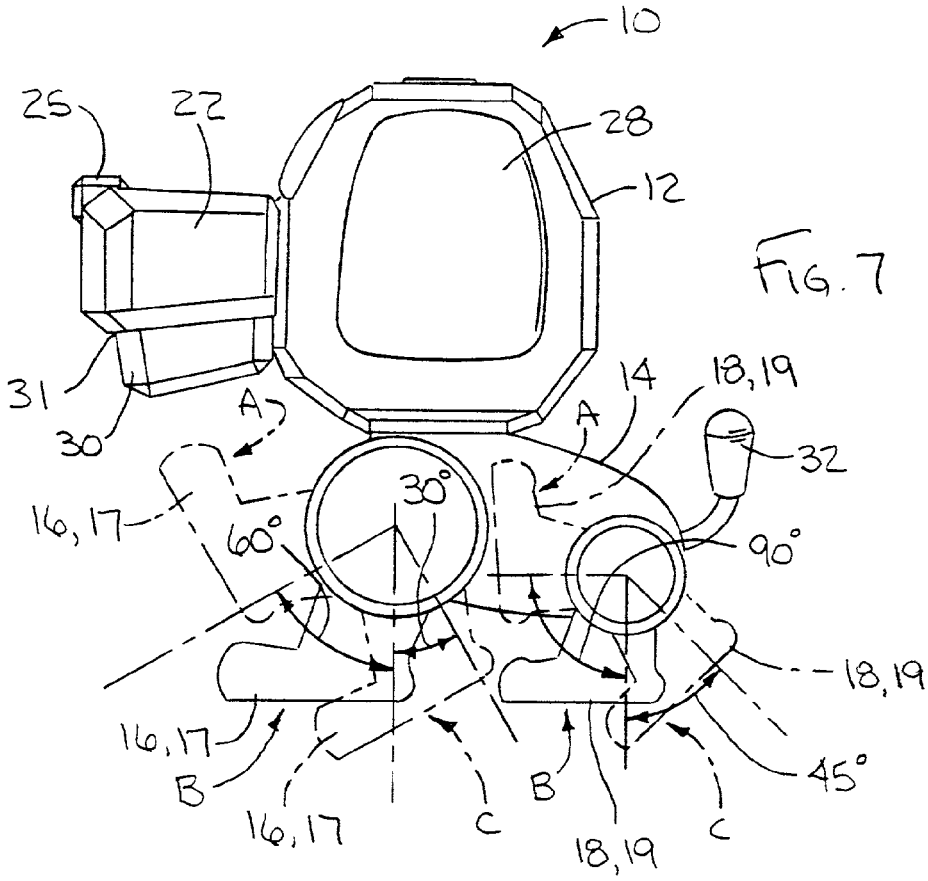
FIG. 7 is a side view of the electronic toy showing the rotational direction and rotational angle of the legs.

The motion patterns of the electronic toy 10 structured as above are explained below. As shown in FIG. 7, the front legs 16 and 17 among the legs 16-19 are provided such that they are capable of being positioned in motion position A rotated 60 degrees in the forward direction (a direction) from standstill position B, and in motion position C rotated 30 degrees in the backward direction (b direction) from standstill position B. Moreover, the hind legs 18 and 19 are provided such that they are capable of being positioned in motion position A rotated 90 degrees in the forward direction (a direction) from standstill position B, and in motion position C rotated 45 degrees in the backward direction from standstill position B.

Figure 8:
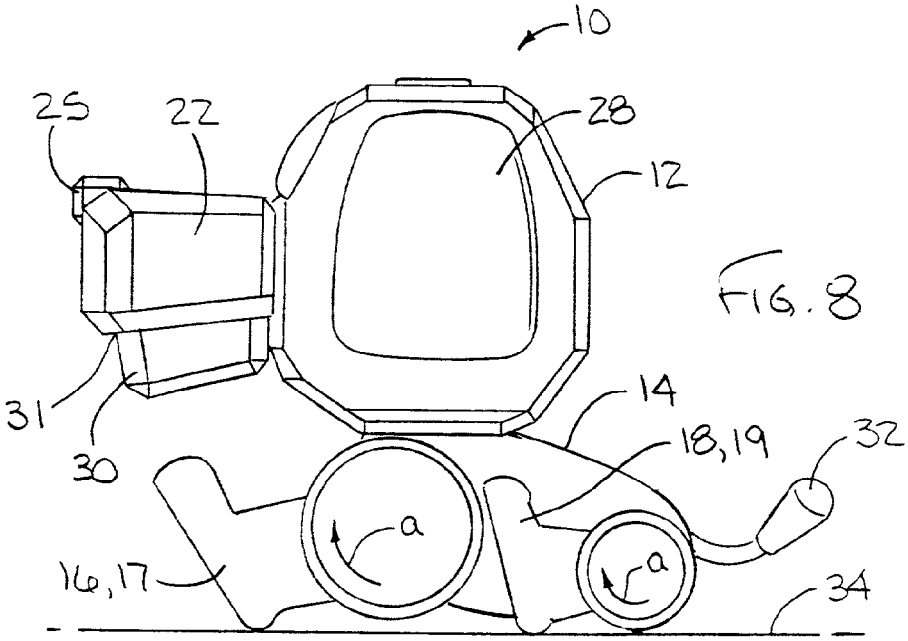
FIG. 8 is a side view showing the motional state when the electronic toy is in the sleeping posture A.

FIG. 8 is a side view showing the motional state when the electronic toy 10 is in the sleeping posture A. As shown in FIG. 8, when the electronic toy 10 is in the sleeping posture A, the respective legs 16-19 are rotated to motion position A. Thus, the respective legs 16-19 are extending forward along both sides of the body 14, the bottom of the body 14 is near the floor 34, and the electronic toy 10 is therefore in posture A. Therefore, the electronic toy 10 may express with its entire body the feeling of, for example, sleepiness or gloominess, by taking posture A described above.

Figure 9:
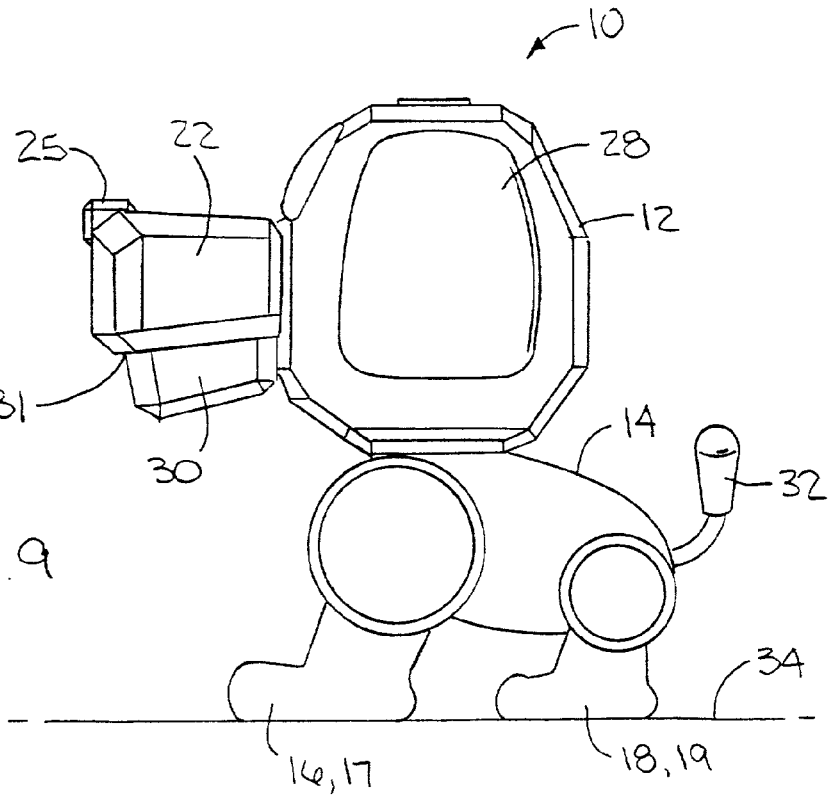
FIG. 9 is a side view of the motional state when the electronic toy is in the standing posture B.

FIG. 9 is a side view of the motional state when the electronic toy 10 is in standing position B. As shown in FIG. 9, when the electronic toy 10 is in the standing posture B, the respective legs 16-19 are rotated to motion position B. Thus, the respective legs 16-19 are rotated to a position (standstill position B) such that they extend downward from both sides of the body 14, the bottom of the body 14 is far from the floor 34, and the electronic toy 10 is therefore posture B. Further, during posture B, the whole surface of the bottom of the respective legs 16-19 (bottom of feet) is closely contacting the floor 34. Therefore, the electronic toy 10, for example, when it is not doing anything, maintains the aforementioned standing posture B in ordinary situations.

Figure 10:
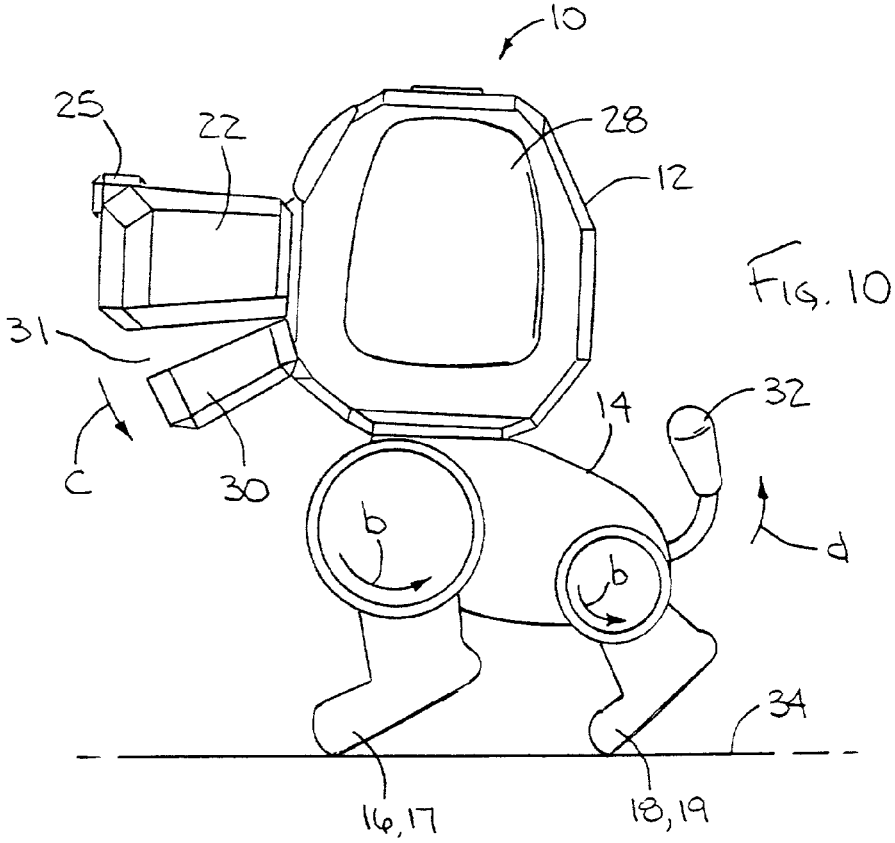
FIG. 10 is a side view of the motional state when the electronic toy is in the leaning-forward posture C.

FIG. 10 is a side view of the motional state when the electronic toy 10 is in the leaning-forward posture C. As shown in FIG. 10, when the electronic toy is in the leaning-forward posture C, the respective legs 16-19 are at motion position C by being rotated in the b direction with respect to posture B. Thus, the respective legs 16-19 become a posture similar to a tiptoe by standing on the tip of the toes 16*c*-19*c*, the heels of the respective legs 16-19 will rise from the floor 34, and the electronic toy is therefore is posture C. During posture C, the lower jaw 30 is rotated in the lower direction c direction) in order to open the mouth, and the tail 32 is rotated in the upward direction (d direction). Moreover, the ears 28 shown in FIG. 1 will rotate in the upward direction (e direction). Therefore, the electronic toy 10 may express with its entire body the feeling of, for example, happiness or pleasure by taking posture C described above.

With the electronic toy of this embodiment, the motion patterns of the three types of postures A-C described in aforementioned FIGS. 8-10 are the basic motions. The internal structure of the electronic toy 10 is now described.

Figure 11:
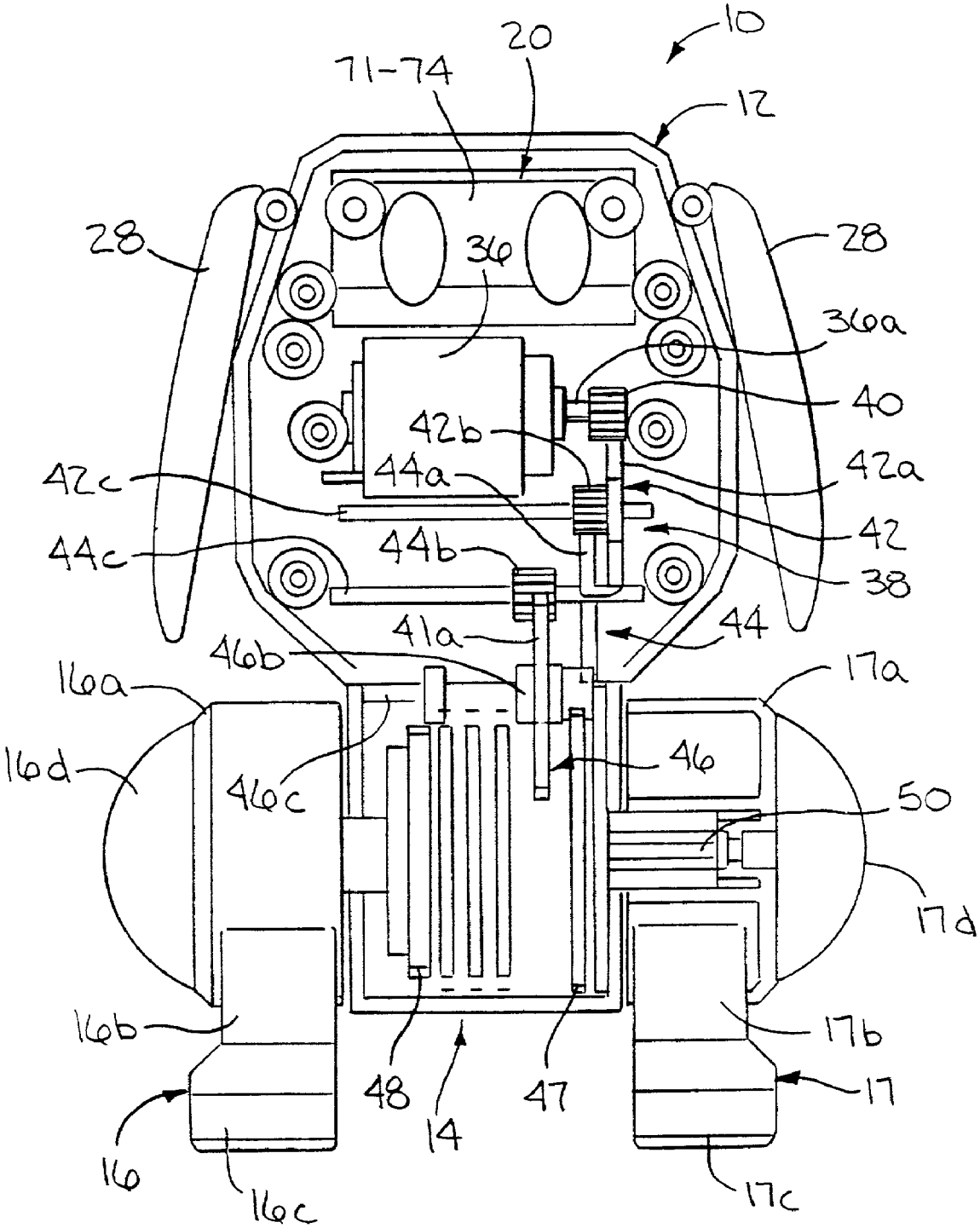
FIG. 11 is a front-vertical cross section showing the internal structure of the electronic toy.
Figure 12:
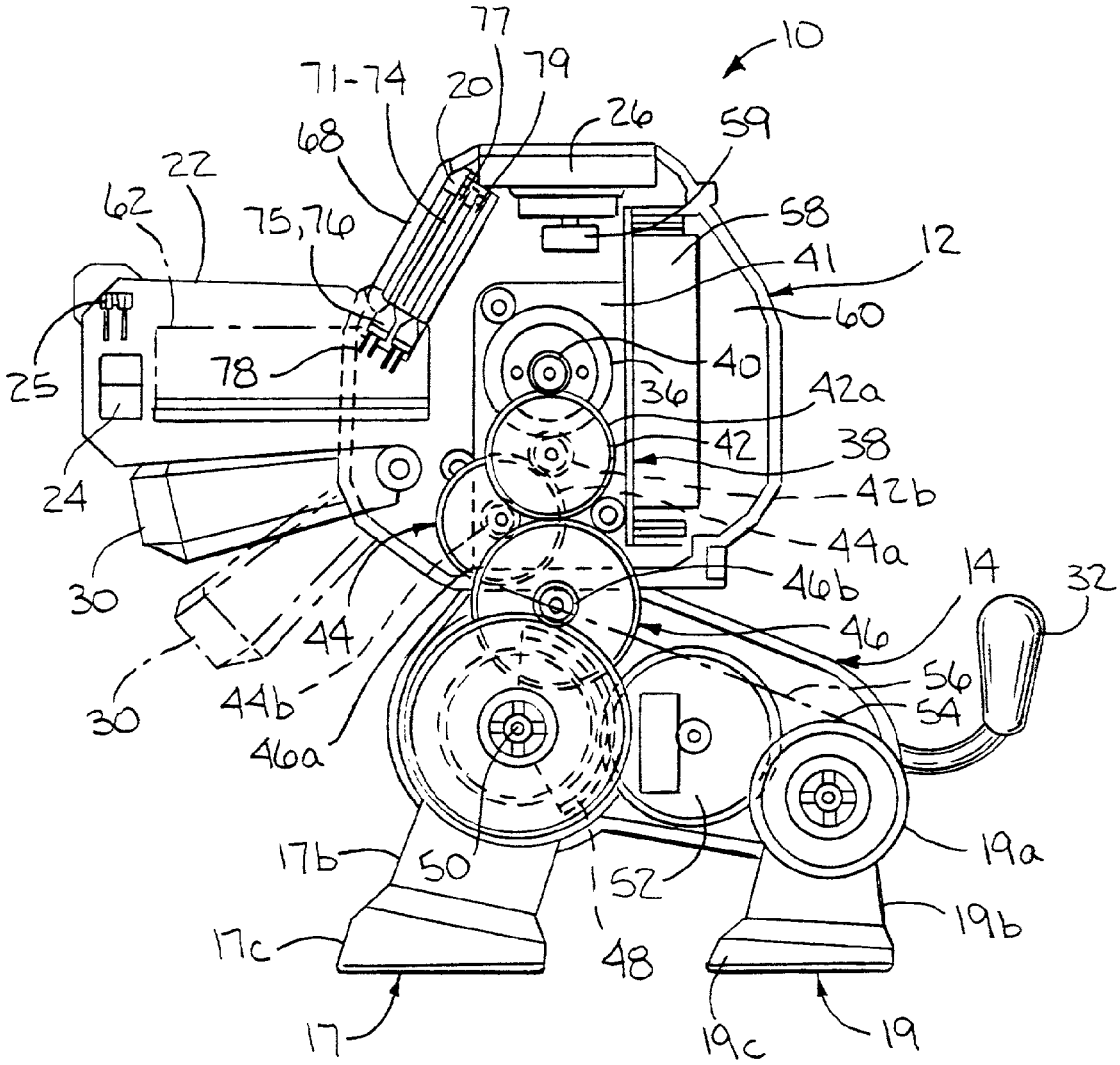
FIG. 12 is a side-vertical cross section showing the internal structure of the electronic toy.
Figure 13:
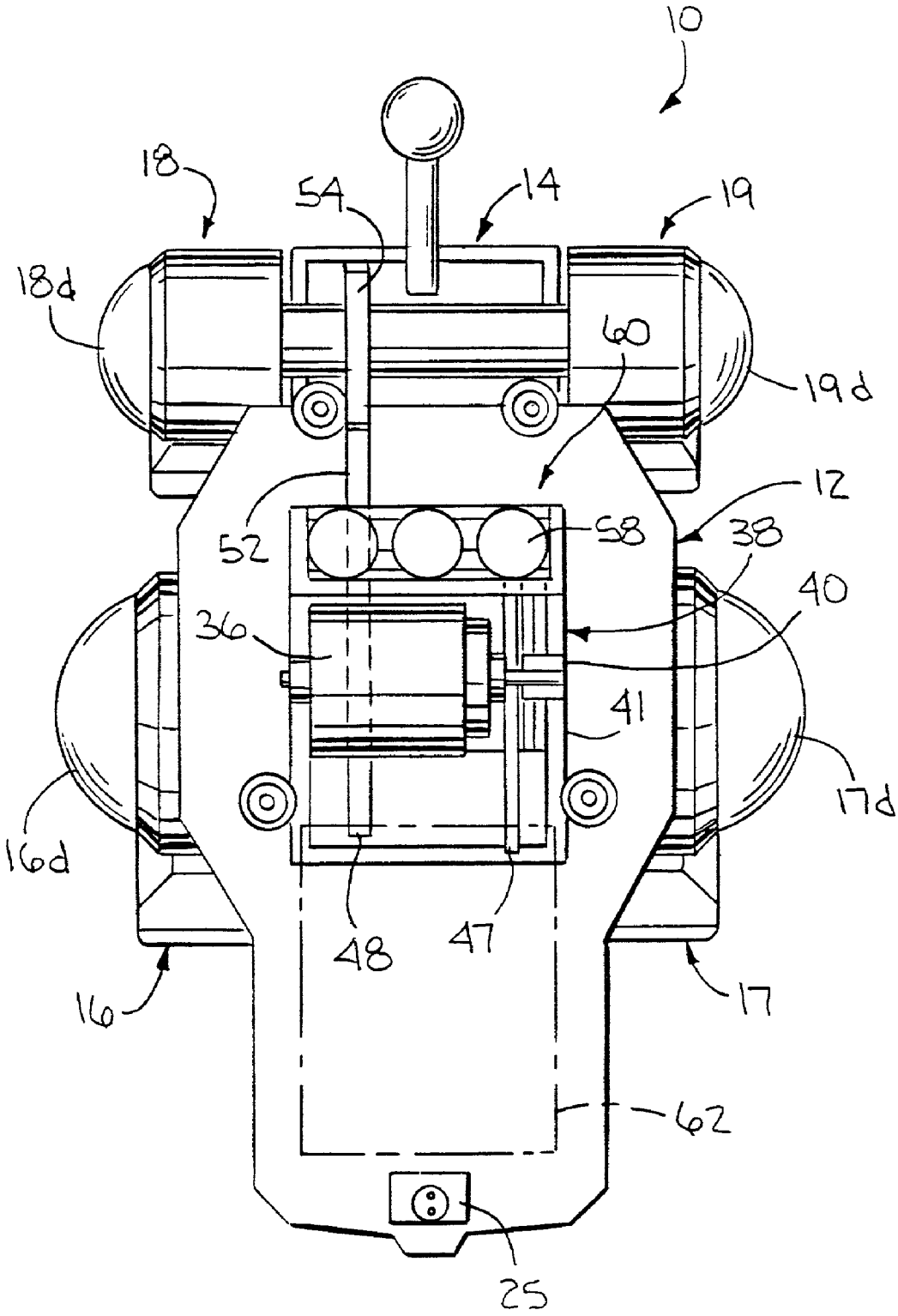
FIG. 13 is a plan-vertical cross section showing the internal structure of the electronic toy.

FIG. 11 is a front-vertical cross section showing the internal structure of the electronic toy 10. FIG. 12 is a side-vertical cross section showing the internal structure of the electronic toy 10. FIG. 13 is a plan-vertical cross section showing the internal structure of the electronic toy 10.

As shown in FIGS. 11 through 13, the electronic toy 10 internally comprises in the head 12 a motor 36 and a transmission mechanism (transmission means) 38 for transmitting the rotational driving force of the motor 36 to the legs 16-19, ears 28, lower jaw 30, and tail 32. The aforementioned legs 16-19, ears 28, lower jaw 30, and tail 32 are respectively driven by one motor 36, and are selectively transmitted the rotational driving force of the motor 36 by the transmission mechanism 38 in accordance with the aforementioned postures A, B, and C.

The motor 36 and transmission mechanism 38 are supported by the bracket 41 provided inside the head 12 and body 14. Therefore, the motor 36 and transmission mechanism 38 are of a compact structure, and are made to correspond to the miniaturization of the electronic toy 10.

Further, the transmission mechanism 38 comprises: a drive gear 40 mounted on the drive axis 36*a* of the motor 36; a first transmission gear 42 for engaging with the drive gear 40; a second transmission gear 44 for engaging with the first transmission gear 42; a third transmission gear 46 for engaging with the second transmission gear 44; a fourth transmission gear 47 for engaging with the third transmission gear 46; a first cam gear 48 co-axially provided with the fourth transmission gear 47; a first shaft 50 for supporting the first cam gear 48; a fifth transmission gear 52 for supporting the first shaft 50; and a second cam gear 54 for engaging with the fifth transmission gear 52.

Transmission gears 42, 44, 46 are respectively structured of large-diameter gears 42*a*, 44*a*, 46*a* and small-diameter gears 42*b*, 44*b*, 46*b* formed integrally, and decelerate the rotation from the motor 36 at a prescribed deceleration ratio. Moreover, the bracket 41 supports the axes 42*c*, 44*c*, 46*c* to which the respective transmission gears 42, 44, 46 are engaged.

The first cam gear 48 is a driving means for driving the front legs 16, 17, and is formed to rotate such legs 16, 17 to the aforementioned rotational positions A, B, C in accordance with the rotational directions and rotational amounts of the drive axis 36*a* of the motor 36. The third and fourth cam gears 54, 55 are driving means for driving the hind legs 18, 19, and are formed to rotate such legs 18, 19 to the aforementioned rotational positions A, B, C in accordance with the rotational directions and rotational amounts of the drive axis 36*a* of the motor 36.

The second cam gear 54 drives the tail 32, and is also connected to the transmission path 56 for driving the ears 28 and lower jaw 30. This transmission path 56 is formed, for example, from a wire and pulley etc. as shown with the one-point chain lines and rotates the ears 28, lower jaw 30 and tail 32 in the e, c, and d directions during the process of rotating the legs 18, 19 from motion position B to motion position C pursuant to the rotational angle of the second cam gear 54.

A battery housing 60 for housing batteries 58 as the power source is internally provided to the head 12. A substrate 64 having a controller 62 mounted thereon is housed inside the nose 22. A speaker 26 is provided slidably in the upward/downward directions, and comprises thereunder a push-type detection switch (contact detection switch) 59 for detecting that the speaker 26 has been pushed and moved downward.

The detection switch 59 is for detecting the lowering of the speaker 26 by the user stroking or knocking on the head 12, and is capable of making such detection while being insensible to the contact made by the user.

The motor 36 and batters 58, which are comparatively heavy among the aforementioned structural components, are arranged at a position near the centroid of the electronic toy 10; that is, at the approximate center of the head 12. The electronic toy 10 is therefore able to maintain the respective postures with steadiness.

Next, the structure of the display 20 for displaying the expression of the eyes is explained. A black smoke plate 68 is mounted on the front display 20, and four red acryl plates 71-74 of end face-illumination are layered on the inside of the smoke plate 68. Light emitting diodes (LEDs) 75-79 are arranged at the upper and lower parts of the respective red acryl plates 71-74. Other than the end face-illumination type described above, other forms of display devices (e.g., liquid crystal displays with back lights, etc.) may be used as the display 20.

Figure 14A:
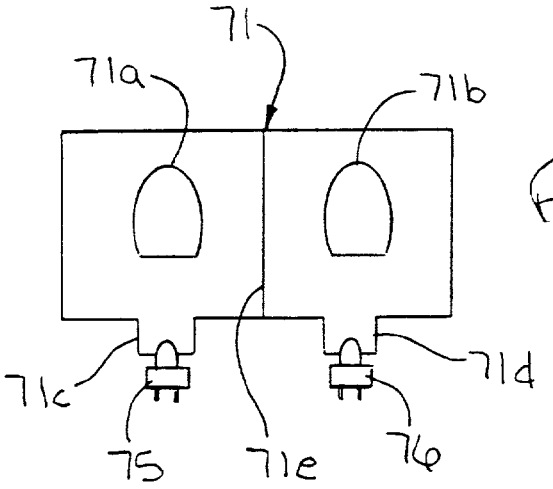
FIG. 14 is a front view separately showing the red acryl plates built in the display.

FIGS. 14(A)-14(D) are front views separately showing the red acryl plates built in the display 20. As shown in FIG. 14(A), the red acryl plate 71 comprises illuminators 71*a*, 71*b* arranged in an oval shape with the bottom parts removed. These illuminators 71*a*, 71*b* have small holes provided in prescribed intervals, and red light is emitted from the inner walls of the respective small holes when light from the LEDs 75, 76 enters the entrance 71*c* provided on the end face. Therefore, the upper parts of the left and right eyes will illuminate in an upside down U-shape pursuant to the illumination of the illuminators 71*a*, 71*b*.

A screen 71*e* for blocking the light is provided between the illuminators 71*a* and 71*b*. Thus, when light is emitted from only one of the LEDs 75, 76, one of the illuminators 71*a*, 71*b* will illuminate and produce the effect of a wink.

Figure 14B:
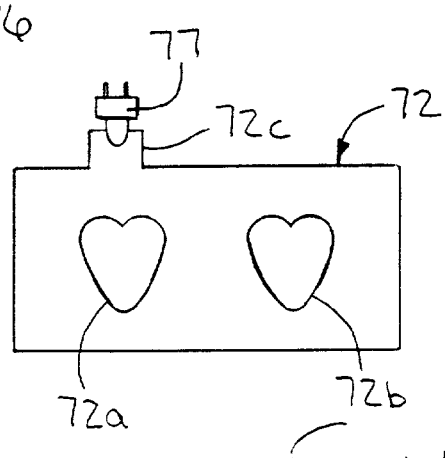

As shown in FIG. 14(B), the red acryl plate 72 comprises illuminators 72*a*, 72*b* arranged in a heart shape. These illuminators 72*a*, 72*b* have small holes provided in a heart shape in prescribed intervals, and red light is emitted from the inner walls of the respective small holes when light from the LED 77 enters the entrance 72*c* provided on the end face. Thus, the left and right eyes will illuminate in a heart shape by the illuminators 72*a*, 72*b* illuminating.

Figure 14C:
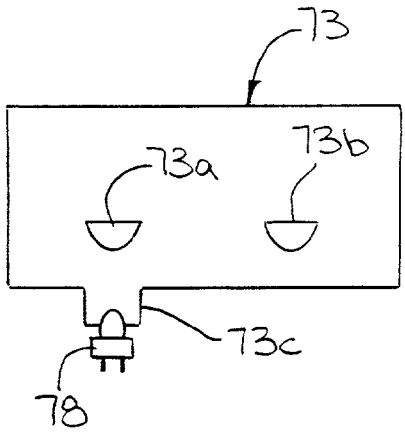

As shown in FIG. 14(C), the red acryl plate 73 comprises illuminators 73*a*, 73*b* arranged in a small semicircular shape formed continuously at the lower part of the illuminators 71*a*, 71*b* shown in FIG. 14(A). These illuminators 73*a*, 73*b* have small holes provided in a semicircular shape in prescribed intervals, and red light is emitted from the inner walls of the respective small holes when light from the LED 78 enters the entrance 73*c* provided to the end face. Thus, the left and right eyes will illuminate as small, angry eyes by the illuminators 73*a*, 73*b* illuminating.

Figure 14D:
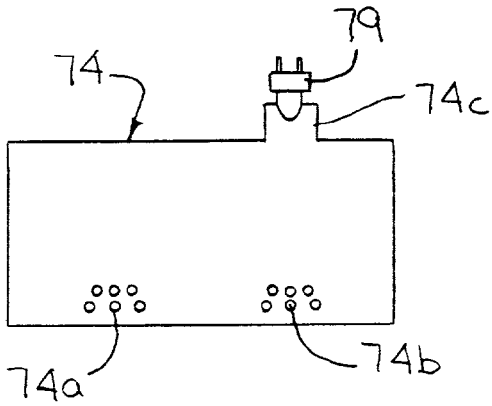

As shown in FIG. 14(D), the red acryl plate 74 comprises illuminators 74*a*, 74*b* arranged radially in small points formed continuously at the lower part of the illuminators 71*a*, 71*b* shown in FIG. 14(A). Regarding these illuminators 74*a*, 74*b*, red light is emitted from the inner walls of the respective small holes when light from the LED 79 enters the entrance 74*c* provided at the end face. Thus, the left and right eyes will illuminate as crying eyes by the illuminators 73*a*, 73*b* illuminating.

The arrangement of the aforementioned LEDs 75-79 is such that the LEDs are distributed at the upper or lower parts of the red acryl plates 71-74 so that light will not enter into other adjacent red acryl plates, and are covered with a partition wall (not shown) for preventing the light from leaking into its periphery. Thereby, the respective display patterns will not interfere with each other even when the red acryl plates 71-74 are superposed, and it is further possible to place such plates 71-74 in a small space inside the head 12.

FIG. 15 is a diagram showing the combinations of the display patterns to be illuminated and displayed on the display 20. As shown in FIG. 15, the display 20, for example, is capable of selectively displaying nine (9) types of display patterns ①-⑨. In display pattern ①, the LED 77 is lit and illuminators 72*a*, 72*b* arranged in a heart shape are illuminated. In display pattern ②, the LED 76 is lit and the illuminator 71*b* of the upper right eye is illuminated. In display pattern ③, the LED 78 is lit and illuminators 73*a*, 73*b* of the left and right angry eyes are illuminated. In display pattern ④, LEDs 75, 78 are lit and the illuminator 71*a* of the left eye is illuminated, and illuminator 73*a*, 73*b* of the left and right angry eyes are also illuminated to display the right-eyed wink. In display pattern ⑤, LEDs 75, 76, 79 are lit and illuminators 71*a*, 71*b* of both eyes are illuminated, and illuminators 74*a*, 74*b* representing tears in both eyes are illuminated to display crying eyes. In displaying pattern ⑥, LEDs 75, 76, 78 are lit and illuminators 71*a*, 71*b* of the left and right upper round eyes are illuminated, and illuminators 73*a*, 73*b* of the left and right lower round eyes are illuminated to display the overall oval-shaped round eyes. In display pattern ⑦, the LED 75 is lit and the illuminator 71*a* of the left upper round eye is illuminated. In display pattern ⑧, LEDs 76, 78 are lit and the illuminator 71*b* of the right eye is illuminated, and illuminators 73*a*, 73*b* of the left and right angry eyes are also illuminated to display the left-eyed wink. In display pattern ⑨, the respective LEDs 75-79 are turned off so that no illumination is displayed on the display 20.

At the display 20, lighting control of the respective LEDs 75-79 is conducted pursuant to control signals from the controller 62. This produces changes in the emotions at such time by representing the expressions with any one of the aforementioned nine (9) types of display patterns ①-⑨.

The structure of the control system of the aforementioned electronic toy 10 is described below.

FIG. 16 is a block diagram showing the structure of the control system of the electronic toy 10. As shown in FIG. 16, the controller 62 is connected to the display 20, sound sensor 24, light sensor 25, speaker 26, motor 36, battery 58, detection switch 59, and, as described later, counts the detection signals from the sound sensor 24, light sensor 25, detection switch 59. The controller 62 thereby drives and controls the display 20, speaker 26, and motor 36 by extracting control data from the relationship of the count value and elapsed time.

Various artificial intelligence (AI) functions and sensor training are provided in which training between the random and sequential behavior modifications of the electronic toy allows the child to provide reinforcement of desirable activities and responses. In connection with the AI functions, appropriate responses are performed for particular activities or conditions, e.g., bored, hungry, sick, sleep. Such predefined conditions have programmed responses which are undertaken by the electronic toy at appropriate times in its operative states. The AI and sensory training functions achieve behavior modification for the interactive toy, thus allowing the child to provide reinforcement of desirable activities and responses. The AI functions are used for the appropriate responses to particular activities or predefined conditions undertaken by the interactive toy at appropriate times in its operative states. Additionally, as discussed, the interactive toy maintains its age in a non-volatile memory, which is used to increment the age where appropriate. Additionally, a co-processor facilitates infrared (IR) communications allowing for communications between electronic toys as discussed herein. Other criteria based on the electronic toy's life as stored in memory may affect the ability to play games. For instance, if the electronic toy is indicated as being sick, either by having received a signal from another electronic toy to enter the sick condition, then no game would be played.

Figure 17A:
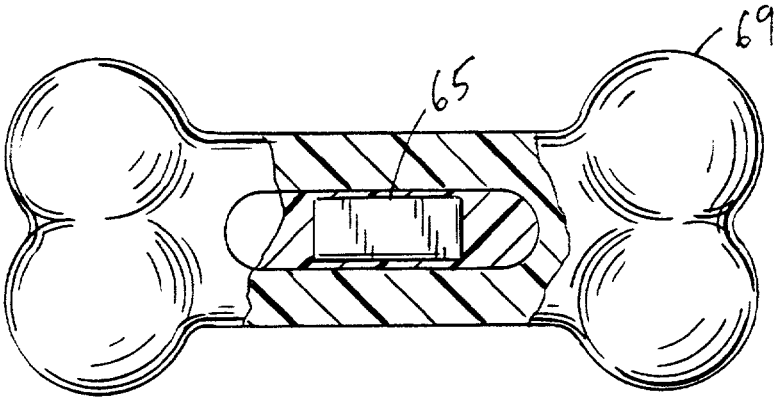
FIG. 17A illustrates a feeding device in the form of a bone containing magnetic material.

FIG. 17 is a block diagram showing the structure of the controller 62. As shown in FIG. 17, the controller 62 comprises a CPU 80 as the central processing unit, ROM 82 (storage means; first-third storage units), RAM 84, and timer 86. Stored in the ROM 82 are a motion control program 82A for controlling the activation of the display 20, speaker 26, and motor 36; posture control data 82B for controlling the rotational direction and rotational amount of the motor 36 in accordance with the changes in the character at such time (value of happy mode or value of grumpy mode) and for switching the motion postures A-C; sound control data 82C for producing from the speaker 26 cries or melodies in accordance with the changes in the character at such time; display control data 82D for switching the display pattern of the display 20 in accordance with the changes in the character at such time; pet biorhythm data 82E for periodically changing the character (happy mode or grumpy mode); and biorhythm revision data 82F for periodically revising the pet biorhythm pursuant to the count value of the aforementioned detection signal.

The motion control program 82A stored in the ROM 82 includes a first control program for counting the number of detection signals output from the detection means which detects external inputs; second control program for changing the values of the parameter in accordance with prescribed time intervals; third control program for selecting an arbitrary motion pattern among a plurality of motion patterns pursuant to the number of detection signals and parameter values upon detection signals being output from the detection means; and fourth control program for controlling the electronic toy to move in the selected motion pattern.

Further, stored in the RAM 84 are a counter 84A for counting the detection signals from the sound sensor 24, light sensor 25, and detection switch 59; and communication biorhythm data 84B prepared pursuant to the count value of the counter 84A.

With counter 84A, it is possible to set count mode 1 for counting, without selecting, the detection signals from the sound sensor 24, light sensor 25, and detection switch 59, and count mode 2 comprising first to third counters (not shown) for preparing communication biorhythm data for each sensor upon individually counting the detection signals from the sound sensor 24, light sensor 25, and detection switch 59, respectively.

The control processing executed by the CPU 80 of the controller 62 is now explained.

Further, the controller 62 includes sound generating circuitry as described herein to make the electronic toy 10 appear to make sounds in conjunction with the movement of the body parts so as enhance the ability of the toy to provide seemingly intelligent and life-like interaction with the user in that the electronic toy 10 can have different physical and emotional states as associated with different coordinated positions of the body parts and sounds or exclamations generated by the controller 62. The controller 62 also supports a magnetic switch for feeding functions associated with a bone 69 having a magnet 65 shown in FIG. 17A. Both the eye and mouth assemblies are mounted to the face frame member, as well as for the light and IR link sensor assembly. Thus, as shown in FIG. 16, IR transmitter 67 and an IR receiver 68 facilitate an infrared (IR) communications link. The infrared transmission with the LEDs is programmed using the information processor according to a pulse width modulated (PWM) signal protocol for communicating information from the information processor (controller) 62. The infrared signals generated from the LEDs may be coupled to the infrared receive block described below, or to another device in communication with the information processor 62. To this end, the infrared transmission block may be used for signal coupling to another computerized device, a personal computer, a computer network, the internet, or any other programmable computer interface. As previously discussed, the controller 62 utilizes inputs from the toy sensors for activating the motor. The audio sensor is in the form of a microphone mounted in cylindrical portion. The light sensor 25 and IR link assembly 67,68 are mounted behind an opaque panel attached to the face frame. The light sensor portion of the assembly is mounted between an IR transmitter element 67 and an IR receiver element 68 on either side thereof to form the IR link to allow communication between a plurality of electronic toys 10.

An embodiment of an embedded processor circuit for the electronic toy, as shown in the schematic block diagram of FIG. 17, depicts the information processor provided as, e.g., an 8-bit reduced instruction set computer (RISC) controller, which is a CMOS integrated circuit providing the RISC processor with program/data read only memory (ROM). The information processor provides various functional controls facilitated with on board static random access memory (SRAM), a timer/counter, input and output ports (I/O) as well as an audio current mode digital to analog converter (DAC). DACs may also be used as output ports for generating signals for controlling various aspects of the circuitry as discussed further below. The information processor provides the IR transmission circuitry. The sound detection block 24 is used to allow the information processor 62 to receive audible information as sensory inputs from the child which is interacting with the electronic toy. The light detection block 25 is provided for sensory input to the information processor 62 through the use of a cadmium sulfide cell in an oscillator circuit for generating a varying oscillatory signal observed by the information processor 62 as proportional to the amount of ambient light.

Figure 20:
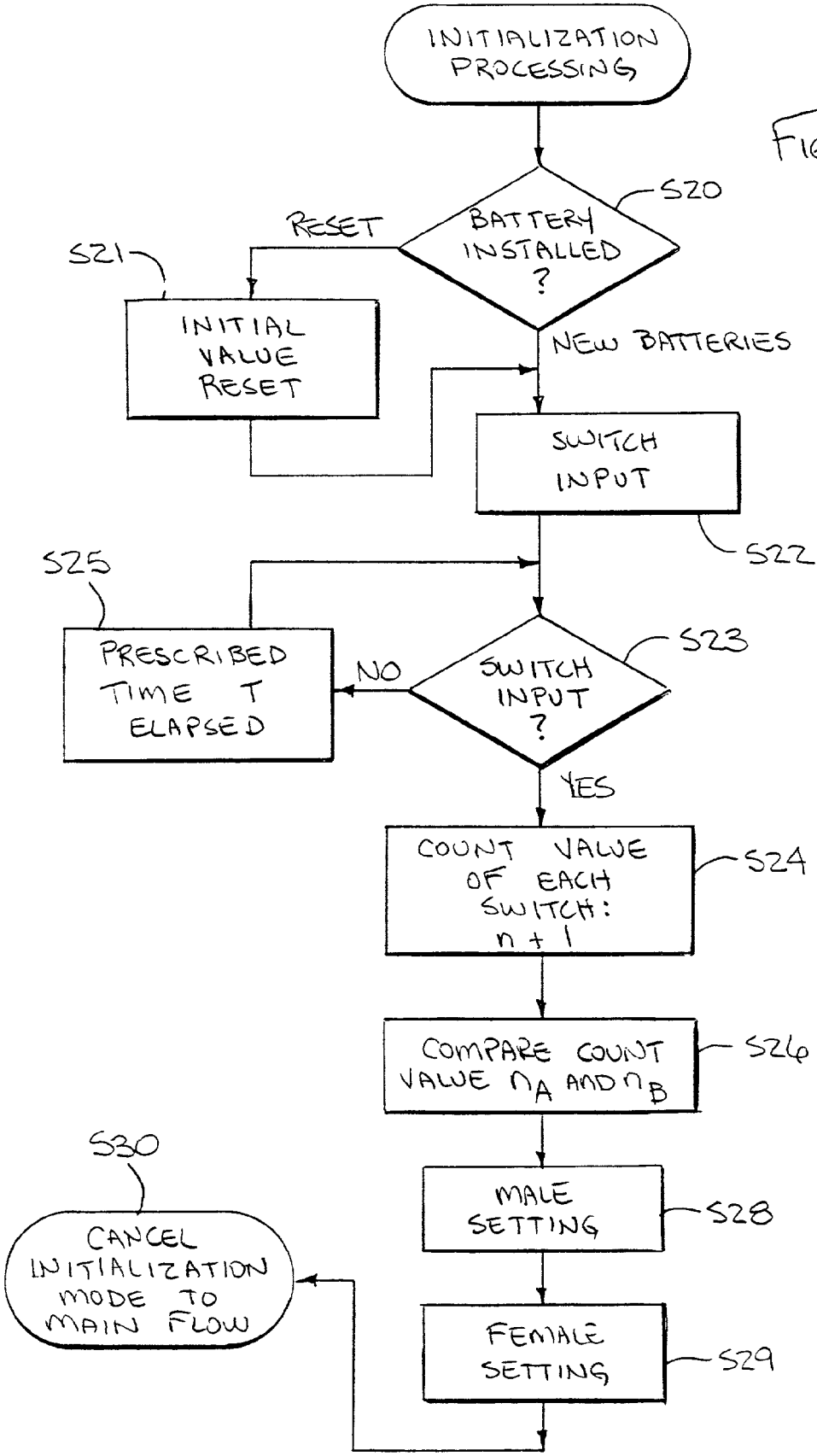
FIG. 20 is a flowchart for explaining the initialization processing.
Figure 21:
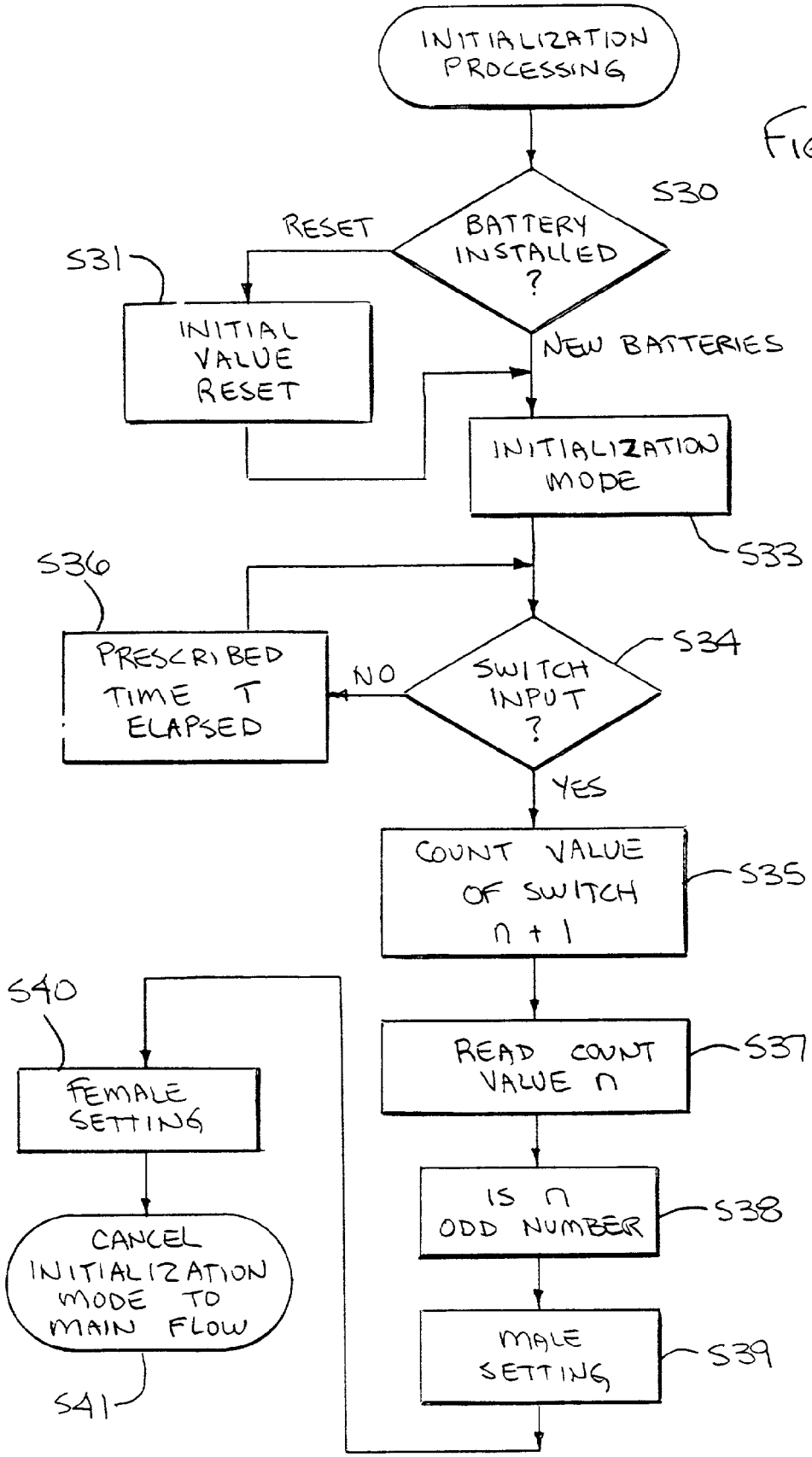
FIG. 21 is a flowchart for explaining a modified example of the initialization processing.

As described, the plurality of sensory inputs, i.e., switches 66, and the audio 24, light 25, and infrared blocks 66,68, are coupled to the information processor 62 for receiving corresponding sensory signals. A computer program discussed below in connection with FIGS. 20 and 21, illustrates a program flow diagram for operating the embedded processor design facilitating processing of the sensory signals for operating the at least one actuator linkage responsive to the sensory signals from the child or the environment of the electronic toy. Accordingly, a plurality of operational modes of the electronic toy is provided by the computer program with respect to the actuator linkage operation and corresponding sensory signal processing for controlling the at least one actuator linkage to generate kinetic interaction with the child with the plurality of movable members corresponding to each of the operational modes of the electronic toy which provides interactive rudimentary artificial intelligence for the electronic toy.

Figure 18:
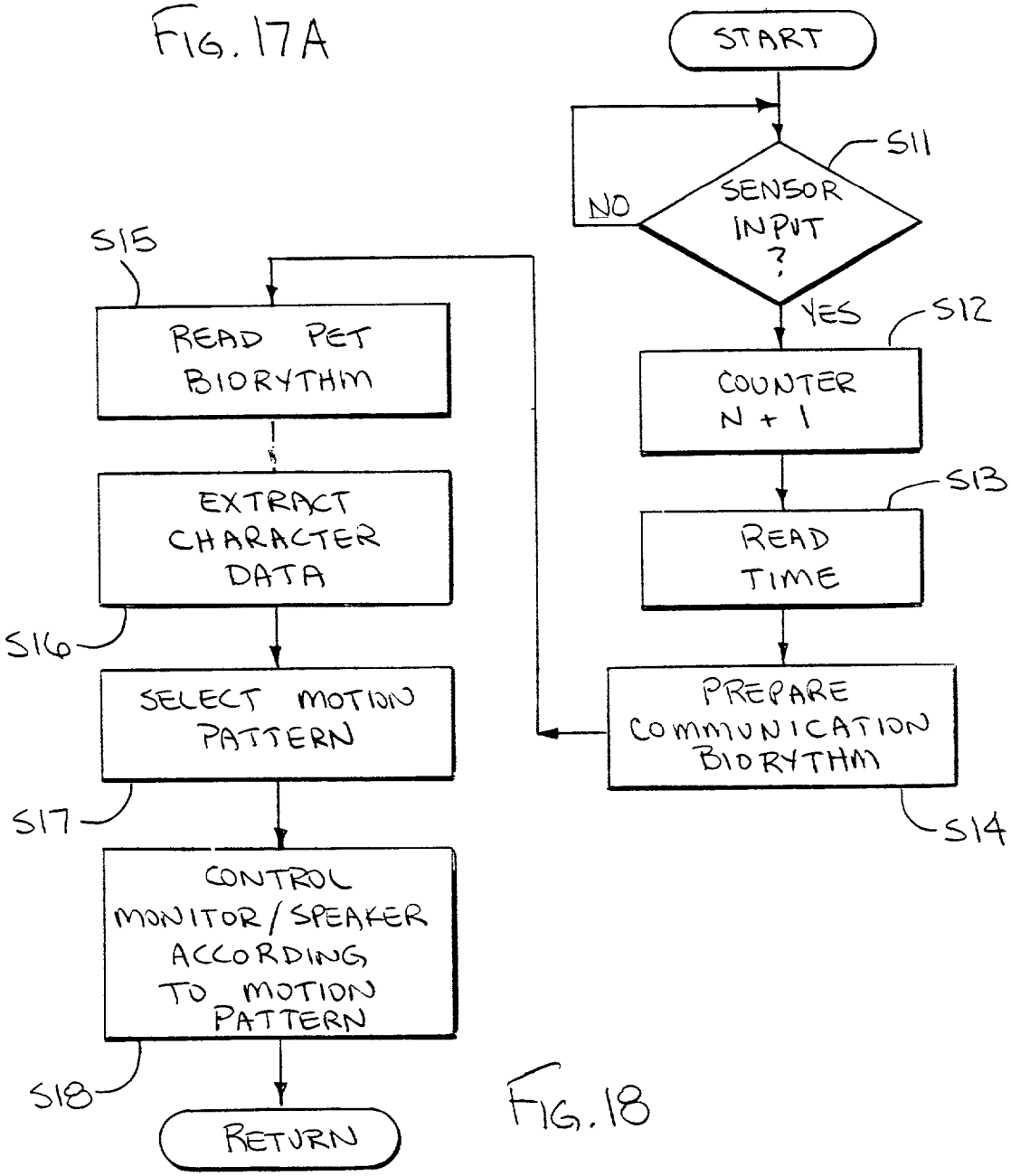
FIG. 18 is a flowchart for explaining the control processing executed by the CPU 80 of the controller.
Figure 19:
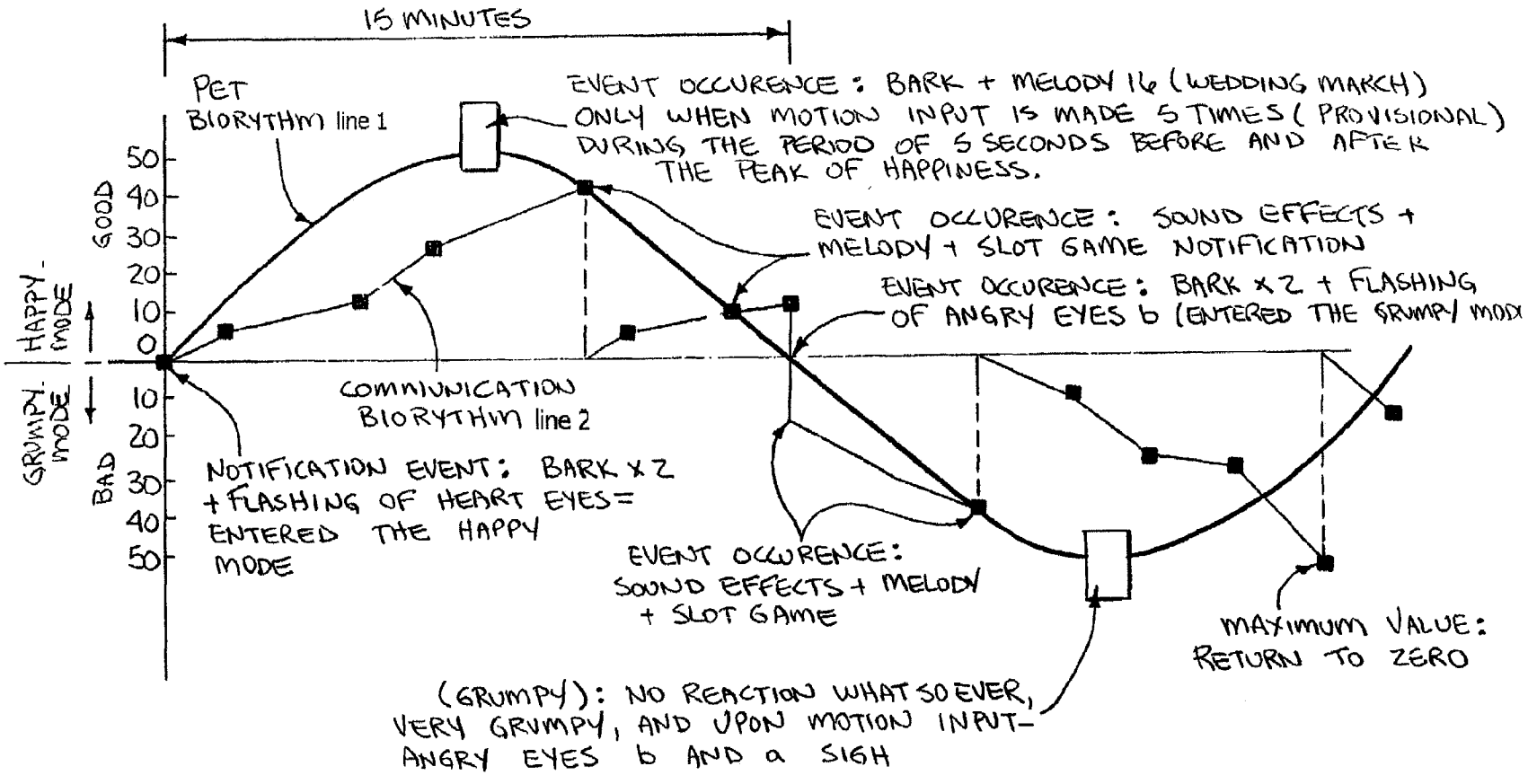
FIG. 19 is a graph showing the changes in the pet biorhythm and communication biorhythm with control method of motions and expressions in accordance with the motional input from the respective sensors during the happy mode.

FIG. 18 is a flowchart for explaining the control processing executed by the CPU 80 of the controller 62. FIG. 19 is a graph showing the changes in the pet biorhythm and communication biorhythm. The CPU 80 repeatedly executes the control processing shown in FIG. 18 every 50 milliseconds, for example, pursuant to the motion control program 82A stored in the ROM 82.

As shown in FIG. 18, the CPU 80 confirms whether or not there was input from the sound sensor 24, light sensor 25, and detection switch 59 at step S11 (the term "step" is hereinafter omitted). When detection signals from the sound sensor 24, light sensor 25, and detection switch 59 are detected, the CPU 80 proceeds to S12, and adds 1 to the count value of the counter 84A. In the next S13, the lapsed time measured by the timer 86 is read. Next, the routine proceeds to S14, prepared Line 2 (see FIG. 19 explained later) of a communication biorhythm based on the counter value of the counter 84A, and updates the communication biorhythm data of the RAM 84. At S15, Line 1 (see FIG. 19 explained later) of the pet biorhythm data stored in the ROM 82 is read.

The routine then proceeds to S16, and extrudes parameters (value of happy mode, value of grumpy mode shown in FIGS. 20 and 21 explained later) from the relationship between the pet biorhythm data and communication biorhythm data (parameter alteration means). Next, at step S17, a motion pattern (1)-(12) (explained later with reference to FIGS. 20 and 21) is selected (selection means) based on the character data. At S18, the motor 36 is driven and controlled in accordance with the selected motion pattern and the legs 16-19 are moved to become the designated posture. Further, the display of the eyes by the display 20 is switched and cries or melodies are generated (control means) from the speaker 26. At S12, it is possible to count the count values of the respective sensors; i.e., sound sensor 24, light sensor 25, and detection switch 59, prepare a communication biorhythm graph in accordance with the respective count values, and control the posture, expression of the eyes by the display 20, and the cries from the speaker 26, and so on.

The relationship between the pet biorhythm and communication biorhythm is now explained. As shown in FIG. 19, in this embodiment, the control posture, cries, melodies, expression of the eyes, etc. of the electronic toy 10 are controlled pursuant to the relationship between Line 1 of the pet biorhythm and Line 2 of the communication biorhythm. In FIG. 19 for the sake of convenience, changes in the pet biorhythm values are shown in Line 1 and changes in the communication biorhythm values are shown in Line 2. Nevertheless, the controller 62 conducts control processing upon comparing the value showing parameter changes and the count value of the counter means.

The pet biorhythm is prepared by the data stored in the pet biorhythm data 82E and, as shown in Line 1 of FIG. 19, is set so as to periodically alternate (e.g., every 15 min.) between the happy mode (good character) and the grumpy mode (bad character). Further, in the happy mode and grumpy mode based on the pet biorhythm, the parameter values at such time change in a range of level 0 to 50 pursuant to the respective lapses in time.

As shown in Line 2 prepared by the data stored in the communication biorhythm data 84B, the communication biorhythm changes in accordance with the number of inputs to the sound sensor 24, light sensor 25, and detection switch 59 and the electronic toy 10 changes its movement or expression pursuant to the degree of the user's affection toward such electronic toy 10. Therefore, the electronic toy 10 is capable of changing its posture to motion postures A-C and the expression of the eyes by the display 20 (see FIGS. 8-10, FIG. 13) pursuant to the number of times the user contacts or speaks to the electronic toy 10.

When the contact frequency of the user, i.e., number of inputs to the sound sensor 24, light sensor 25, and detection switch 59, increases based on the biorhythm revision data 82F, the controller 62 changes the cycle by extending the happy mode and shortening the grumpy mode, or, if the number of inputs decreases, by extending the grumpy mode and shortening the happy mode. Thus, the happy mode and grumpy mode are not repeated in a fixed time period.

Therefore, as the electronic toy 10 will not make a uniform reaction even if contacted in a similar manner and will move and make expressions in accordance with the characteristic changes at such time, the user will not lose interest easily. As the user cannot predict the characteristic changes of the electronic toy 10, he/she may enjoy unexpected movements and expressions of the electronic toy 10.

For example, in the happy mode, when the character level is zero and the user strokes the head 12 of the electronic toy 10 and detection signals from the detection switch 59 are output; or the user speaks to the electronic toy 10 and detection signals from the sound sensor 24 are output; or the user waves his/her hand in front of the nose and detection signals from the light sensor 25 are output; notification event ① (cry ① is generated twice and heart eyes are flashed on the display 20 (see FIG. 15)) is conducted to notify the user that the toy has entered the happy mode. Moreover, in the happy mode, while the character level of the per biorhythm is changing from 0 to 50, for example, if the user makes five contacts (inputs) to the electronic toy 10, event ③ (bark ② and performance of special melody (Wedding March)) is conducted.

Also in the happy mode, when Line 2 of the communication biorhythm intersects with Line 1 of the pet biorhythm, event occurrence ① (sound effects and melody and commencement of slot game) is conducted. This slot game is a game wherein display patterns ①-⑨ are successively displayed on the display 20 and, when the speaker 26 is pushed and the detection switch 59 is turned on, any one of the display patterns ①-⑨ will stop and be displayed. Further in the happy mode, when the character level returns to zero due to the pet biorhythm, notification event ② (cry ② is generated twice and angry eyes are flashed on the display 20 (see FIG. 15)) is conducted and notifies the user that the toy has entered the grumpy mode.

In the grumpy mode, when Line 2 of the communication biorhythm intersects with Line 1 of the pet biorhythm, event occurrence ② (sound effects and melody and commencement of slot game) is conducted. Moreover, in the grumpy mode, when the character level of the pet biorhythm is near 50, the electronic toy 10 will become unresponsive to anything the user does, and extremely grumpy. For example, in response to the motion input of the user, angry eyes are displayed on the display 20 and a sigh is heaved. Also in the grumpy mode, when the character level of the pet biorhythm returns to zero, the aforementioned notification event ① (cry ① is generated twice and heart eyes are displayed on the display 20 (see FIG. 15)) is conducted and notifies the user that the toy has entered the happy mode. Although the counter 84A counts the number of inputs from the sound sensor 24, light sensor 25, and detection switch 59, when Line 2 of the communication biorhythm intersects with Line 1 of the pet biorhythm as described above, or when the count reaches a maximum value set in advance, the counter is reset and returned to zero.

The electronic toy 10 changes the posture and expression in accordance with the following motion patterns (1)-(12), for example, if inputs are made by the user when the toy is in the happy mode.

FIG. 20 is a diagram showing the control method of motions and expressions in accordance with the motion input from the respective sensors during the happy mode. As shown in FIG. 20, for example, if inputs are made by the user when the character is in the happy mode, the electronic toy 10 changes the posture and expression in accordance with the motion patterns (1)-(12) as follows.

(1) When there is no input, motion posture B (see FIG. 9) is changed to motion posture A (see FIG. 8), the display is changed from round eyes to closed eyes on the display 20, and snoring is generated from the speaker 26.

(2) When there is input only from the sound sensor 24, the motion posture is changed from B to A, the display of closed eyes are changed to crying eyes on the display 20, and a joyful outcry is generated from the speaker 26.

(3) When there is input only from the light sensor 25, motion posture B is maintained, round eyes are displayed on the display 20, and monologues or sound effects are generated from the speaker 26.

(4) When there is input only from the detection switch 59, the motion posture is changed from B to C (see FIG. 10) and back to B, the display of closed eyes are changed to round eyes on the display 20, and a joyful outcry is generated from the speaker 26.

(5) When there are inputs from the sound sensor 24 and the light sensor 25, motion posture B is maintained, the display on the display 20 is changed to flashing round eyes, and the sound of a woof ① is generated from the speaker 26. Or, the motion posture is changed from B to C to B, heart eyes are displayed on the display 20, and a bark ① is generated from the speaker 26.

(6) When there are inputs from the sound sensor 24, light sensor 25, and detection sensor 59, the motion posture is changed from B to C to B to C to B, the display on the display 20 is changed from round eyes to heart eyes, or a wink is displayed on the display 20, and a laughing sound ① is generated from the speaker 26.

(7) When there are repeated inputs from the light sensor 25, motion posture B is maintained, the round eyes are made to flash on the display 20, and a joyful outcry and laughing sound ① are generated from the speaker 26.

(8) When there are repeated inputs from the sound sensor 24 and light sensor 25, the motion posture is changed from B to C to B to C to B, the heart eyes are made to flash on the display 20, and monologues ①-③ are generated from the speaker 26.

(9) When there are repeated inputs from the sound sensor 24, detection switch 59, and light sensor 25, the motion posture is changed from B to C to B to C to B, the heart eyes are made to flash on the display 20, and a laughing sound and melody are generated from the speaker 26.

(10) When there are repeated inputs from the detection switch 59 and the light sensor 25, the motion posture is changed from B to C to B to C to B, the heart eyes are made to flash on the display 20 k, and a joyful outcry and melody are generated from the speaker 26.

(11) When there are inputs from the sound sensor 24 and the detection switch 59, the motion posture is changed from B to A, the round eyes are made to flash on the display 20, and a monologue ② is generated from the speaker 26.

(12) When there are inputs from the light sensor 25 and detection witch 59, the motion posture is changed from B to C to B to C to B, the heart eyes are made to flash on the display 20, and a joyful outcry and melody are generated from the speaker 26.

As the character of this electronic toy 10 switches between the happy mode and grumpy mode in prescribed cycles based on the characteristic changes pursuant to the communication biorhythm, it is difficult for the user to predict the response of the toy to his/her input, and the user will thereby not lose interest in the toy.

It is also possible to change the cycle of the happy mode and/or the grumpy mode in accordance with the number of detection of the respective sensors. Thus, the cycle of the happy mode may be extended or the cycle of the grumpy mode may be extended pursuant to the way the user contacts the electronic toy 10. It will therefore be difficult for the user to predict the motion pattern at such time and will increase the amusement by the toy conducting unexpected actions.

The control processing of the initialization mode executed by the CPU 80 of the controller 62 is now explained.

FIG. 20 is a flowchart for explaining the initialization processing. As shown in FIG. 22, the CPU 80 of the controller 62 checks at S20 whether or not new batteries 58 have been installed. When the batteries 58 are initially installed in the battery housing 60 or when the batteries are replaced, the CPU 80 proceeds to S20, and resets the initialization value stored in the memory (not shown). Next, the initialization mode is set at S22. During this initialization mode, the electronic toy 10 has a character of a puppy, and is relatively good-tempered.

At the next S23, checked is whether or not there was input by a switch. Here, the CPU 80 monitors the detection motion of the sound sensor 24 and detection switch 59 as the detection means. When detection signals are output from the detection switch 59, the routine proceeds to S24, integrates the detection frequency n thereof, and stores such integrated value (count value +1) in the memory. At the subsequent S24, checked is whether prescribed time T (e.g., T=1 hour) has elapsed or not. Therefore, until 1 hour elapses from the time the batteries 58 were installed, the processing steps of S23-S25 are repeated. At S25, when 1 hour elapses, the routine proceeds to S26, and the count value $n_A$ of the sound sensor 24 and the count value $n_B$ of the detection switch 59 are compared.

At the next S27, the routine proceeds to S28 when the count value $n_A$ of the sound sensor 24 is larger than the count value $n_B$ of the detection switch 59 ($n_A>n_B$), and sets the gender data to male. Moreover, at S27, the routing proceeds to S29 when the count value $n_A$ of the sound sensor 24 is not larger than the count value $n_B$ of the detection switch 59; that is, (a) when the count value $n_A$ of the sound sensor 24 is smaller than the count value $n_B$ of the detection switch 59 ($n_A>n_B$), (b) when the count value $n_A$ of the sound sensor 24 is equal to the count value $n_B$ of the detection switch 59 ($n_A=n_B$), or (c) when the count value $n_A$ of the sound sensor 24 and the count value $n_B$ of the detection switch are zero ($n_A=0$, $n_B=0$), and sets the gender data to female. In the aforementioned cases (a) and (b), the gender may be set to a predetermined gender as described above, or set pursuant to random numbers.

When the gender data is set to male at S28, or when the gender data is set to female at S29, the routine proceeds to S30, and the initialization mode is cancelled. Thereafter, the routine proceeds to the main control processing shown in FIG. 18. When the initialization of male or female is made after the batteries are initially installed, expressions and motions thereafter will be made in accordance with such selected gender (individual difference).

For instance, characteristics when the gender data is set to male are (a) the voice being set to a low-tone version, (b) the normal pattern A for the eyes, and (c) special songs only for males. Further, characteristics when the gender data is set female are (a) the voice being set to a basic pattern, (b) the normal pattern B for the eyes, and (c) special dances only for females. As described above, the gender (individual difference) is set in accordance with the count values $n_A$, $n_B$ of the number of detections detected from the sound sensor 24 and detection switch 59 while the initialization mode is being set. Thus, for example, while the initialization mode is being set after the batteries are initially installed, it is possible to set in advance individual differences, such as the gender, as the initial value, and produced are unique expressions and movements unpredictable by the user.

In the aforementioned explanation, the number of detections of the sound sensor 24 and detection switch 59 was counted and the gender was set upon comparing such values. Other than this detection means, for example, it goes without saying that the detection signals from the light sensor 25 and the like may be counted. Needles to say, characteristics when the gender data is set to male or female are not limited to the motion patterns, and other expressions and motions may be initially set.

FIG. 21 is a flowchart for explaining a modification example of the initialization processing. As shown in FIG. 21, the processing steps of S31-S34 among the control processing executed by the CPU 80 of the controller 62 are the same as those of S20-S23, and the explanation thereof is omitted. Here, at S34, the CPU 80 monitors the detection motion of the sound sensor 25 and detection switch 59 as the detection means. When detection signals are output from the detection switch 59, the routine proceeds to S34, integrates the detection frequency n thereof, and stores such integrated value (count value +1) in the memory. At the subsequent S36, checked is whether prescribed time T (e.g., T=1 hour) has elapsed or not. Therefore, until one hour elapses from the time the batteries 58 were installed, the processing steps of S34-S36 are repeated.

At S36, when one hour elapses, the routine proceeds to S37, and the count value n of the detection switch n is read. At S37, checked is whether the count value n of the detection switch 59 is an odd number. At the next S38, the gender data is set to male when the count value n of the detection switch 59 is an odd number. When the count value n of the detection switch 59 is not an odd number at S38; in other words, if the count value n of the detection switch 59 is an even number or zero, the routine proceeds to S40, and the gender data is set to female. When the gender data is set to male at S39, or when the gender data is set to female at S40, the routing proceeds to S41, and the initialization mode is cancelled. Thereafter, the routine proceeds to the main control processing shown in FIG. 18.

When the initialization of male or female is made after the batteries are initially installed, expressions and motions thereafter will be made in accordance with such selected gender (individual difference). Therefore, the gender is set pursuant to whether the count value of the number of inputs detected while the initialization mode is being set is an odd or even number, produced are expressions and motions according to the gender and character set irrespective of the intention of the user. In other words, individual differences will appear in the expressions, sounds, and movements in correspondence to the contact by the user after initialization, and it is thereby possible to produce the feeling of the electronic toy having a gender and character as though a real animal.

In the aforementioned explanation, the number of detections of the detection switch 59 was counted and the gender was set upon judging whether such count value is an odd or even number. Other than this detection means, for example, it goes without saying that the detection signals from the sound sensor 24 or light sensor 25 and the like may be counted and the gender may be set upon judging whether such count value is an odd or even number.

In the aforementioned FIGS. 20 and 21, the sounds from the speaker 26 are prepared in a plurality of types for each item, and are set to generate a lower tone (low tones are also prepared in a plurality of types) in the grumpy mode in comparison to the happy mode.

Although a dog-shaped electronic toy was described as an example in the aforementioned embodiment, electronic toys in other shapes of animals such as a cat, tiger, lion, monkey, horse, elephant, giraffe, etc. may also be used as a matter of course.

Figure 23:
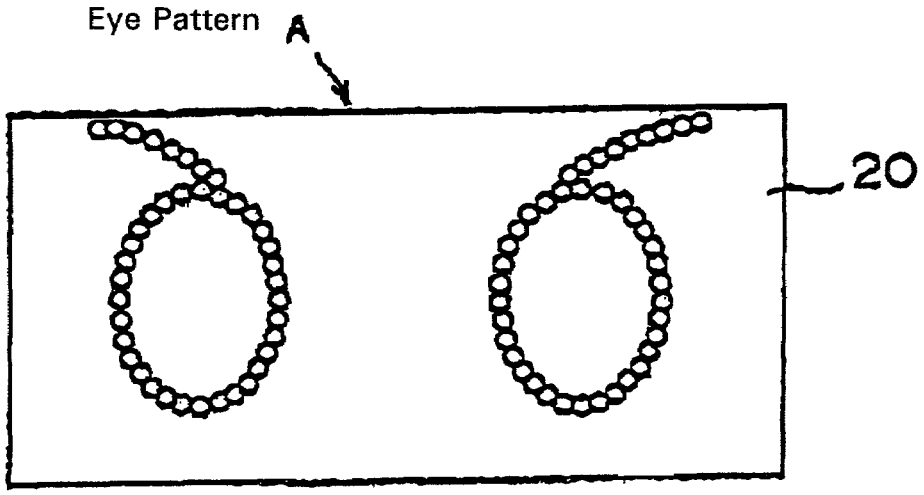
Figure 24:
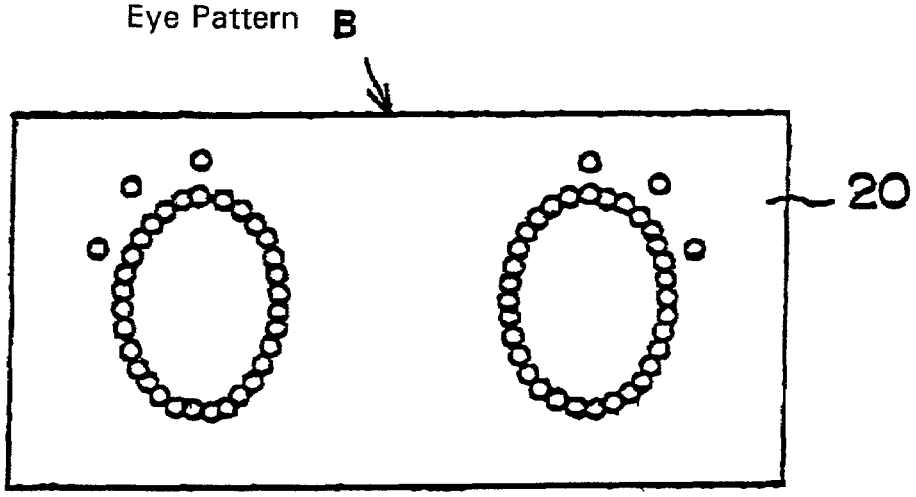

FIG. 22 shows male and female gender data associated with eye patterns A and B shown in FIGS. 23 and 24 respectively, with associated voice and song gender characteristics. For example, characteristics when the gender data is set to male are as shown in FIG. 22 (a) the voice being set to a low-tone version, (b) the normal pattern of the eyes being set to pattern A shown in FIG. 23, and (c) special songs only for males. Further, characteristics when the gender data is set to female are as shown in FIG. 22, (a) the voice being set to a basic pattern, (b) the normal pattern of the eyes being set to pattern B shown in FIG. 24, and (c) special dances only for females. As described above, the gender (individual difference) is set in accordance with the count values $n_A$, $n_B$ of the number of detections detected from the sound sensor 24 and detection switch 59 while the initialization mode is being set. Thus, for example, while the initialization mode is being set after the batteries are initially installed, it is possible to set in advance individual differences, such as the gender, as the initial value, and produced are unique expressions and movements unpredictable by the user.

The second embodiment of the present invention is now explained.

Figure 25:
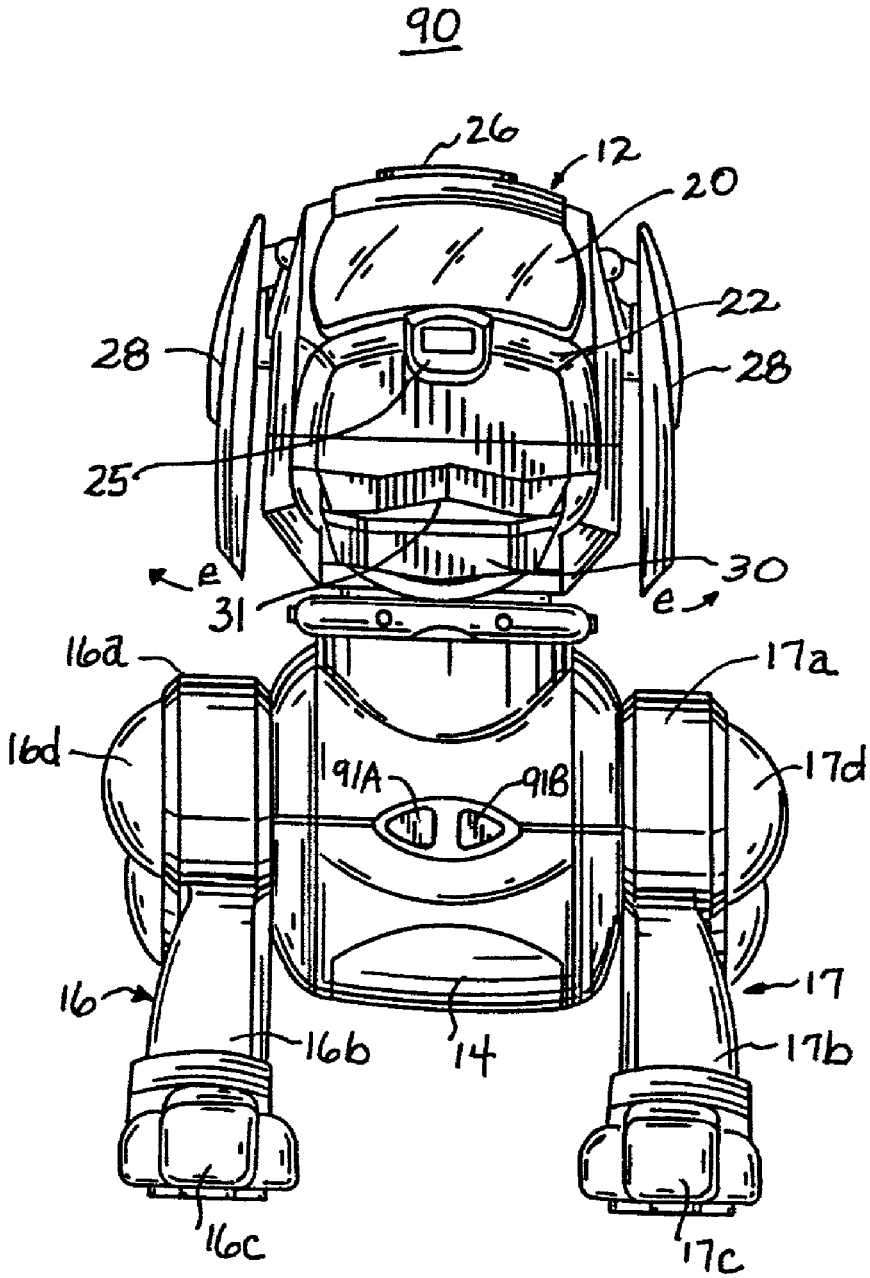
FIG. 25 is a front view of the electronic toy according to the second embodiment of the present invention.
Figure 26:
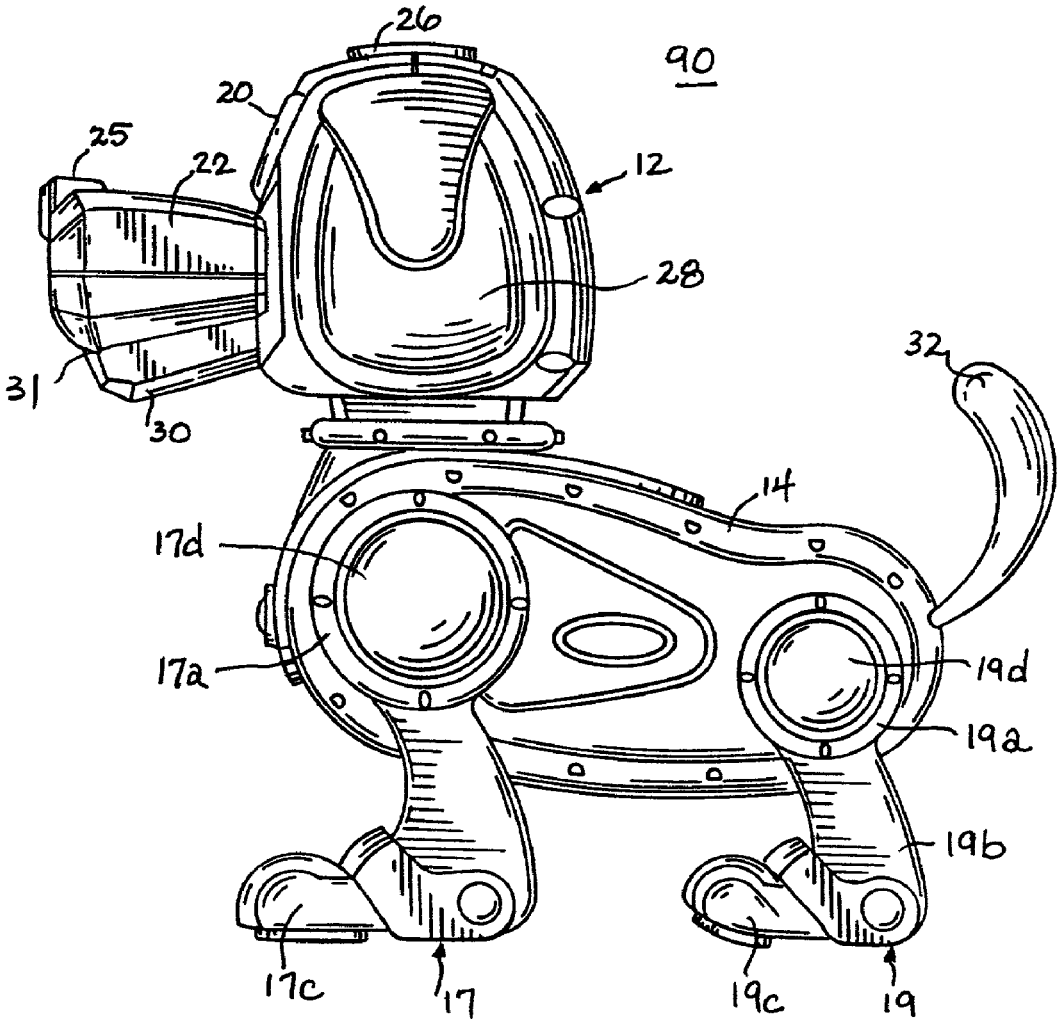
FIG. 26 is a side view of the electronic toy shown in FIG. 25.
Figure 27:
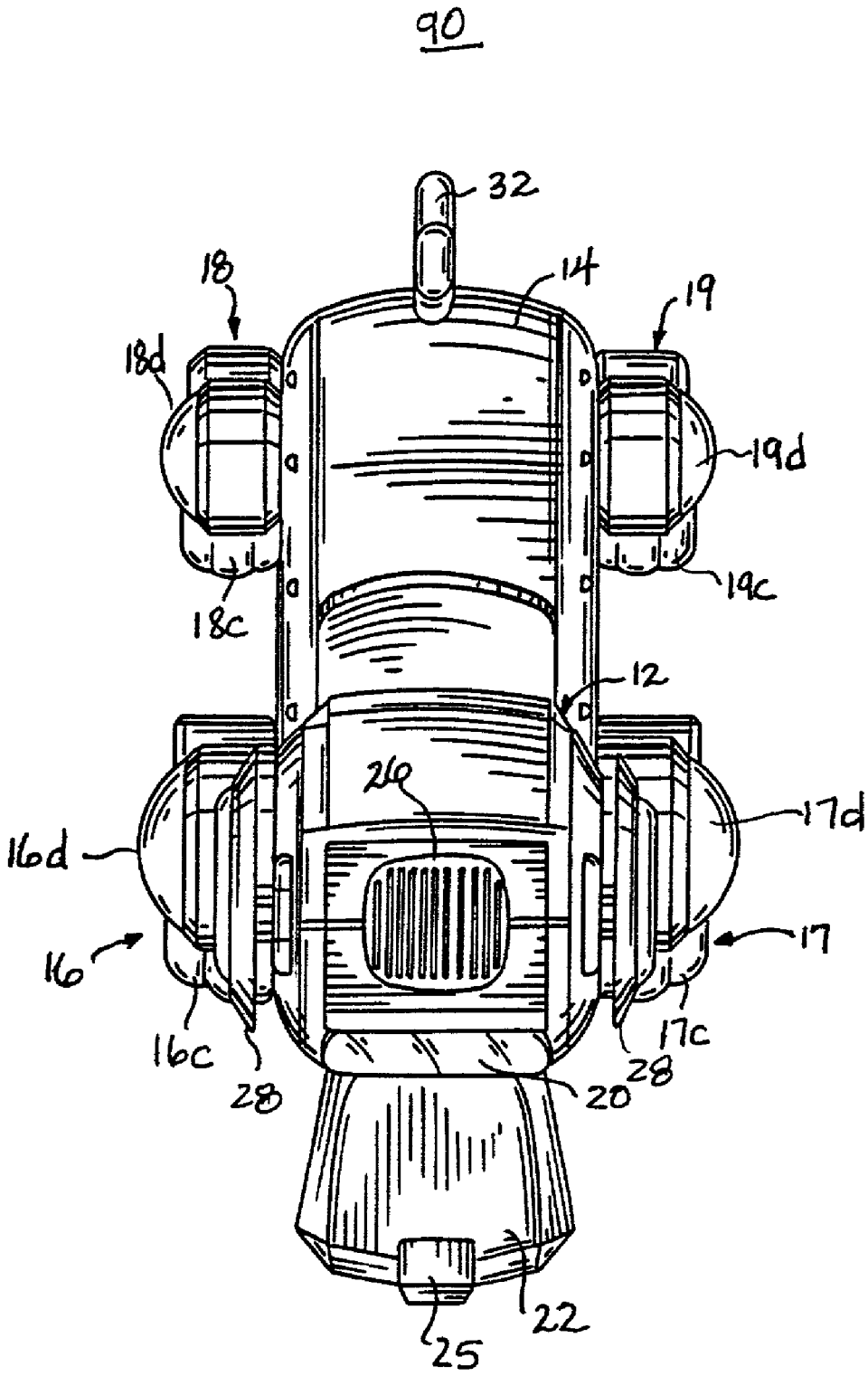
FIG. 27 is a plan view of the electronic toy shown in FIG. 25.
Figure 28:
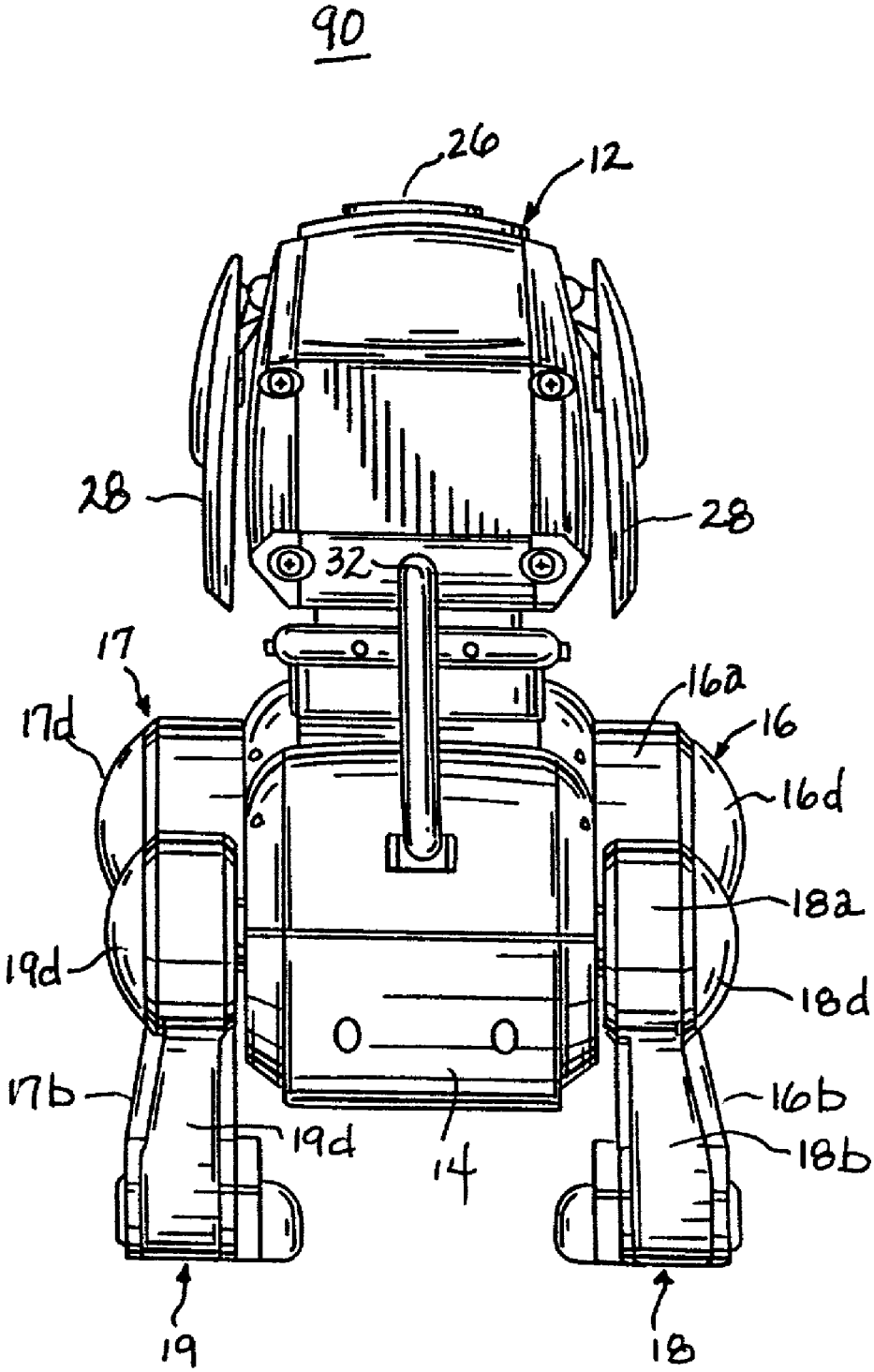
FIG. 28 is a rear view of the electronic toy shown in FIG. 25.
Figure 29:
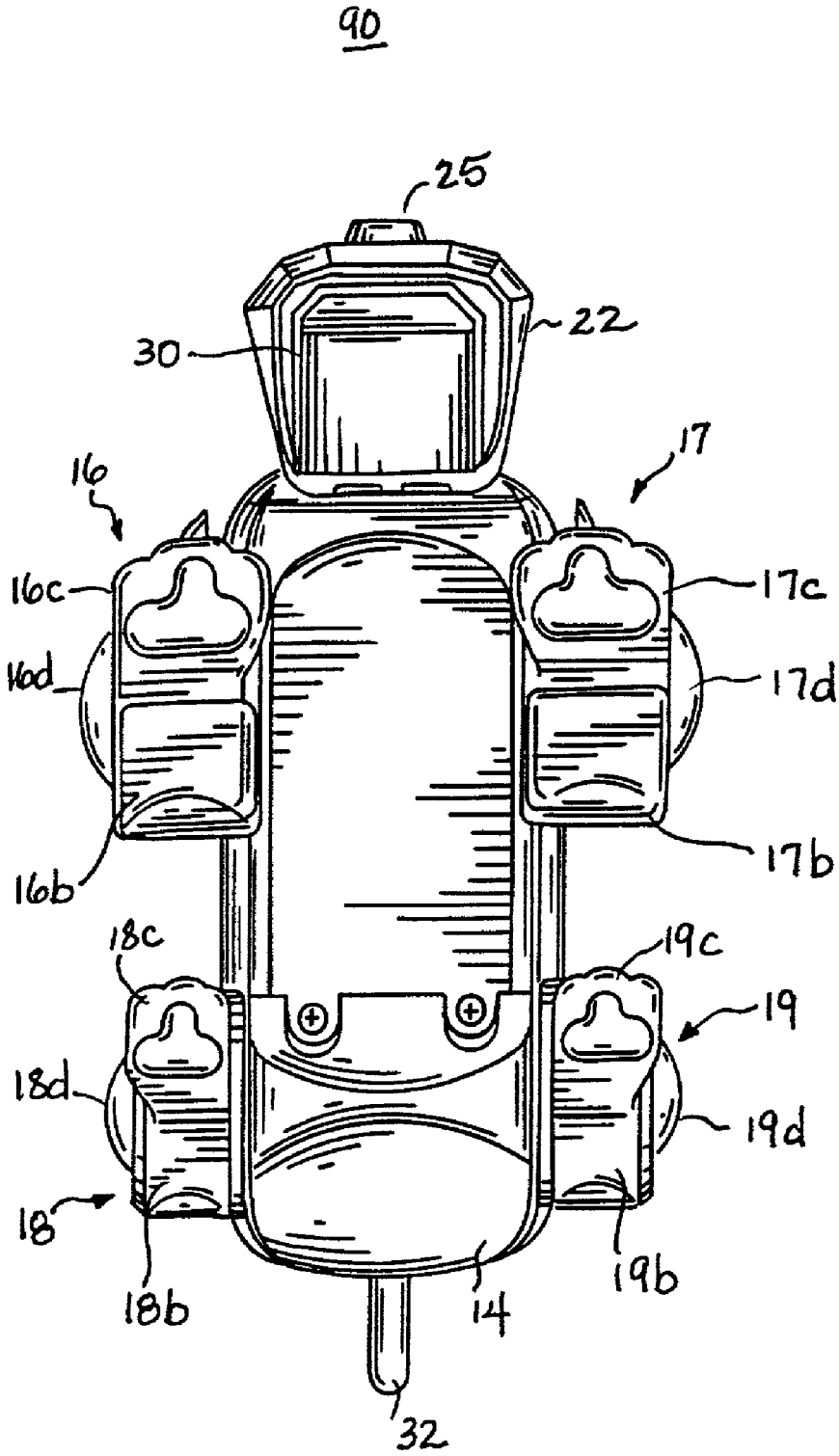
FIG. 29 is a bottom view of the electronic toy shown in FIG. 25.
Figure 30:
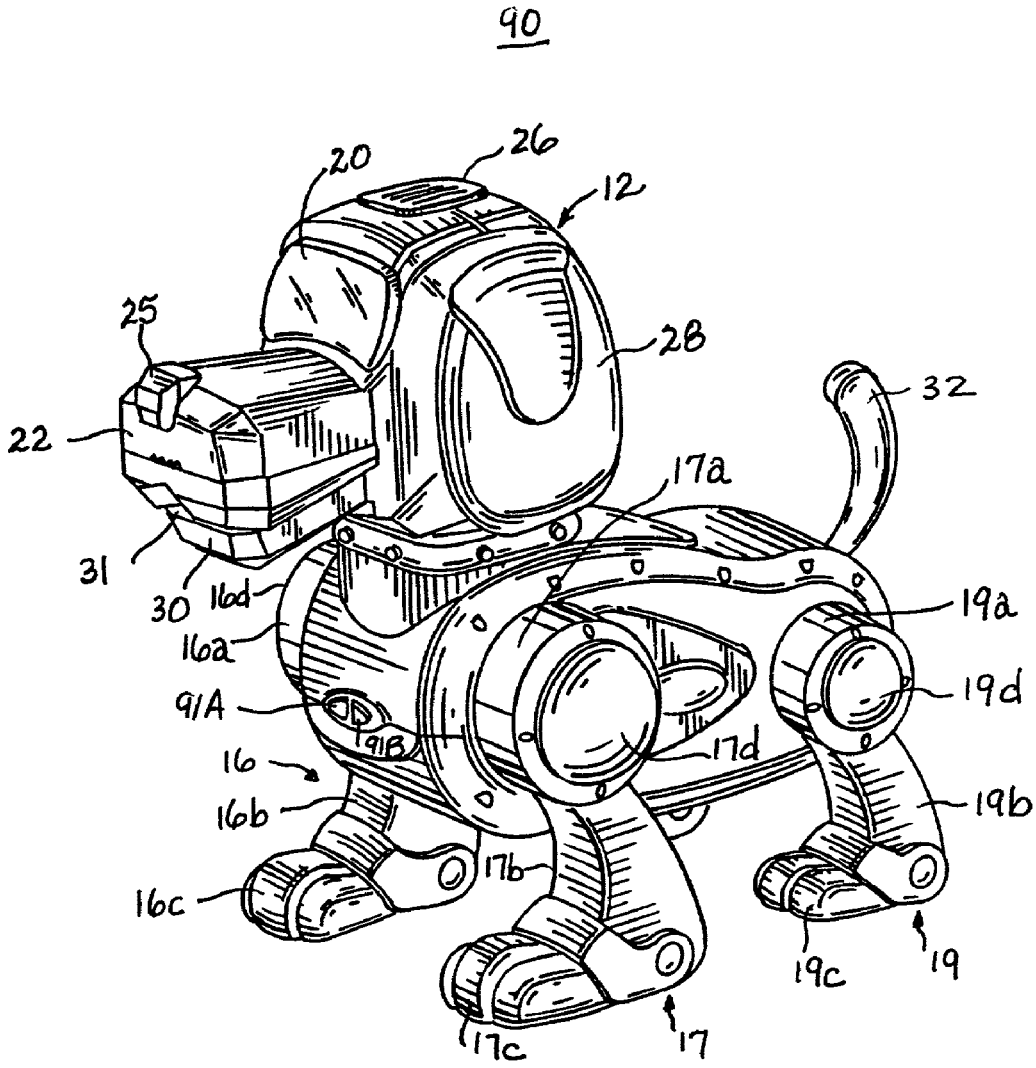
FIG. 30 is a perspective view of the electronic toy shown in FIG. 25.

FIG. 25 is a front view of the electronic toy according to the second embodiment of the present invention. FIG. 26 is a side view of the electronic toy shown in FIG. 25. FIG. 27 is a plan view of the electronic toy shown in FIG. 25. FIG. 28 is a rear view of the electronic toy shown in FIG. 25. FIG. 29 is a bottom view of the electronic toy shown in FIG. 25. FIG. 30 is a perspective view of the electronic toy shown in FIG. 25. Further, in FIGS. 25 through 30, the components identical to those of the electronic toy 10 in the first embodiment will bear the same numbers as born in the electronic toy 10 in the first embodiment, and the explanation of such numbers will be omitted.

As shown in FIGS. 25 through 30, an electronic 90 is a dog-shaped toy have a head 12, body 14, and legs 16-19 as the electronic toy 10 does. Further, the electronic toy 90 is different from the aforementioned electronic toy 10 in that it can swing its head 12 in the lateral direction and that the tail 32 is provided so as to be rockable in the lateral direction.

Further, in the electronic toy 90, two push-type mode selection switches 91A and 91B are provided on the breast of the body 14. Either of these mode selection switches 91A and 91B is selectively operated in, for example, starting a sound registration mode as explained later, or selecting a character-raising mode and a character basic mode, etc. Furthermore, the mode selection switches 91A and 91B, upon the both being simultaneously operated to be on, functions as a reset switch to reset control data stored in the memory.

Further, the electronic toy 90 can perform 15 types of motions.

FIG. 31 is a diagram showing the combinations of the motion types of the electronic toy 90 and the motion positions of the legs 16-19: (A) is a diagram showing the combinations of the motion types and the motion positions of the legs 16-19, and (B) is a diagram respectively showing the rotation angles of the legs 16-19.

As shown in (A) and (B) of FIG. 31, the legs 16 and 17, to constitute the front legs of the electronic toy 90, are rotated to either of a vertical position A or a horizontal position B, and the legs 18 and 19, to constitute hind legs, are rotated to any of a vertical position C, a forward tilt position D, a horizontal position E or a back tilt position F. By the legs 16 and 17 being rotated to either of the vertical position A or the horizontal position B and the legs 18 and 19 being rotated to any of the positions C to F, the motions such as stand, sit, lie down, growl, hand, good, wriggle 1, wriggle 2, stretch 1, stretch 2, stretch 3, pushup, back 1, back 2, and perform, can be performed.

Figure 32:
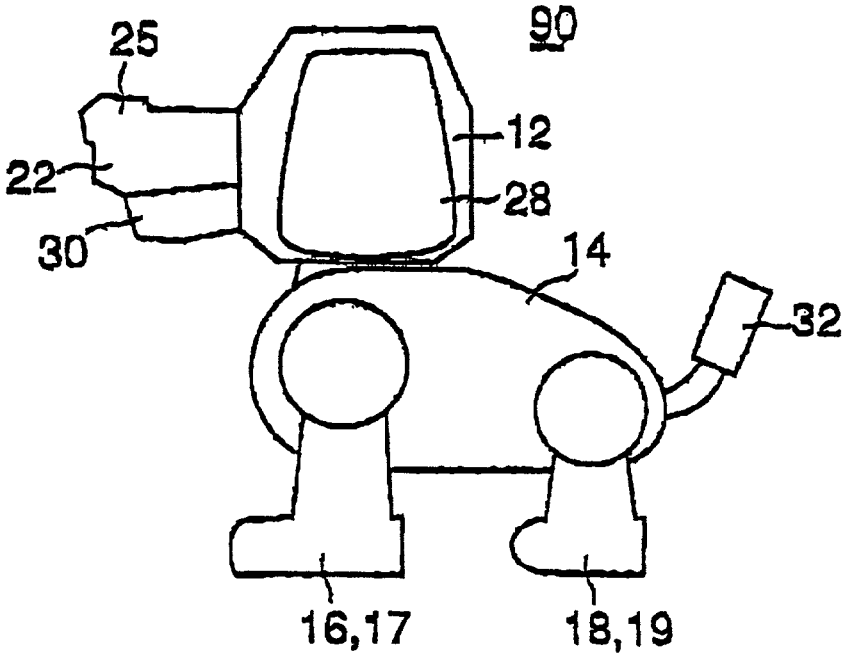
FIG. 32 is a side view for explaining a motion of "stand" of the electronic toy 90.
Figure 33:
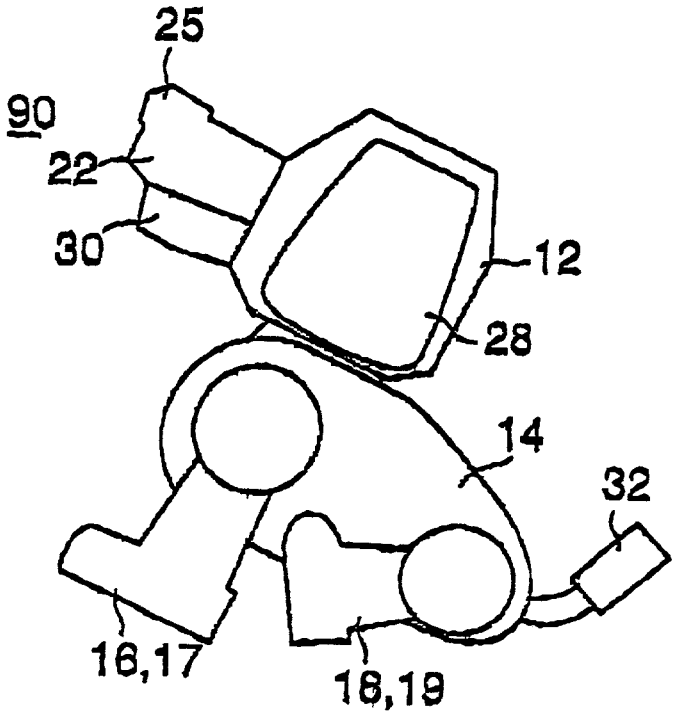
FIG. 33 is a side view for explaining a motion of "sit" of the electronic toy 90.

As shown in FIG. 32, the electronic toy 90, upon the word "stand" being inputted by a user, rotates the legs 16 through 19 to the vertical position A and the horizontal position C, and stands. Further, as shown in FIG. 33, the electronic toy 90, upon the words "sit" inputted by a user, rotates its hind legs 18 and 19 to the front tilt position D while keeping the legs 16 and 17 in the vertical position A.

Figure 34:
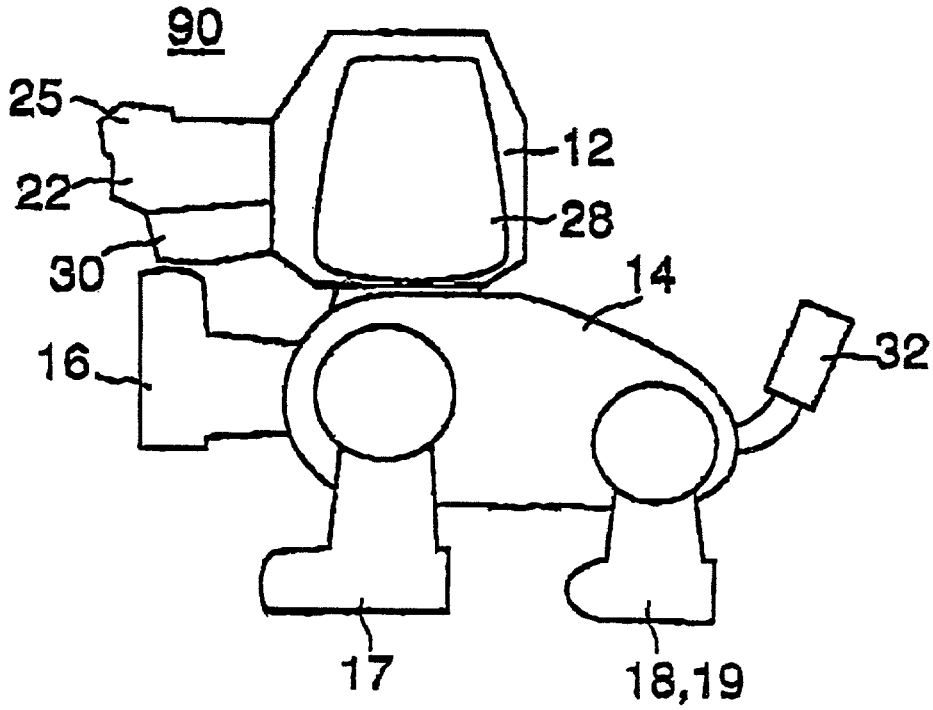
FIG. 34 is a side view for explaining a motion of "hand" of the electronic toy 90.
Figure 35:
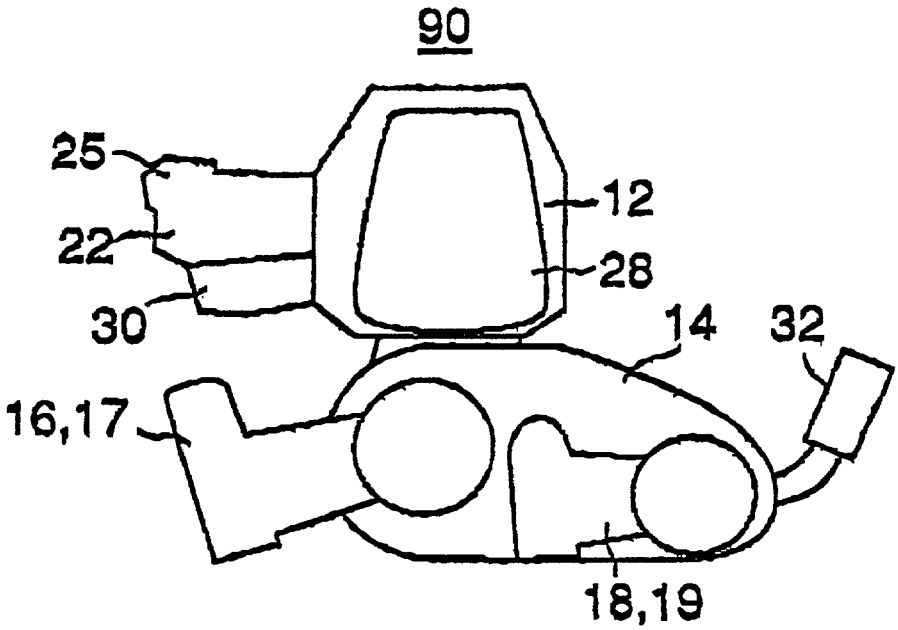
FIG. 35 is a side view for explaining a motion of "lie down" of the electronic toy 90.

Further, as shown in FIG. 34, the electronic toy 90, upon the word "hand" being inputted by a user, rotates the leg 16, which constitutes the right front leg, to the horizontal position B while keeping the legs 17 through 19 in the vertical positions A and C and gives its hand to the user. Furthermore, as shown in FIG. 35, the electronic toy 90, upon the words "lie down" being inputted by a user, rotates the legs 16-19 to the forward horizontal positions B and E and becomes in a posture of lies down.

In the electronic toy 90, the display 20 for displaying the expression of the eyes is provided on the front surface of the head 12. The display 20 may selectively illuminate a plurality of LEDs in order to express the feelings of the electronic toy 90 at such time by the display pattern of the eyes.

Here, the display patterns of the display 20 is explained.

Figure 36:
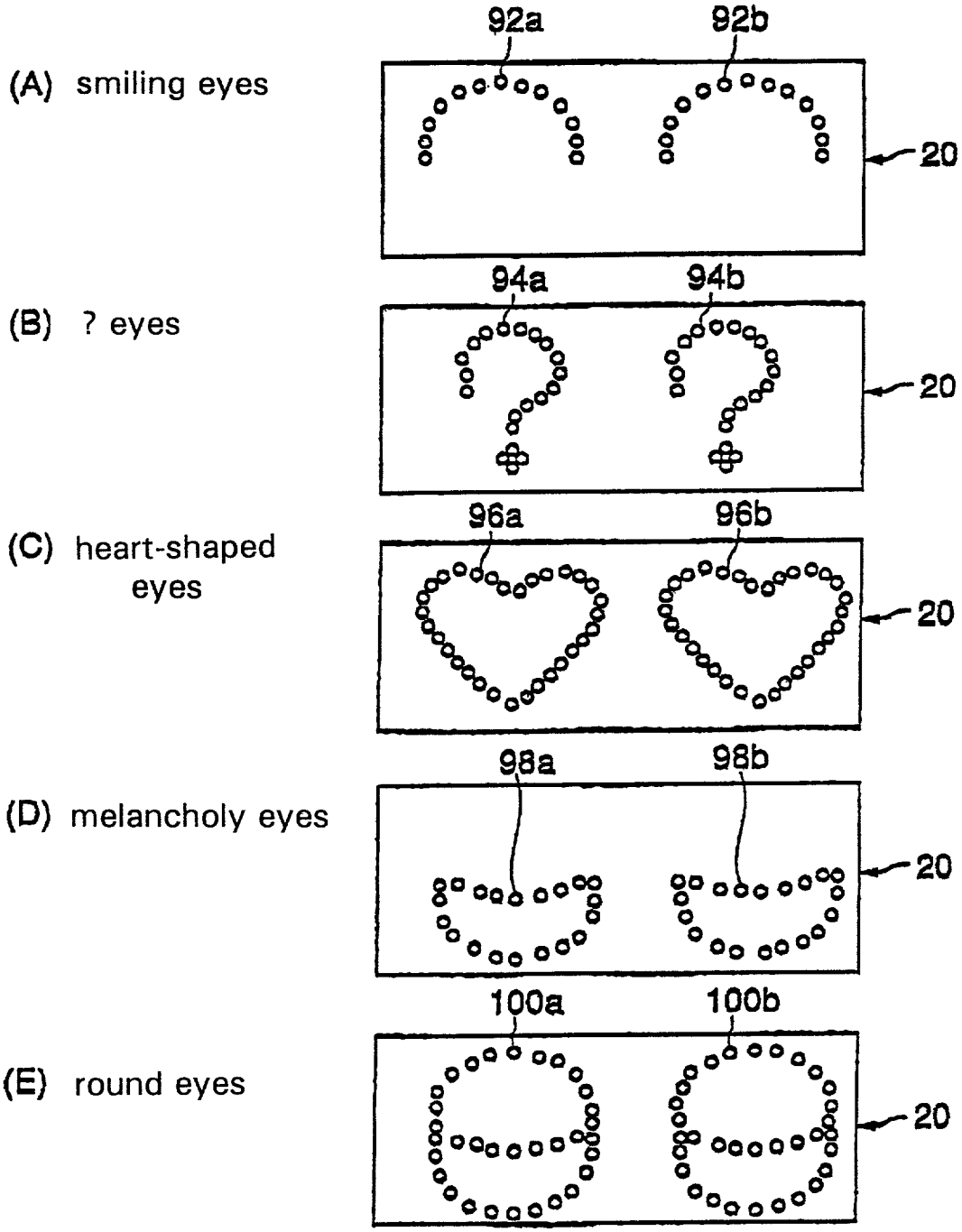
FIG. 36 is a diagram showing an example of the display patterns on the display 20; (A) is a diagram showing smiling eyes; (B) is a diagram showing ? eyes; (C) is a diagram showing heart-shaped eyes; (D) is a diagram showing melancholy eyes; and (E) is a diagram showing round eyes.

FIG. 36 is a diagram showing an example of the display patterns of the display 20; (A) is a diagram showing smiling eyes; (B) is a diagram showing ? eyes; (C) is a diagram showing heart-shaped eyes; (D) is a diagram showing melancholy eyes; and (E) is a diagram showing round eyes.

As shown in diagrams (A) through (E) of FIG. 36, in the display 20 of the second embodiment, it is possible, for example, to selectively display five types of the display patterns ①-⑤.

In the display pattern ①, a smiling eyes pattern in a circular arc shape illuminates in illuminators 92*a* and 92*b*.

In the display pattern ②, a ? eyes pattern in a question mark shape illuminates in illuminators 94*a* and 94*b*.

In the display pattern ③, a heart-shaped eyes pattern in a heart-shaped shape illuminates in illuminators 96*a* and 96*b*.

In the display pattern ④, an unsatisfying eyes pattern in a crescent shape (sickle-shaped) illuminates in illuminators 98*a* and 98*b*.

In the display pattern ⑤, a round eyes pattern, which simultaneously display the above smiling eyes pattern and melancholy eyes pattern, illuminates in illuminators 100*a* and 100*b*.

Next, a sound registration mode to be performed when batteries are installed is explained.

FIG. 37 is a diagram for explaining a sound registration; (A) is a diagram showing an example of registered words to be used in sound registration; (B) is a flowchart for explaining the steps of sound registration; (C) is a flowchart for explaining an unsuccessful example of sound registration; and (D) is a flowchart for explaining a successful example of sound registration.

As shown in FIG. 37(A), six kinds of terms, ① dog's name, ② hand, ③ lie down, ④ sit, ⑤ good, and ⑥ let's play, are used in this embodiment as words for sound registration.

Next, steps of sound registration to be taken by CPU 80 in controller 62 are explained.

As shown in FIG. 37(B), a sound registration mode starts when batteries are first installed in the electronic toy 90 at S51 and the mode selection switch 91A is then turned on. At the next S52, the sound message "Say 'name'" is given from the speaker 26 of the electronic toy 90 while smiling eyes (see FIG. 36(A)) are flashing on the display 20. When a user says the dog's name in response to this, the name is inputted in the sound sensor 24.

Upon the sound input of the dog's name being registered, the routine proceeds to S53, a sound message "Say 'hand'" is given from the speaker 26 while smiling eyes are flashing on the display 20 (see FIG. 36(A)). When a user says "hand" in response to this, the word "hand" is inputted in the sound sensor 24.

Upon the sound input of "hand" being registered, the routine proceeds to S54 and gives from the speaker 26 a sound message "Say 'sit'" while smiling eyes (see FIG. 36(A)) are flashing on the display 20. When a user says "sit" in response to this, the words "sit" are inputted in the sound sensor 24.

Upon the sound input of "sit" being registered, the routine proceeds to S55 and gives from the speaker 26 a sound message "Say 'lie down'" while smiling eyes (see FIG. 36(A)) are flashing on the display 20. When a user says "lie down" in response to this, the words "lie down" are inputted in the sound sensor 24.

Upon the sound input of "lie down" being registered, the routine proceeds to S56 and gives from the speaker 26 a sound message "Say 'good'" while smiling eyes (see FIG. 36(A)) are flashing on the display 20. When a user says "good" in response to this, the word "good" is inputted in the sound sensor 24.

Upon the sound input of "good" being registered, the routine proceeds to S57 and gives from the speaker 26 a sound message "Say 'let's play'" while smiling eyes (see FIG. 36(A)) are flashing on the display 20. When a user says "let's play" in response to this, the words "let's play" are inputted in the sound sensor 24.

Upon the sound input of "let's play" being completed, the routine proceeds to S58 and the sound registration mode is terminated by giving an electronic sound, e.g., "Piro-rin".

Thus, the above six types of terms "① the dog's name, ② hand, ③ lie down, ④ sit, ⑤ good, and ⑥ let's play" are registered with the user's sound.

Next, an unsuccessful sound registration is explained.

As shown in FIG. 37(C), when, at S61, a sound message "Say 'name'" is given from the speaker 26 while smiling eyes are flashing on the display 20 (see FIG. 36(A)), if the dog's name is not inputted and registered from the sound sensor 24 in spite of saying the dog's name (e.g., POO-CHI), the routine proceeds to S62 and gives from the speaker 26 an error sound such as "boo-boo" while displaying ? eyes (see FIG. 36(B)) on the display 20. This enables a user to confirm an unsuccessful sound registration.

Then, at S63, the sound message "Say the name once again" is given from the speaker 26.

Further, a motion of a successful sound registration is explained.

As shown in FIG. 37(D), when, at S71, a sound message "Say 'name'" is given from the speaker 26 while smiling eyes are flashing on the display 20 (see FIG. 36(A)), if the name said by a user (e.g., "POO-CHI") is registered from the sound sensor 24, the routine proceeds to S72 and gives from the speaker 26 a sound such as "pin-pon" while displaying heart-shaped eyes (see FIG. 36(C)) on the display 20. This enables a user to confirm a successful sound registration.

Next, upon the sound registration mode of the electronic toy 90 being completed, the routine proceeds to the character registration mode, in which the character of the electronic toy 90 is registered.

Figure 40:
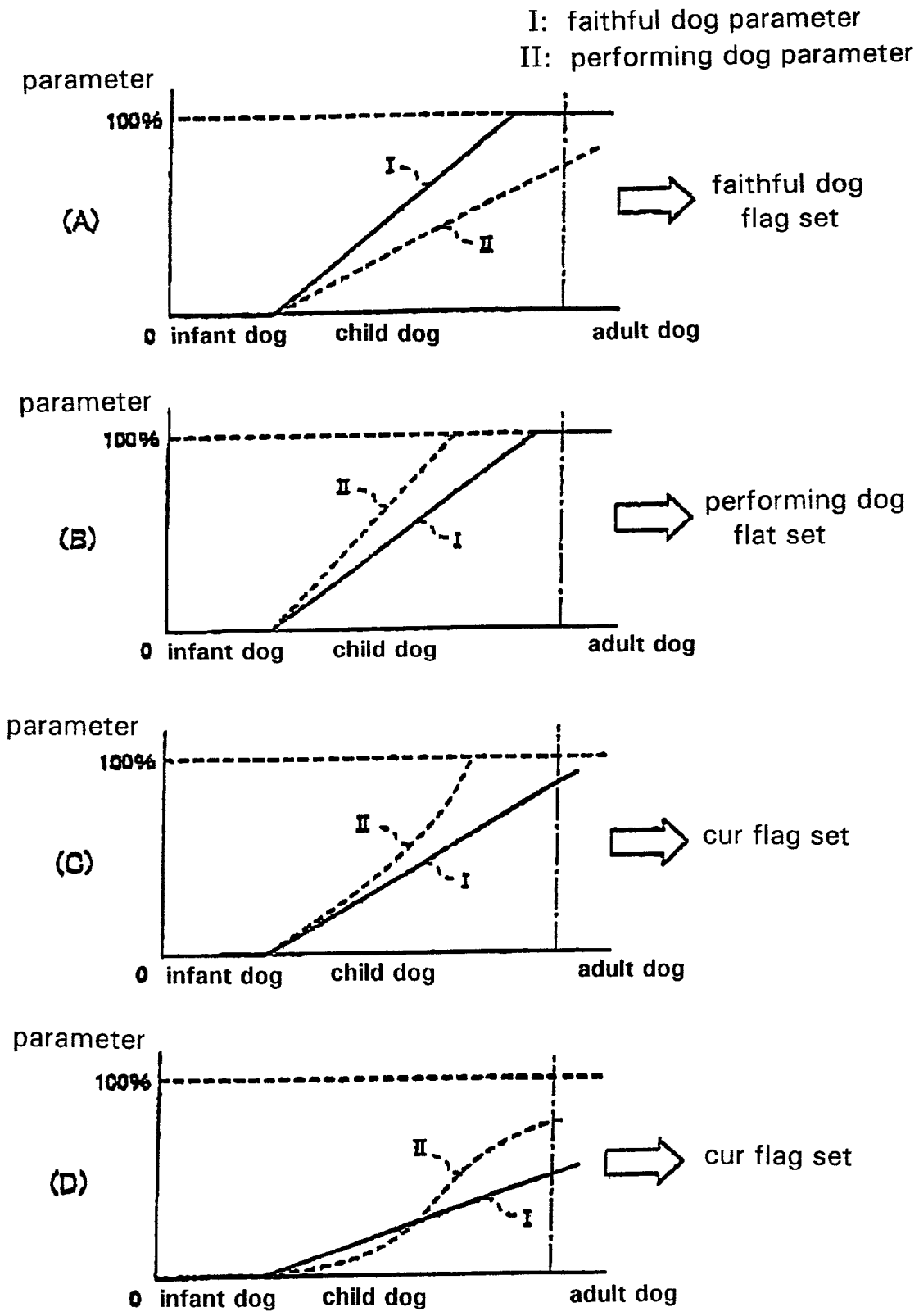
FIG. 40 is a graph showing the characters set in accordance with the variation (increase) of the number of points in a faithful dog parameter I and a performing dog parameter II which are registered in the character formation parameter MAP 102; (A) is a graph showing a faithful dog setting mode; (B) is a graph showing a performing dog setting mode; and (C) and (D) are graphs showing cur setting modes.

Here, the character registration mode of the electronic toy 90 is explained in reference to FIGS. 38 through 40. FIG. 38 is a diagram for explaining an example of conditions for character formation; (A) is a diagram showing characteristics of the characters; (B) is a diagram showing an example of the character formation parameter MAP; and (C) is a diagram showing an example of conditions for character changing.

As shown in FIG. 38(A), there are three types of characters registrable in the electronic toy 90: ① a cur (characterized in, for example, singing an indecent song with an indecent sound, ignoring an instruction by its master and performing differently, or sleeping all the time), ② a faithful dog (characterized in faithfully performing an instruction by its master and being able to sing), and ③ a performing dog (characterized in having a faithful character the same as a faithful dog as well as being pleasing, e.g., performing a special trick when a user says "let's play").

As shown in FIG. 38(B), a character formation parameter MAP 102, which forms a character of the electronic toy 90, consists of a faithful dog parameter and a performing dog parameter. In this character formation parameter, points are counted in accordance with the way and the number of times of contacting (i.e., training) the electronic toy 90 within a predetermined time (e.g., four hours).

The way of contacting (i.e., training) the electronic toy 90 to be counted for a faithful dog parameter includes, for example, giving commands of "hand", "sit", "lie down", etc. Further, the way of contacting (i.e., training) the electronic toy 90 to be counted for a performing dog parameter includes giving a command of "let's play".

When a user says "hand", for example, if the electronic toy 90 extends its hand outward as shown in FIG. 34, the point of "hand" is increased. Thus, when the electronic toy 90 obeys a command from a user, the items of the character formation parameter MAP 102 become filled with a circle mark, thereby points of the faithful dog parameter and the performing dog parameter increase.

Further, as shown in FIG. 38(C), for the condition for character changing, when, for example, 25 points are counted in all the items in the character formation parameter MAP 102 within four hours, the electronic toy 90 will have a character of a performing dog. Further, when 25 points are counted in the items of a faithful dog parameter of the character formation parameter MAP 102 within four hours, the electronic toy 90 has a character of a faithful dog. Furthermore, when less than 25 points are counted in the faithful dog parameter and the performing dog parameter of the character formation parameter MAP 102 within four hours, the electronic toy 90 has a character of a cur.

FIG. 39 is a diagram for explaining an example of character registration motions; (A) is a diagram showing an example of an incorrect motion; and (B) is a diagram showing an example of a correct motion.

As shown in FIG. 39(A), when the electronic toy 90, for example, selects "sit" from motion candidates and performs a motion of "sit" (see FIG. 33) in spite of a user giving a command of "hand", the user taps the speaker 26 provided on the upper surface of the head 12 as the electronic toy 90 performs a wrong motion. By this, the detection switch 59 provided beneath the speaker 26 is pressed with a strong pressure and is turned on.

When it is detected in a judgment process that the detection switch is pressed with a strong pressure, a point of the character formation parameter MAP 102 is not registered and the controller 62 selects the next motion candidate.

As shown in FIG. 39(B), however, when the electronic toy 90, upon a user giving a command of "hand", for example, selects "hand" from motion candidates and performs a motion of "hand" (see FIG. 34), the sound sensor 24 inputs the word "good" upon a user saying "good". By this, the controller 62 resets "hand" from the motion candidates and registers as a point of the character formation parameter MAP 102.

FIG. 40 is a graph showing the characters set in accordance with the variation (increase) of the number of points in a faithful dog parameter I and a performing dog parameter II which are registered in the above character formation parameter MAP 102; (A) is a graph showing a faithful dog setting mode; (B) is a graph showing a performing dog setting mode; and (C) and (D) are graphs showing a cur setting mode. Further, character formation is performed at the period of a child dog (e.g., four hours after the installation of batteries).

As shown in FIG. 40(A), the electronic toy 90 is an infant dog when batteries are installed, and it is impossible to predict a motion in response to a command by a user as the learning capability does not function. After the period of an infant dog (the period of premature), the period of a child dog (the period of growing up) starts and character formation is now possible. Then the number of points in the faithful dog parameter I and the performing dog parameter II which are registered in the character-forming parameter MAP 102 is varied (increases) in response to the way and number of times of contacting the electronic toy 90 in the child period.

For example, if, in the child period, the points in the faithful dog parameter I reached the goal (25 points) prior to the points in the performing dog parameter II, the electronic dog 90 has a character of a faithful dog when it reaches the adult dog period (the period of completion of growing up), and a faithful dog flag (a first control flag) is set.

Further, as shown in FIG. 40(B), if, in the child dog period, the points in the performing dog parameter II reached to 100 percent of the goal (25 points) prior to the points in the faithful dog parameter I, the electronic dog 90 has a character of a performing dog when it reaches the adult dog period, and a performing dog flag (a first control flag) is set.

Further, as shown in FIG. 40(D), when, in the child dog period, the points of the performing dog parameter II at first increases likewise the points of the faithful dog parameter I increases, and the performing dog parameter II then sharply increases in the middle and reaches the goal (25 points), the electronic toy 90 has a character of a cur when it reaches the adult dog period, and a cur flag (a second control flag) is set.

As shown in FIG. 40(D), when, in the child dog period, the points of the performing dog parameter II at first varies below the points of the faithful dog parameter I, and the points of the performing dog parameter II then sharply increases in the middle and reaches to the value more than the points of the faithful dog parameter I, the electronic toy 90 has a character of a cur when it reaches the adult dog period.

Thus, the number of points in the faithful dog parameter I and the performing dog parameter II is varied (increases), by which the electronic toy 90 is set to have a character of any of a faithful dog, a performing dog, or a cur. Therefore, a user can enjoy the way of bringing up the electronic toy 90 as the user can cause it to grow up into a faithful dog or a performing dog when the user adequately makes contact with it in a predetermined period of time after the installation of batteries, and to a cur when the amount of contact is low.

Next, emotion parameter to execute motion control when the electronic toy 90 becomes an adult dog after the character developing period.

The emotion parameter includes a mood parameter that varies with the lapse of time and a fullness parameter that varies with the frequencies of feeding.

FIG. 41 includes diagrams explaining the mood parameters; (A) indicates the level of the mood parameter; (B) indicates the state of the respective level, (C) indicates positive conditions to the mood parameter; and (D) indicates negative conditions to the mood parameter.

As shown in (A) of FIG. 41, the mood parameter value $P_A$ is set so as to vary in five stages. At level 1, $P_A$=0-20; at level 2, $P_A$=20-40; at level 3, $P_A$=40-60; at level 4, $P_A$=60-80; and at level 5, $P_A$=80-100 and 100-127.

At the starting point, the initialization value is set as 50 for the mood parameter value $P_A$.

As shown in (B) of FIG. 41, when the mood parameter value $P_A$ is at level 1, the controlling mode of the electronic toy 90 is in the ultra unhappy state. When the mood parameter value $P_A$ is at level 2, the controlling mode of the electronic toy 90 is in the unhappy state. When the mood parameter value $P_A$ is at level 3, the controlling mode of the electronic toy 90 is in the normal state. When the mood parameter value $P_A$ is at level 4, the controlling mode of the electronic toy 90 is in the happy state. When the mood parameter value $P_A$ is at level 5, the controlling mode of the electronic toy 90 is in the ultra happy state.

As shown in (C) of FIG. 41, when a user pats the head 12 of the electronic toy 90, the mood parameter value $P_A$ increases by 2 points; and when it is praised for its motion made upon the command of user (for example, "good", etc.), the mood parameter value $P_A$ increases by four points. When it is told "no good" for its motion made upon the command of user, the parameter value $P_A$ increases by one point.

As shown in (D) of FIG. 41, when a user strikes the head 12 of the electronic toy 90, the mood parameter value $P_A$ decreases by one point. With the lapse of time after feeding (for example, every one minute), the fullness level gradually goes down: at the fullness level 5, the mood parameter value $P_A$ decreases by two points; at the fullness level 4, by four points; at the fullness level 3, by six points; at the fullness level 2, by eight points; at the fullness level 1, by ten points. Accordingly, the mood parameter is set so as to vary in accordance with the fullness parameter value $P_B$.

When the electronic toy 90 sleeps, and the mood parameter value $P_A$ exceeds 100, it is amended as 100 since it falls under level 5.

When the mood parameter value $P_A$ exceeds 127 (maximum value at level 5), it is amended as 20, ultra unhappy state, since the ultra happy state was maintained for a rather long time.

Figure 42:
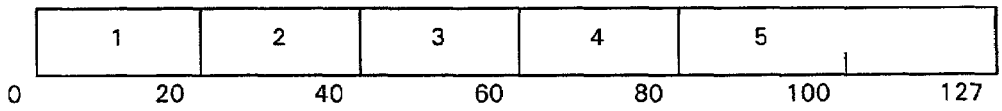
FIG. 42 is a diagram explaining the fullness parameters; (A) indicates the level of a fullness parameter; (B) indicates the state of the respective level; and (C) indicates positive conditions to the fullness parameter, and (D) indicates negative conditions to the fullness parameter.

FIG. 42 includes diagrams explaining the fullness parameters; (A) indicates the level of the fullness parameter, (B) indicates the state of the respective level; (C) indicates positive conditions to the fullness parameter; and (D) indicates negative conditions to the fullness parameter.

As shown in (A) of FIG. 42, the fullness parameter value $P_B$ is set so as to vary in five stages. At level 1, $P_B$=0-20; at level 2, $P_B$=20-40; at level 3, $P_B$=40-60; at level 4, $P_B$=60-80; and at level 5, $P_B$=80-100 and 100-127.

At the starting point, the initialization value is set as 50 for the fullness parameter value $P_B$.

As shown in (B) of FIG. 42, when the fullness parameter value $P_B$ is at level 1, the controlling mode of the electronic toy 90 is in the ultra hungry state. When the mood parameter value $P_B$ is at level 2, the controlling mode of the electronic toy 90 is in the hungry state. When the mood parameter value $P_B$ is at level 3, the controlling mode of the electronic toy 90 is in the normal state. When the mood parameter value $P_B$ is at level 4, the controlling mode of the electronic toy 90 is in the full state. When the mood parameter value $P_B$ is at level 5, the controlling mode of the electronic toy 90 is in the ultra full state.

When a fullness parameter value $P_B$ exceeds 127, it is reduced to 20 since it is overfed.

As shown in (C) of FIG. 42, when a user provides the electronic toy 90 with food, the fullness parameter value $P_B$ increases by four points.

As shown in (D) of FIG. 42, when the electronic toy 90 makes a sound, or conducts a motion to demand for food, the fullness parameter value $P_B$ decreases by one point.

Furthermore, as the fixed time (for example, one minute) passes after the electronic toy 90 becomes hungry and demands for food, the fullness parameter value $P_B$ decreases by four points. Accordingly, the fullness parameter value $P_B$ increases if a user periodically provides food, but the fullness parameter value $P_B$ decreases and the toy becomes hungry if a user does not provide food. The mood parameter value $P_A$ also decreases and changes to an unhappy state.

As for a food, a similar shape to bone, for example, is prepared in resin, and a magnet is embedded into it. It is possible to detect this food by installing a magnetic sensor inside the mouth 31 of the electronic toy 90. Or, it may be also possible to detect the food by installing a light sensor inside the mouth 31 of the electronic toy 90.

Figure 43:
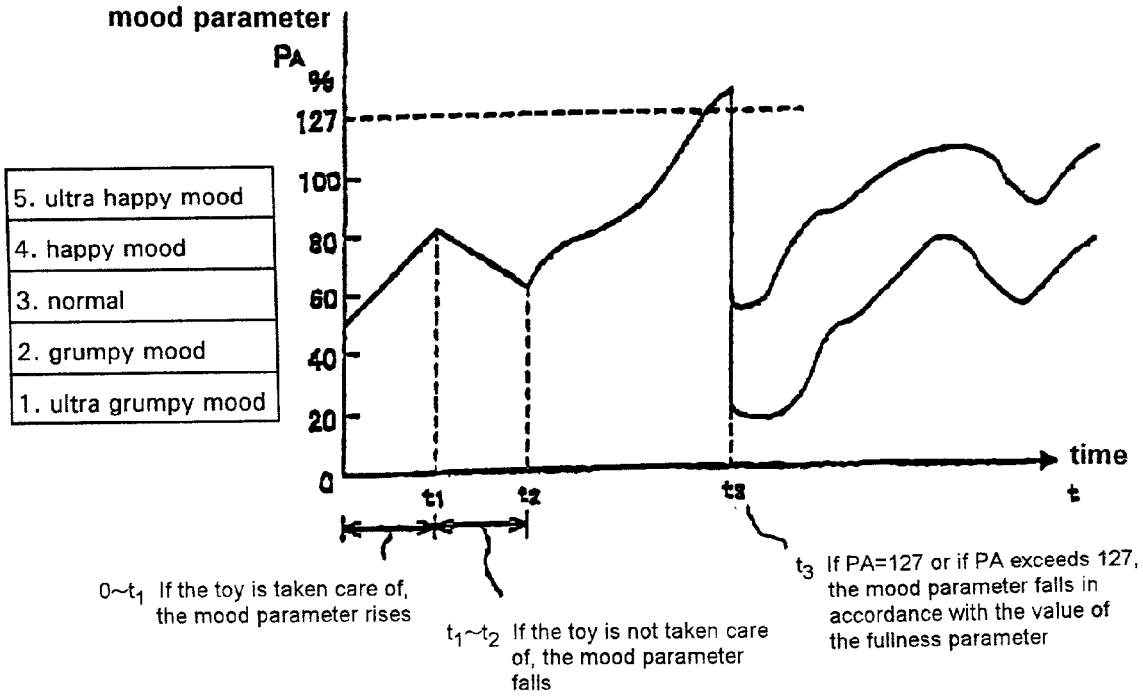
FIG. 43 is a graph showing an example of the mood parameter changes.

FIG. 43 is a graph showing an example of the mood parameter changes.

As shown in FIG. 43, the mood parameter value $P_A$ increases since the user cares for the electronic toy 90 during the time between 0 and $t_1$. However, the mood parameter value $P_A$ decreases since the user does not care for the electronic toy 90 during the time between $t_1$ and $t_2$.

At $t_3$, the mood parameter value $P_A$ exceeds 127 and decreases rapidly due to the fullness parameter value $P_B$. This prevents the users from getting tired of having an ultra happy mode continuously.

FIG. 44 is a diagram showing an example of the changing values of the mood parameter in accordance with the fullness parameter value $P_B$.

As shown in FIG. 44, in this embodiment, ① when the fullness parameter value $P_B$ is in the range of 0 to 20, the changing value of the mood parameter value $P_A$ decreases by 100, ② when the fullness parameter value $P_B$ is in the range of 20 to 40, the changing value of the mood parameter value $P_A$ decreases by 90, ③ when the fullness parameter value $P_B$ is in the range of 40 to 60, the changing value of the mood parameter value $P_A$ decreases by 80, ④ when the fullness parameter value $P_B$ is in the range of 60 to 80, the changing value of the mood parameter value $P_A$ decreases by 70, and ⑤ when the fullness parameter value $P_B$ is in the range of 80 to 127, the changing value of the mood parameter value $P_A$ decreases by 60.

Thus, the more the toy becomes hungry, the bigger the changing value of the mood parameter becomes, and the more it becomes full, the smaller the changing value of the mood parameter becomes. Accordingly, the mood parameter changes are affected by the fullness parameters that vary by the feeding frequencies or feeding intervals as well as the sound input or the patting of the head 12 by users. The users are required to pay attention to the feeding time or frequencies as are for an actual dog, which enables them to play with the electronic toy 90 as if they raise an actual dog.

The control processing executed by controller 62 of the electronic toy 90 constructed as in the above is not explained.

Figure 45:
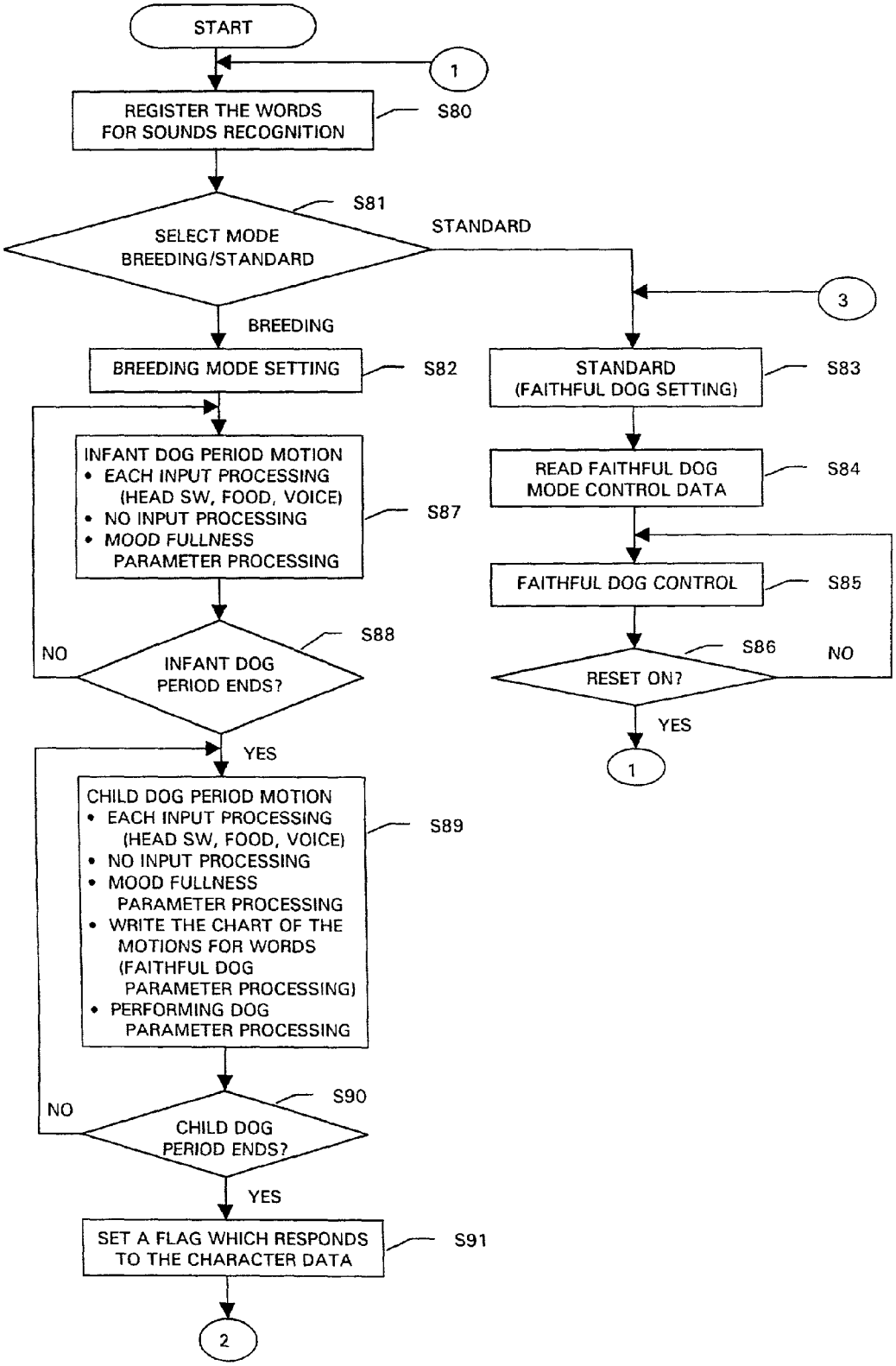
FIG. 45 is a flowchart of the main processing executed by the controller 62 of the electronic toy 90.
Figure 46:
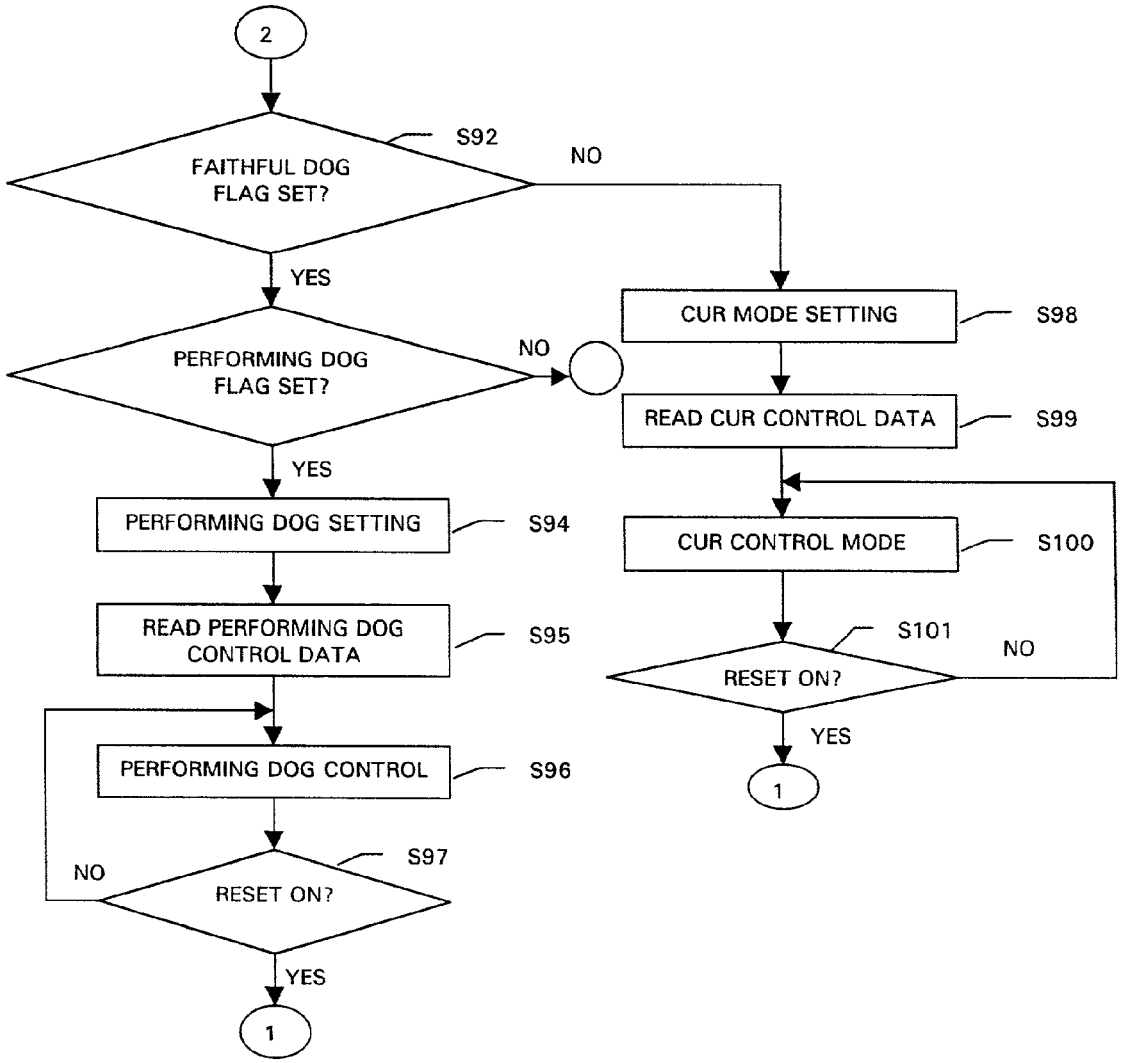
FIG. 46 is a flowchart of the main processing executed following the processing of FIG. 45.

FIG. 45 is a flowchart of the main processing executed by the controller 62 of the electronic toy 90. FIG. 46 is a flowchart of the main processing executed following the processing of FIG. 45.

As shown in FIG. 45, when a battery is installed in the electronic toy 90, the words for sound recognition are registered at S80. For this sound recognition processing, refer to the above stated (A) through (D) of FIG. 37.

At next S81, regarding the character of the electronic toy 90, either mode is selected: character developing mode during the child dog period, or standard character mode without character developing. For example, if a user switches on mode selection switch 91A, the character developing mode is selected, and if a user switches on mode selection switch 91B, the standard character mode is selected.

Accordingly, when mode selection switch 91A is on at S81, the user proceeds to S82, and character developing mode is set. When mode selection switch 91B is on at S81, proceeds to S83, and faithful dog mode as standard character mode is set.

When faithful dog mode is set at S83, control data for faithful dog mode is read from ROM 82 at S84. Then control of faithful dog mode is executed at S85, which will be continued until it is reset at S86.

When character developing mode is set at the above S82, the user proceeds to S87, and motion control for the infant dog period is executed. For this motion control, the following motions are included: motions to the sound input or the patting of the head 12 input, motion to no input, motions based on the mood parameter and fullness parameter. At S88, it is checked whether infant dog period ends or not.

When the infant dog period ends at S88, the user proceeds to S89, and motion control for child dog period is executed. This motion control is the above-mentioned learning mode (refer to FIGS. 38 through 40), and includes the following: the processing to each input such as switch at the head 12, sound, food, etc., the processing to no input, processing of mood parameter and fullness parameter, writing in character forming MAP 102 to the words (faithful dog parameter processing), performing dog parameter processing. At S90, it is checked whether the child dog period ends or not. Motion control for child dog period at S88 will be executed until the child dog period ends.

When the child dog period ends at S90, proceeds to S91, and one of flags among faithful dog, performing dog, or cur is set in accordance with the character data (faithful dog parameter, performing dog parameter) developed with the processing at about S88 (refer to (A) through (D) in FIG. 40).

At S92 (refer to FIG. 46), it is checked whether faithful dog flag is set or not. At S92, when faithful dog flag is set, proceeds to S93, and it is checked whether performing dog flag is set or not. At S93, when performing dog flag is set, proceeds to S94, and control data for performing dog mode is read from ROM 82 at S95 after setting performing dog made. Then control of performing dog mode is executed at S96, which will be continued until it is reset at S97.

When the faithful dog flag is not set at the above S92, the user proceeds to S98 judging that the cur flag is set, and the control data for the cur mode is read from ROM 82 at S99 after setting the cur mode. Then control of cur mode is executed at S100, which will be continued until it is reset at S101.

When performing dog flag is not set at the above S93, it moves to above S83, and processing for S83 through S86 is executed.

Thus, in this second embodiment, it is possible to form individual character data (faithful dog parameter, performing dog parameter) by executing character development processing responding to the user's reaction during the child dog period, and to enable to play as if the user raises an actual pet.

The following steps are used to train the electronic toy 90 for voice recognition. To give the electronic toy 90 a name:

A. Electronic toy 90 will say "Say a name".

B. Speaking clearly, say a name.

C. The electronic toy 90 will ask the user to repeat the name.

D. If the user has done this properly, the electronic toy 90 will beep and go to the next prompt, otherwise the electronic toy will ask the user to repeat the name again.

To train the electronic toy 90 to recognize specific commands:

PAW

A. The electronic toy 90 will prompt the user to say "PAW".

B. The electronic toy 90 will then prompt the user to repeat "PAW".

C. If the user has done this correctly then the electronic toy 90 will beep and proceed to the next prompt.

GOOD DOG

D. The electronic toy 90 will prompt the user to say "GOOD DOG".

E. The electronic toy 90 will then prompt the user to repeat "GOOD DOG".

F. If the user has done this correctly then the electronic toy 90 will beep and proceed to the next prompt.

LET'S SING

G. The electronic toy 90 will prompt the user to say "LET'S SING".

H. The electronic toy 90 will then prompt the user to repeat "LET'S SING".

I. If the user has done this correctly then the electronic toy 90 will beep and proceed to the next prompt.

LIE DOWN

J. The electronic toy 90 will prompt the user to say "LIE DOWN".

K. The electronic toy 90 will then prompt the user to repeat "LIE DOWN".

L. If the user has done this correctly then the electronic toy 90 will beep and proceed to the next prompt.

SIT

M. The electronic toy 90 will prompt the user to say "SIT".

N. The electronic toy 90 will then prompt the user to repeat "SIT".

O. If the user has done this correctly then the electronic toy 90 will beep and proceed to the next prompt.

To train the electronic toy 90 to respond to voice commands:

1) Wait until the electronic toy 90 has stopped moving.

2) Speaking clearly, call out the electronic toy 90 name; therefore if the user has named the dog "Spot", call out "Spot".

3) If the dog recognizes his name, his eyes will show "??" and he will say "huh".

4) While his eyes show "??" the user can give him a command from the list (PAW, GOOD DOG, LET'S SING, LIE DOWN, SIT).

The electronic toy 90 will go through three stages of development: Baby, Puppy, and Adult. In the Adult stage, the electronic toy 90 will become a LOYAL dog, TALENTED dog, or LAZY dog. As discussed, there are two modes of operation: Nourish mode or Adult mode. In Nourish mode, the user gets to train the electronic toy 90 to do tricks. In Adult mode, the electronic toy 90 will automatically know how to do all his tricks. In both modes the user's voice commands the electronic toy 90 to do his tricks. Press the left chest button to go to Nourish mode; press the right chest button to go to Adult mode.

After the user has completed the training of the electronic toy 90 to recognize its voice, Nourish mode is started automatically.

There are three stages of development in Nourish mode: Baby, Puppy, and Adult. In the Baby stage, the electronic toy 90 cannot understand the user's voice commands well. The electronic toy 90 also cannot stand up for a long time and is only able to sing one song. In the Baby mode, the electronic toy 90 will be able to respond to his name and may be able to do tricks.

When the electronic toy 90 develops to Puppy mode, the "Tada" sound is heard and he will start to bark. The puppy age is a very important development stage during which time the electronic toy 90 learns to do tricks by the user's voice commands. If the user plays a lot it will be able to teach the electronic toy 90 to do many things.

As a result of his learning during the puppy age, the electronic dog will become one of three different types of dog: lazy dog, faithful dog, or talented dog. If the user does not train its dog to properly respond to its voice commands, the electronic dog will become a lazy dog as an adult. If the dog becomes a lazy dog, he will have vague (confused) reaction to the user's voice commands.

If the user trains its dog well during the Puppy stage, he will become a Faithful dog. A Faithful dog will always properly respond to voice commands. If the user trains its dog well as a puppy and plays with it a lot during training, he will become a talented dog. A Talented dog will always respond properly to the user's voice command and will be able to sing lots of songs and dance a lot.

If the user leaves the electronic toy 90 alone without any communication (input voice command, touch, etc.) for over two minutes, the dog will take a nap for one minute. If the user leaves the electronic toy 90 for longer than two minutes, he will go to sleep.

Press his head button to wake him up.

If when the user replaces the electronic toy 90 batteries or if the electronic toy 90 does not make any action, press the Recover (Reset) switch, which is located inside of the upper jaw. If the user wants to start the electronic toy 90 all over again, press both chest buttons and hold for approximately four seconds. The user will then have to re-train the electronic toy 90 to recognize its voice If the user wants to get into the "secret mode", which plays all the songs the electronic toy 90 knows in a row without dancing, press the SET button for four seconds and it will begin beeping. Then press the MODE button and it will play the first song. If the user presses the HEAD button, it stops that song and the user can then press the MODE button to go to the next song. If the user presses the SET button again, it exits the secret mode. If the user wants to retain one or two of its commands, it does not have to erase all the commands and start over. The user can press the MODE button for four seconds and it will begin beeping. Then hit the SET button to enter the retrain mode. Then hit the MODE button again to step through the commands, which are indicated by the eye patterns.

If the user puts two electronic toys 90 together (two Electronic toys 90 or one Super and one regular), they will "talk" to each other. In order to get them to communicate, the user needs to face them to each other and touch their head switches. They will then "talk", and based on how happy they are, they will do different actions. Two happy dogs will sing to each other, one happy and one unhappy will just say "hi", and two unhappy dogs will fight. If two dogs have been communicating for a while, sometimes the dogs do not have to be facing each other or have been hit on the head to talk. The "talking" signals will bounce off the walls, so sometimes they may talk to each other "spontaneously".

Although a dog-shaped electronic toy was described as an example in the aforementioned embodiment, electronic toys in other shapes of animals such as a cat, tiger, lion, monkey, horse, elephant, giraffe, etc. may also be used as a matter of course.

When detection signals are output from the detection means, selected is information of an arbitrary motion pattern among the plurality of motion patterns stored in the storage means based on the count value of the counter means and parameter value set by the parameter alteration means. Thus, for example, when external inputs of sound or contact are made, it is possible to make the motions differ pursuant to the input timing. Moreover, as it is possible to control the toy to take unexpected actions in response to the input, the user will not lose interest even after long hours of playing with the toy since it will be difficult to predict the motion pattern. As parameters are changed while the happy mode and grumpy mode are alternated in predetermined cycles based on the control parameter which changes together with the lapse in time, the toy will switch to the happy mode or grumpy mode pursuant to the input timing, and it is therefore possible to increase the amusement by conducting unpredicted motions. The cycle of the happy mode and/or grumpy mode is changed in accordance with the number of detections, the cycle of the happy mode will be extended or the cycle of the grumpy mode will be extended pursuant to the way the user contacts the toy. Therefore, it is possible to increase the amusement since the motion pattern at such time will be difficult to predict and unexpected motions are conducted. As a special motion pattern is selected when the value representing the parameter change conforms with the count value of the counter means, the user will be amused in comparison to cases of ordinary motions as unexpected reactions unlike normal motions will be made. By detecting the changes in external sounds, external contacts, and the brightness of the surrounding light, the toy will recognize that it is being treated with affection. It is possible to produce interesting reactions in response to the inputs by making the motion pattern selected according to the sound detection frequency, contact detection frequency, and light detection frequency counted with the first to third counter means not repeat the same motion as in the case of a changed input.

An arbitrary motion may be selected from the data of posture motion patterns stored in the first storage unit, sound patterns stored in the second storage unit, and expression patterns stored in the third storage unit based on the count value of the counter means and parameter value set pursuant to the parameter alteration means. As the expression pattern includes a motion pattern of at least changing the size or shape of the eyes, it is possible to change the size or shape of the eyes based on the count value of the counter means and the parameter value set by the parameter alteration means. Thus, produced is an expression according to the changes in the character at such time.

The gender is set in accordance with the count value of the number of inputs detected during the setting of the initialization mode and at least one among the expressions of the eyes, sound, or motion corresponding to the set gender is changed. Thus, it is possible to priorly set as the initial value of the contact method of the user and the gender in accordance with such contact method. This enables the production as though electronic toy has a gender and character of an animal as individual differences will appear with respect to the expression, sound, and motion in correspondence with the contact of the user after initialization. Upon application of a battery, a selection switch is used for selecting either a character standard mode for causing motions of a standard specification character, or a character rearing mode for rearing a character. Pursuant to the operation of the selection switch, either the character standard mode or the character rearing mode is set, and motions are performed in accordance with the mode set. Thus, at the wish of the user, the character rearing mode can be omitted and motions can be performed in the character standard mode; otherwise, the user may select the character rearing mode and rear a character in his own way. The character standard mode is set by the initial setting means, motions are controlled on the basis of controlling data of said standard mode set in advance. Thus, the character rearing mode can be omitted, and motions can be controlled on the basis of controlling data of a general character. When the character rearing mode is set, controlling data is renewed to emotion data having a level of control in accordance with the number input from outside during a prescribed period of time, and motions are controlled pursuant to said renewed emotion data. The character of the toy is altered depending on the amount of contact by the user during a prescribed period of time, and motions can be controlled pursuant to the emotion data which depends on the user's handling of the toy. When the character rearing mode is set, further set are: an immature period where the controlling data is not renewed at prescribed time intervals; a rearing period where controlling data is renewed to emotion data with a level of control in accordance with the number input from outside during a prescribed period of time; and a completion-of-rearing period where motions are controlled in accordance with emotion data having a level of control renewed during the rearing period. By executing the character rearing mode, the toy experiences the immature period, the rearing period, and the completion-of-rearing period, and data of the toy is renewed to emotion data which depends on the frequency and method of contact by the user.

The emotion data is renewed in accordance with the frequency of input of sounds, food, contacts, etc. during said rearing period, and motions are controlled in accordance with such renewed emotion data. Thus, emotion data is renewed in accordance with the frequency and the method of contacts by the user. The emotion data is renewed during the rearing period in response to instructions provided in sounds registered by said voice registration means. Thus, emotion data is renewed, primarily reacting to the registered voice of the user. A second parameter which shows the degree of satiety depending on the frequency of input of food during said rearing period, and motions can be controlled in accordance with the renewed second parameter. Thus, the user can rear the toy, feeling as if it is his real pet, and the user can thereby enjoy the rearing period. The first parameter is changed in accordance with said second parameter renewed during the rearing period. The first parameter changes depending on the frequency of input of food by the user, and the cycle of the happy mode or the cycle of the grumpy mode may be extended. As a result, the current motion pattern is difficult to predict, and the amusement of the user is increased by the unexpected motions.

A memory stores the emotion data having the level of control renewed during the rearing period. After the end of the rearing period, motions can be performed in accordance with the emotion data set during the rearing period. The emotion data is saved in the memory so that the rearing period need not be repeated even if batteries are to be exchanged. A first controlling flag for performing actions following at least the instructions inputted pursuant to the emotion data, or a second controlling flag for performing actions differing from the inputted instructions is set. Thus, motions are performed in accordance with the flag set pursuant to the emotion data renewed during the rearing period, and a character corresponding to the set flag can be selected.

What is claimed is:

1. An electronic toy capable of controlling motions arbitrarily in accordance with external inputs, comprising:

a head housing a drive motor and a transmission mechanism for transmitting rotational driving force to said drive motor;

a display provided to the front of said head for displaying the shape of the eyes;

first detection means provided on the top of said head for detecting the pressing thereof;

second detection means for detecting sound;

third detection means for detecting the peripheral brightness;

initialization means for setting the initial mode for a period after the power is turned on until a prescribed time elapses;

fourth detection means for detecting external inputs;

a plurality of counters for counting the number of detections from the first, second, third and fourth detection means while the initial mode is being set by said initialization means;

individual difference setting means for setting individual differences in accordance with the detection means having the highest count value among the respective count values of said plurality of counters;

a body housing a cam mechanism for transmitting rotational driving force to said drive motor via said transmission mechanism;

legs driven by said can mechanism;

a lower jaw driven by said transmission mechanism;

ears driven by said transmission mechanism;

storage means for storing the respective motion patterns of said legs, lower jaw, and ears; and a controller for selecting an arbitrary motion pattern among the plurality of motion patterns stored in said storage means in accordance with the timing of detection signals output from said first to third detection means, and controlling said drive motor and the display pattern of said display in accordance with the selected motion pattern.

2. An electronic toy according to claim 1, wherein said individual difference setting means sets individual differences pursuant to whether the count value of said counter is an odd or even number.

3. An electronic toy according to claim 1, wherein said individual difference setting means sets the gender in accordance with the count value of said counter, and changes at least one among the expression of the eyes, sound, or motion corresponding to said set gender.

4. An electronic toy, comprising:

a body member having a head-shaped member disposed at an upper part of said body member and leg-shaped members movably disposed at lower parts of said body member, said head-shaped member being formed with a display disposed at a face portion of said head-shaped member, ear-shaped members movably coupled to said head-shaped member and a lower jaw-shaped member movably coupled to said head-shaped member;

a driving mechanism having a drive motor, a transmission mechanism functionally coupled to said drive motor so as to transmit a rotational driving force from said drive motor, and a cam mechanism driven by the rotational driving force transmitted from said transmission mechanism, wherein said ear-shaped members and said lower jaw-shaped member are driven by said transmission mechanism, wherein said leg-shaped members are driven by said cam mechanism;

storage means that stores data indicative of a plurality of motion patterns of said leg shaped members, said lower jaw-shaped member and said ear-shaped members, and data indicative of a plurality of eye expression patterns;

a plurality of sensors including a touch detection sensor disposed on a top of said head-shaped member so as to detect a touching action by a user, a sound detection sensor disposed so as to detect a sound made by the user, and an optical detection sensor disposed so as to detect a peripheral brightness;

a controller electrically coupled to said plurality of detection sensors, said drive motor and said display, wherein said controller selects a motion pattern among said plurality of motion patterns and an eye expression pattern among said plurality of eye expression patterns in accordance with a timing of detection signals received from said detection sensors, and controls said drive motor and said display in accordance with the selected motion and eye expression patterns;

initialization means that sets an initial mode when the power is turned on;

a plurality of counters that respectively count the number of detections on said plurality of sensors while the initial mode is being set by said initialization means; and character setting means that sets the character of the toy in accordance with the highest count value among the respective count numbers of said plurality of counters.

5. An electronic toy comprising:

a body member having a head-shaped member disposed at an upper part of said body member and leg-shaped members movably disposed at lower parts of said body member, said head-shaped member being formed with a display disposed at a face portion of said head-shaped member, car-shaped members movably coupled to said head-shaped member and a lower jaw-shaped member movably coupled to said head-shaped member;

a driving mechanism having a drive motor, a transmission mechanism functionally coupled to said drive motor so as to transmit a rotational driving force from said drive motor, and a cam mechanism driven by the rotational driving force transmitted from said transmission mechanism, wherein said ear-shaped members and said lower jaw-shaped member are driven by said transmission mechanism, wherein said leg-shaped members are driven by said cam mechanism;

storage means that stores data indicative of a plurality of motion patterns of said leg shaped members, said lower jaw-shaped member and said ear-shaped members, and data indicative of a plurality of eye expression patterns;

sensor means that detects external inputs;

a controller electrically coupled to said sensor means, said drive motor and said display, wherein said controller selects a motion pattern among said plurality of motion patterns and an eye expression pattern among said plurality of eye expression patterns in accordance with a timing of detection signals received from said sensor means, and controls said drive motor and said display in accordance with the selected motion and eye expression patterns;

initialization means that sets an initial mode when the power is turned on;

a counter that counts the number of detections on said sensor means while the initial mode is being set by said initialization means; and character setting means that sets the character of the toy pursuant to whether the count number of said counter is an odd or even number.

6. An electronic toy comprising:

a body member having a head-shaped member disposed at an upper part of said body member and leg-shaped members movably disposed at lower parts of said body member, said head-shaped member being formed with a display disposed at a face portion of said head-shaped member, ear-shaped members movably coupled to said head-shaped member and a lower jaw-shaped member movably coupled to said head-shaped member;

a driving mechanism having a drive motor, a transmission mechanism functionally coupled to said drive motor so as to transmit a rotational driving force from said drive motor, and a cam mechanism driven by the rotational driving force transmitted from said transmission mechanism, wherein said ear-shaped members and said lower jaw-shaped member are driven by said transmission mechanism, wherein said leg-shaped members are driven by said cam mechanism;

storage means that stores data indicative of a plurality of motion patterns of said leg shaped members, said lower jaw-shaped member and said ear-shaped members, and data indicative of a plurality of eye expression patterns;

sensor means that detects external inputs;

a controller electrically coupled to said sensor means, said drive motor and said display, wherein said controller selects a motion pattern among said plurality of motion patterns and an eye expression pattern among said plurality of eye expression patterns in accordance with a timing of detection signals received from said sensor means, and controls said drive motor and said display in accordance with the selected motion and eye expression patterns;

initialization means that sets an initial mode when the power is turned on;

a counter that counts the number of detections on said sensor means while the initial mode is being set by said initialization means; and character setting means that sets the gender in accordance with the count number of said counter, and changes at least one among the expression of the eyes, sound, or motion corresponding to said set gender.

7. An electronic toy capable of controlling motions arbitrarily in accordance with external inputs, comprising:

a selection switch for selecting between a character standard mode for performing motions of a standard specification character and a character rearing mode for rearing a character;

a memory for storing an initial setting for said character standard mode or said character rearing mode in accordance with the operation of said selection switch, wherein said character rearing mode is set by an initial setting of said memory for:

an immature period where said controlling data is not renewed at prescribed time intervals;

a rearing period where controlling data is renewed to emotion data with a level of control in accordance with the external inputs during a prescribed period of time; and a completion-of-rearing period where motions are controlled in accordance with emotion data with a level of control renewed during said rearing period; and a programmable controller responsive to said memory for performing motions in said character standard mode or said character rearing mode in accordance with the operation of said initial setting means.

8. An electronic toy according to claim 7, wherein said character standard mode is set by an initial setting associated with said memory, said programmable controller controlling motions on the basis of data of said standard mode.

9. An electronic toy according to claim 8, wherein said character rearing mode is set by an initial setting associated with said memory, the controlling data being renewed to provide emotion data with a level of control in accordance with the external inputs during a prescribed period of time, and motions controlled pursuant to said renewed emotion data.

10. An electronic toy capable of controlling motions in accordance with external inputs, comprising:

a character mode selection switch;

initial setting means which, in response to an operation on said character mode selection switch, selects a character mode for the toy from a character standard mode for performing motions of a standard specification character and a character rearing mode for rearing a character; and a programmable controller that controls motions of the toy in said character standard mode or in said character rearing mode in accordance with said initial setting means, wherein, when said character standard mode is set, the motions of the toy are controlled in accordance with preset data, wherein, when said character rearing mode is set, emotion data is renewed in accordance with external inputs, and the motions of the toy are controlled pursuant to said renewed emotion data, in which said character rearing mode comprises an immature period where said controlling data is not renewed; a rearing period where controlling data is renewed to provide the emotion data in accordance with the external inputs during a prescribed period of time; and a completion-of-rearing period where motions are controlled in accordance with the renewed emotion data.

11. An electronic toy according to claim 10, wherein the emotion data is renewed in accordance with the frequency of input of sounds, food, contacts, etc. during said rearing period, and motions are controlled in accordance with said renewed emotion data.

12. An electronic toy according to claim 10, wherein said programmable controller sets either a first controlling flag for performing actions pursuant to at least the content of instructions which are input, or a second controlling flag for performing actions differing from said inputted instructions, and motions are controlled in accordance with the flag set.

* * * * *